US011557414B2

(12) United States Patent
Gedlick et al.

(10) Patent No.: US 11,557,414 B2
(45) Date of Patent: Jan. 17, 2023

(54) MAGNETICALLY INTERCONNECTABLE BLOCK STRUCTURES AND METHODS FOR MAKING THE SAME

(71) Applicant: IDEA VAULT HOLDINGS INC, Ashland, OR (US)

(72) Inventors: Joshua J. Gedlick, Ashland, OR (US); Jordan M. Willing, Ashland, OR (US); Michael E. Munter, Ashland, OR (US); Howard Allen Wilson, IV, Medford, OR (US)

(73) Assignee: IDEA VAULT HOLDINGS INC, Ashland, OR (US)

( * ) Notice: Subject to any disclaimer, the term of this patent is extended or adjusted under 35 U.S.C. 154(b) by 0 days.

(21) Appl. No.: 17/238,700

(22) Filed: Apr. 23, 2021

(65) Prior Publication Data

US 2021/0335527 A1 Oct. 28, 2021

Related U.S. Application Data

(60) Provisional application No. 63/014,613, filed on Apr. 23, 2020.

(51) Int. Cl.
*H01F 7/02* (2006.01)

(52) U.S. Cl.
CPC ..... *H01F 7/02* (2013.01)

(58) Field of Classification Search
CPC ..... H01F 7/02; H01F 7/0252
See application file for complete search history.

(56) References Cited

U.S. PATENT DOCUMENTS 2,955,239 A * 10/1960 Rouse ..... H01F 7/0252 211/DIG. 1
6,022,025 A 2/2000 Chuang
(Continued)

FOREIGN PATENT DOCUMENTS

CN 85100485 A 11/1985
CN 202028181 U 11/2011
(Continued)

OTHER PUBLICATIONS

International Search Report and Written Opinion for corresponding PCT Application No. PCT/US2021/028822, dated Aug. 5, 2021 (9 pages).

(Continued)

*Primary Examiner* — Mohamad A Musleh
(74) *Attorney, Agent, or Firm* — Lewis Roca Rothgerber Christie LLP

(57) ABSTRACT

Disclosed is a magnetic housing assembly which may have a housing body, a first capping structure; a second capping structure; a water-tight chamber defined by the first capping structure and the second capping structure; a ratcheting face; a magnet enclosed within the water-tight chamber; at least one ridge on the perimeter of the housing body, where the magnet can flip to reverse polarity within the water-tight chamber, where the ratcheting face is configured to allow adjustment of the assembly when connected with another structure also having a ratcheting face. Also disclosed is a system including a structure configured to house the plurality of magnetic housing assemblies while exposing a surface of the magnetic housing assemblies.

20 Claims, 136 Drawing Sheets

(56) References Cited

U.S. PATENT DOCUMENTS

| | | | | |
|---|---|---|---|---|
| 7,985,116 | B2 | 7/2011 | Song et al. | |
| 7,988,518 | B2 | 8/2011 | Kim et al. | |
| 8,070,550 | B2 | 12/2011 | Song et al. | |
| 8,128,452 | B2 | 3/2012 | Kim et al. | |
| 8,790,151 | B2 | 7/2014 | Bertrand et al. | |
| 8,850,683 | B2 | 10/2014 | Haughey et al. | |
| 9,873,061 | B2 | 1/2018 | Cheung et al. | |
| 2008/0305708 | A1 | 12/2008 | Toht et al. | |
| 2009/0181595 | A1* | 7/2009 | Song | A63H 33/046 446/92 |
| 2014/0227939 | A1 | 8/2014 | Kim | |
| 2015/0004869 | A1 | 1/2015 | Kim | |
| 2017/0095747 | A1* | 4/2017 | Cheung | A63H 33/046 |

FOREIGN PATENT DOCUMENTS

| | | | | | |
|---|---|---|---|---|---|
| CN | 104645639 | A | | 5/2015 | |
| CN | 213555373 | U | * | 6/2021 | |
| DE | 195 11 588 | C2 | | 2/1997 | |
| EP | 1 134 011 | A2 | | 9/2001 | |
| EP | 2239026 | A1 | * | 10/2010 | A63H 33/046 |
| EP | 3 549 649 | A1 | | 10/2019 | |
| FR | 2866933 | A1 | * | 9/2005 | H01F 7/0242 |
| KR | 30-0589698 | | | 2/2011 | |
| KR | 20110026895 | A | * | 3/2011 | |
| KR | 30-0627940 | | | 1/2012 | |
| KR | 10-1421585 | B1 | | 7/2014 | |
| KR | 10-1600529 | B1 | | 3/2016 | |
| KR | 30-0893715 | | | 2/2017 | |
| KR | 30-0893721 | | | 2/2017 | |
| KR | 30-0893722 | | | 2/2017 | |
| KR | 30-0896045 | | | 3/2017 | |
| WO | WO 2014/038735 | A1 | | 3/2014 | |
| WO | WO-2014038735 | A1 | * | 3/2014 | A63H 33/046 |
| WO | WO 2015/153827 | A1 | | 10/2015 | |
| WO | WO 2015/160113 | A1 | | 10/2015 | |
| WO | WO-2015160113 | A1 | * | 10/2015 | A63H 33/10 |
| WO | WO 2017/131277 | A1 | | 8/2017 | |

OTHER PUBLICATIONS

SPYTEC M2 Waterproof Magnetic Case for GL300 Real-Time GPS Trackers; Amazon.com printout retrieved from https://www.amazon.com/Spy-Tec-Waterproof-Weatherproof-Real-Time/dp/B00L1G6GCS (Retrieved on Mar. 11, 2020) 9 pages.

GLOUE 254 PCS Magnetic Building Blocks Magnets Toys, Gloue.com printout retrieved from https://gloue.com/products/gloue-254-pcs-magnetic-building-blocks-magnets-toys-200-piece-magnetic-stacking-tiles-54-letter-card-w-stickers-deluxe-building-set-for-boys-girls-254 (Retrieved on Mar. 11, 2020) 3 pages.

INTOCK Magnetic Blocks, Amazon.com printout retrieved from https://www.amazon.com/Intock-Magnetic-Building-Unlimited-Imagination/dp/B07PYK3WBQ/ref=sr 1 2?keywords=intock+magnetic+blocks&gid= 1585695779&sr=8-2 (Retrieved on Mar. 11, 2020) 8 pages.

TEENTUMN Magnet Blocks, Amazon.com printout retrieved from https://www.amazon.com/Teentumn-Magnetic-Educational-Development-Toys-Great/dp/B07WM15M7W?ref=ast bbp dp&th=1&psc=1 (Retrieved on Apr. 1, 2020) 6 pages.

BRIO Magnetic Building Blocks, FatBrainToys.com printout retrieved from https://www.fatbraintoys.com/toy companies/ravensburger/brio magnetic building blocks. cfm?country=US&source=google pla&kwid=SH192-. 1&gclid=EAIaIQobChMI4gGD OWt5QIVXSCtBh32Bwo1EAYYCSABEgJKTvD BwE#product description (Retrieved on Mar. 11, 2020) 2 pages.

* cited by examiner

MAGNETICALLY INTERCONNECTABLE BLOCK STRUCTURES AND METHODS FOR MAKING THE SAME

CROSS-REFERENCE TO RELATED APPLICATION(S)

This U.S. utility patent application claims priority to and the benefit of U.S. Provisional Patent Application Ser. No. 63/014,613, filed on Apr. 23, 2020, entitled MAGNETICALLY INTERCONNECTABLE BLOCK STRUCTURES AND METHODS FOR MAKING THE SAME, the entire contents of which is incorporated herein by reference.

BACKGROUND

In the past there have been magnetically interconnected structures designed which were intended to allow for larger structures to be built from the base units. Such magnetically interconnected structures have been used in, for example, children's toys.

SUMMARY

It is appreciated by the inventors that current designs of magnetically interconnected structures suffer from one or more drawbacks that may limit how they may be used and manufactured. For example, current designs typically allow them to be used primarily in protected environments, otherwise the key magnetic assemblies may corrode and rust. This limits their ability to engage in water-based activities such as baths or pools. Further, current designs typically require cutting and machining sheets of foam or other material to form desired structural shapes. The magnetic interconnection assemblies, typically formed of plastic, may be then glued into position within a cavity formed in the block. The process is time-consuming and presents opportunities for errors along the production process that may require lengthy quality control measures to ensure against failed bonds between the magnetic assemblies and the foam structure. Still further, current implementations typically do not provide a method to quickly evacuate water trapped within the housings of the interconnections or block structures. This may be especially important in either bath or pool environments, in which the products may be used as a water toy.

One or more embodiments of the present disclosure may be drawn to a magnetic housing assembly. The magnetic housing assembly may have a housing body, a first capping structure; a second capping structure; a water-tight chamber defined by the first capping structure and the second capping structure; a ratcheting face; a magnet enclosed within the water-tight chamber; at least one ridge on the perimeter of the housing body, where the magnet can flip to reverse polarity within the water-tight chamber, where the ratcheting face is configured to connect with another ratcheting face, and where the ratcheting face is configured to allow adjustment of the magnetic housing assembly in a tangential direction when connected with another ratcheting face.

One or more embodiments of the present disclosure may be drawn to a system including a plurality of magnetic housing assemblies, and a structure configured to house the plurality of magnetic housing assemblies while exposing the surface of the magnetic housing assemblies with a ratcheting face for each magnetic housing assembly housed in the structure.

The exemplary embodiments described in more detail herein may include one or more features that address or improve upon one or more drawbacks of existing designs. The features of any one embodiment may be combined with one or more features of another embodiment to produce embodiments that realize complementary advantages of the various features. The exemplary embodiments provide one or more added benefits. By way of example only, and not by way of limitation, one or more embodiments may include one or more features that allow for a watertight or hermetically sealed housing for the interconnections and/or magnets to protect against corrosion from water intrusion or contaminants, improved subassemblies that protect the magnet and allow it to flip into polarity to couple different blocks, mechanisms to facilitate connections and provide audible sounds, simplified moldings and improved injection molding techniques to improve the manufacturing process and reduce the need for extensive quality control, improved shapes for blocks and fully assembled structures, and other beneficial features as described more fully herein.

BRIEF DESCRIPTION OF THE DRAWINGS

These and other aspects of the exemplary embodiments may be better understood with reference to the accompanying drawings, in which

FIGS. 1-10 show various perspective views, a top view, a side view, cross-sectional views, and exploded views of an exemplary embodiment of a magnetic housing assembly which utilizes a ratcheting cap;

FIGS. 116-125 show various perspective views, a top view, a side view, cross-sectional views, and exploded views of an exemplary embodiment of a magnetic housing assembly which utilizes a ratcheting cap.

DETAILED DESCRIPTION

Figure 1:
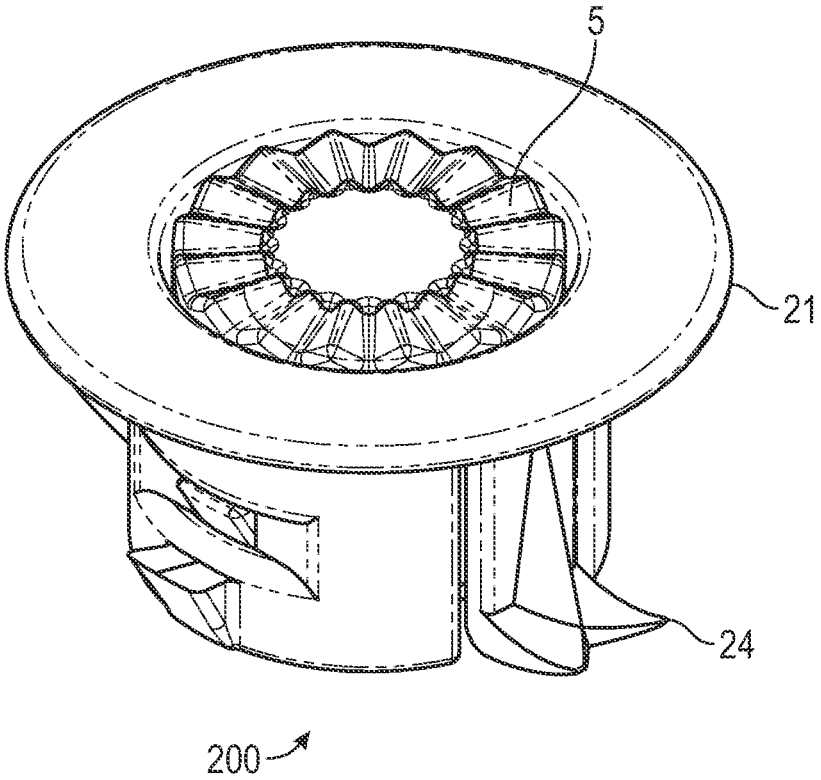
FIGS. 1-120 illustrate various features and embodiments. The illustrated embodiments are illustrative only. The illustrated features and concepts may be mixed and matched across different embodiments to create alternative embodiments. In the drawings.

In the below description, a cylindrical coordinate system may be used to describe one or more embodiments. In this application, a radial direction may refer to a distance from a center of a circle along a generally circular face of a cylinder in a plane; an axial direction may refer to a height of the cylinder and a distance from a center of a circle along a direction which is normal to the generally circular face of a cylinder; and a tangential direction may refer to a degree of rotational movement (e.g. displacement from a neutral position of 0-degrees) along the generally circular face of a cylinder. However, not every embodiment described herein may be described using such a cylindrical coordinate system.

Referring to FIGS. 111-115, shown is a structure body 100 configured to house a plurality of magnetic housing assemblies 225 in corresponding voids 105 within the while exposing a surface of each magnetic housing assembly housed within the structure body 100. Any of the magnetic housing assemblies disclosed herein may be used in the secondary structure bodies. The structure body 100, when housing one or more magnetic housing assemblies 225, may be a monomer structure unit assembly 300 of a larger system which is composed of a plurality of such structures 300, where each monomer structure unit assembly 300 may house one or more magnetic housing assemblies 225. The plurality of monomer structure unit assemblies 300 can then be connected together by attaching the exposed faces of the magnetic housing assemblies to one another, which will be held together by an attractive magnetic force between the magnets housed therein. In addition, it may be possible to adjust the orientation of the monomer structure unit assemblies 300 relative to one another when connected by rotating each structure in a tangential direction relative to the face of the subsequent structure, with the exposed face of each magnetic housing assembly securing the position of each connected unit structure relative to the next.

For example, in one embodiment, the structure body 100 and monomer structure unit assembly 300 may be in the shape of a block, and may house six magnetic housing assemblies, one in each face of the block structure body 100. The monomer structure unit assembly 300 can then be connected with a subsequent monomer structure unit assembly 300 by placing the subsequent assembly 300 adjacent to the first, and the magnets housed with each magnetic housing assembly 225 will then hold the monomer structure unit assemblies 300 together. In addition, as will be further described below, the orientation of each monomer structure unit assembly 300 can be adjusted relative to one another by rotating each monomer structure unit assembly 300, which will then be secured in position by the exposed surfaces of each magnetic housing assembly 225 contained therein.

The shape of the structure body 100 is not limited to a block, and can be any shape, such as rectangular blocks, polygonal prisms, cylinders, cones, spheres, other conical shapes, pyramids, irregular shapes, or any other shape which may house the magnetic housing assemblies disclosed herein. In this manner, the methods and structures of present embodiments may be used to produce any manner of structure which can be imagined by the end user, and they can be used to model a variety of different environments. For example, the monomer structure unit assembly 300 could act similarly to LEGOS® and may be used to construct, buildings, robots, landscapes, roads, castles, or other structures.

In one or more embodiments, the structure body 100 may be made from foam, for example, ethylene-vinyl acetate (EVA), polyurethane (PU), or cross lined polyethylene, among various possibilities. The magnetic housing assemblies may be inserted into the foam, and may be screwed into the foam blocks where there may be an appropriate structure on the magnetic housing assembly to be inserted, such as a spiral ridge along the perimeter of the magnetic housing assembly. For example, such a ridge 35 is shown in FIGS. 126-135. When made from foam, the monomer structure unit assemblies 300 may be well suited for use in water as bath toys, and can be further modified by the end user by puncturing holes through the structure body 100 as to allow for water to drain through the structure.

Referring to FIGS. 126-135, shown is an embodiment of a magnetic housing assembly 205. Shown in these figures is: a main housing body 32; a threading ridge 35 surrounding the perimeter of the main housing body 32; a ratcheting face 5 located on a ratcheting cap 20; a lower cap 39; a water tight chamber or hermetically sealed chamber defined by the space between the ratcheting cap 20 and the lower cap 39; a magnet 10 within the hermetically sealed chamber; a housing cap 33 attached to the bottom of the main housing body 32; a plurality of slots in the housing body, positioned on an interior surface of the housing body; and an installation tool 37 with a plurality of teeth which insert into the plurality of slots within the housing body. In some embodiments, the slots and the tool may have barbed teeth to prevent removal of the magnetic housing assembly 225 by screwing in a reverse direction.

In this embodiment illustrated in FIGS. 126-135, the main housing body 32 generally defines the shape of the magnetic housing assembly, and may be a top shaped structure with a generally cylindrical main body, having a spiraling threading ridge 35 surrounding a curved exterior surface of the generally cylindrical main housing body 32. The top shaped generally cylindrical main housing body 32 has a larger diameter circle (e.g. larger radius) sitting atop the main housing body 32, and the interior of the main housing body may be hollowed out except as to the slotted surface which defines the plurality of slots and sits below approximately midway within the cylindrical cavity in the main housing body. The hollow interior of the main housing body 32 may be capped with a housing cap 33 at the base of the structure, which may form a watertight seal and define a lower surface of the main housing body 32. One benefit of the larger diameter circle sitting atop the main housing body 32 is that it may increase the size of the magnetic housing assembly 205 to a point such that it is too large to swallow, as to prevent choking by children. Any of the embodiments described herein may also be similarly sized to be too large to swallow, as to prevent choking by children.

In this embodiment illustrated in FIGS. 126-135, the ratcheting cap 20 may be a top shaped structure with a generally cylindrical hollow main body with a larger diameter circle sitting atop the cylindrical main body. The ratcheting surface 5 may be a larger diameter circle sitting atop the cylindrical hollow main body. The bottom of the ratcheting cap 20 may be sealed in watertight manner to a lower cap 39 to define a water tight chamber or hermetically sealed chamber within the cylindrical hollow main body. The hermetic seal may be accomplished by ultrasonic welding, for example, among other possible methods. A magnet 10 may be placed within the water tight chamber or hermetically sealed chamber within the cylindrical hollow main body of the ratcheting cap 20.

The water tight chamber or hermetically sealed chamber may be large enough to allow for the magnet to flip in polarity (e.g. flip orientation) within the chamber when shaken or moved. In one or more embodiments, the diameter of the chamber may be large enough to allow the magnet to flip and spin freely along the largest cross-section of the given shape, possibly along the longest length of the magnet defined in the largest cross-section, as to allow for it to easily flip in polarity. For example, in the case of a rectangular prismatic magnet (e.g. cube, block, sheet), the chamber may have a diameter which is large enough to allow the hypotenuse (e.g. diagonal length) of the largest rectangular face to rotate freely within the chamber. The hypotenuse may include the thickness of the magnet to include both its thickness in a z-direction as well as the length of the hypotenuse in an x-y direction. In some embodiments, the chamber may have a diameter and height which is large enough to allow the hypotenuse (e.g. diagonal length) of the largest rectangular face to rotate freely within the chamber.

In other embodiments, the chamber may be cylindrical in shape have a diameter and height and diameter to allow for a cylindrical shaped magnet to freely rotate when measuring the longest diagonal length from a bottom right point of the cylinder on the circumference of the lower face, to an upper left point of the cylinder on the circumference of the upper face. Various shapes of magnets may be utilized in the chamber as to allow for the magnet to easily flip in polarity; for example, a cube shaped magnet may be used in a smaller sized chamber, a disc shaped magnet with a larger face and a lower vertical profile may be used in a larger sized chamber, or a cylindrical shaped magnet with a smaller face and larger vertical profile may be used in smaller or moderate sized chambers, among various possibilities disclosed herein.

In this embodiment illustrated in FIGS. 126-135, the ratcheting cap 20, and the water tight chamber or hermetically sealed chamber containing the magnet 10, may then be inserted into the mostly hollowed out main housing body 32, to define the magnetic housing assembly shown in this embodiment. There may be one or more protruding posts, insertion points or structures which extend downward from the larger diameter circle sitting atop the cylindrical hollow main body of the ratcheting cap 20 to allow the ratcheting cap 20 to securely attach to the main housing body 32. The protruding posts at the bottom of the ratcheting cap may interface with a slot of a few degrees to limit the amount the ratcheting ring 40 can move rotationally, and may provide a few degrees of rotational motion in one or more embodiments. For example, the degree of rotational motion may be between about 5 and 12 degrees, and may be between 5.625 and 11.25 degrees.

In some embodiments, the insertion points, protruding posts, or structures facilitating attachment to the main housing body 32 may be friction fits, snap fit, locking mechanisms, or mere contact points which may be then glued, ultrasonically welded, or otherwise fastened using an acceptable method within the art to attach the ratcheting cap 20 to the main housing body 32. While the ratcheting cap 20 is described as a top shaped structure with a generally cylindrical main body, it need not be made in this shape, and may be made in other shapes that may be suitable to insert into a main housing body, including, for example, a rectangular prism, polygonal prism, pyramid, or other shape.

Once assembled, the magnetic housing assembly 225 may then be inserted into a foam block, or other secondary housing structure, using the installation tool 37 to screw the magnetic housing assembly 225 into the foam block, with the threading ridge 35 digging into the foam block to secure the assembly. The plurality of teeth on the installation tool 37 may insert into the plurality of slots within the housing body and rotate the assembly at multiple points to allow for the magnetic housing assembly 225 to be screwed in easily.

The ratcheting face 5 can be described as a surface with a plurality of ridges arranged in a repeating pattern along a tangential direction, for example about a circle, where the plurality of ridges may be defined by a first upwardly slanting surface, and a second downwardly slanting surface, wherein the first upwardly slanting surface may be connected to the second downwardly slanting surface. The ridges may be spaced apart from one another as to allow tangential movement of the magnetic housing assembly in approximately 22.5-degree increments when connected to another like structure also having a plurality of ridges arranged in a same configuration. The ridges may allow for approximately 11.25-degrees of rotation in either a clockwise or counterclockwise direction from a neutral position between ridges before interlocking with a subsequent ridge. The ratcheting face 5 defined by the plurality of ridges allow for 360-degree adjustment about an axis the magnetic housing assembly when connected to another like structure also having a plurality of ridges arranged in a same configuration (e.g. another ratcheting face).

In one or more embodiments, there may be a minimum of 11.25-degrees of radial freedom of motion in each puck, and 22.5-degrees of motion between two paired ratcheting faces, with there being 22.5-degrees between the teeth or ridges of the ratcheting face, as to always assure alignment. For example, the blocks may align substantially perfectly no matter their orientation because the teeth or ridges of each ratcheting face may be configured to interlock with each other, and be pulled into an interlocking neutral position by the attractive force of the magnets housed underneath the ratcheting face. For example, the rotational movement (e.g. rotation along a tangential direction) may relate to the number of teeth, the maximum degrees of rotation (e.g. 360-degrees), and the number of interlocking ratcheting faces (e.g. two connected ratcheting faces), as described by the formula:

$$\theta \geq \frac{360^\circ}{2T}$$

where θ is the degrees of rotational movement along a tangential direction, and T is the number of teeth or ridges in a ratcheting face, 360° is the maximum amount of rotation, and 2 represents the number of interlocking ratcheting faces, as each block may share half the amount of rotation.

While the ratcheting face 5 may be defined by a plurality of ridges arranged in a repeating pattern along a tangential direction, the structure defining the ratcheting face need not be arranged in such a pattern. For example, interlocking structures such as hooks, or interlocking ridges arranged in a planar direction (e.g. up and down, side to side) may also be used to construct the ratcheting faces.

The shape of the magnetic housing assemblies is not limited to a generally cylindrical shape, and can be any shape, such as rectangular blocks, polygonal prisms, cones, other conical shapes, pyramids, or any other shape which may house the magnets and insert into a foam block, or other secondary structure containing the assemblies. Similarly, the threading ridge need not be in the shape of a thread that surrounds the circumference of the magnetic housing assemblies, but attachment of the magnetic housing assemblies to a foam block, or other secondary housing structure, may also be facilitated by one or more spikes extending from the assembly at an angle, for example, a 45-degree angle, with one such spike on each side of the assembly. However, the use of a threaded ridge may be advantageous in that it does not present a hazard to children, as a spike, or other securing structure, could possibly pose.

In one or more embodiments of a magnetic housing assembly, an assembly of a magnetic housing may use an ultrasonically or chemically-welded watertight or hermetically sealed enclosure to protect the magnet 10 from exposure to wet and corrosive environments. Expanding features may be implemented to embed the plastic (or other material) housing into the foam (or other material) without the need for additional adhesives, for example, the threading ridge 35 or spikes described above. This embodiment may reduce or overcome the challenges of permanently affixing two materials with low-surface energies. This embodiment may also reduce the time required to assemble the parts including simplifying the quality control process and secondary tests to ensure proper adhesion between the assemblies. Similarly, other embodiments of the magnetic housing assemblies may also be hermetically sealed by being ultrasonically or chemically welded, including, for example, the embodiments shown in FIGS. 126-135.

This embodiment may incorporate a combination of parts to produce an assembly that allows exterior faces of connecting blocks to align in a planar manner, for example, allowing alignment along the surface of the ratcheting faces 5. The contacting surfaces may include a ratcheting interface that may include a plurality of protrusions, teeth, or other interface, to create an audible "clicking" noise. In one embodiment, the face may float for a few degrees radially to allow exterior faces of the blocks to align. The faces may also float axially so that the ratcheting teeth can pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Referring to FIGS. 1-10, magnetic housing assembly 200 may be inserted into an aperture configured to receive the body, or may be machined, or injection-molded into foam, wood, plastic, or other material. Next, the inner assembly containing a hermetically-sealed enclosed magnet 10 in which the shape of the magnet 10 may be a cube, sphere, cylinder, or other shaped component, within a plastic (or other material) housing that may be inserted into the anchor body 21. In one embodiment, the interference between the anchor body tabs 24 and the plastic (or other material) housing forces the anchor tabs outward into the foam (or other material) block tightly or permanently connecting the anchor body 21 and the foam (or other material). The connection between the anchor body 21 and the plastic (or other material) assembly may be made through a snap-fit tab or other mechanism that locks the two parts together tightly or permanently.

This embodiment may allow for the magnet 10 to flip within the housing, thereby allowing each magnet 10 to orient itself into the correct polarity to pair with another magnetic block assembly.

Figure 2:
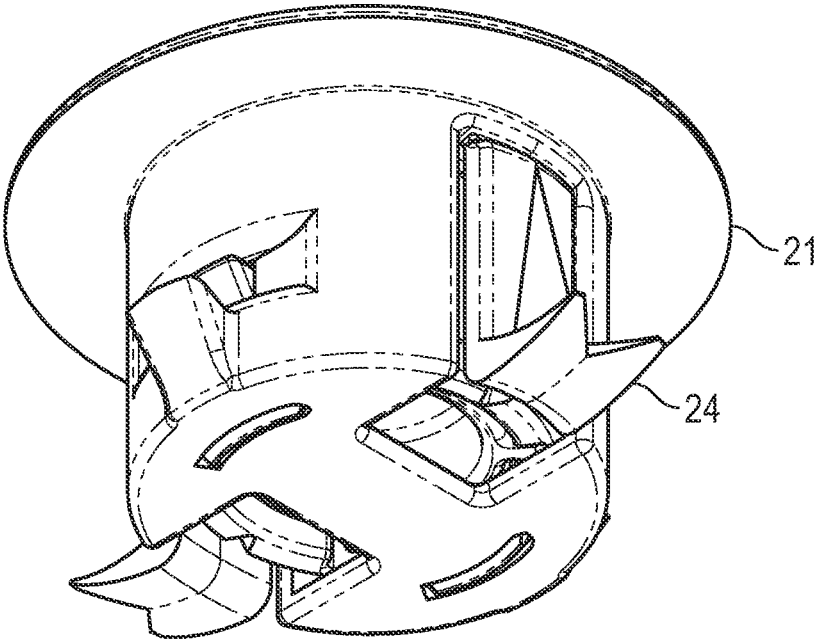
Figure 3:
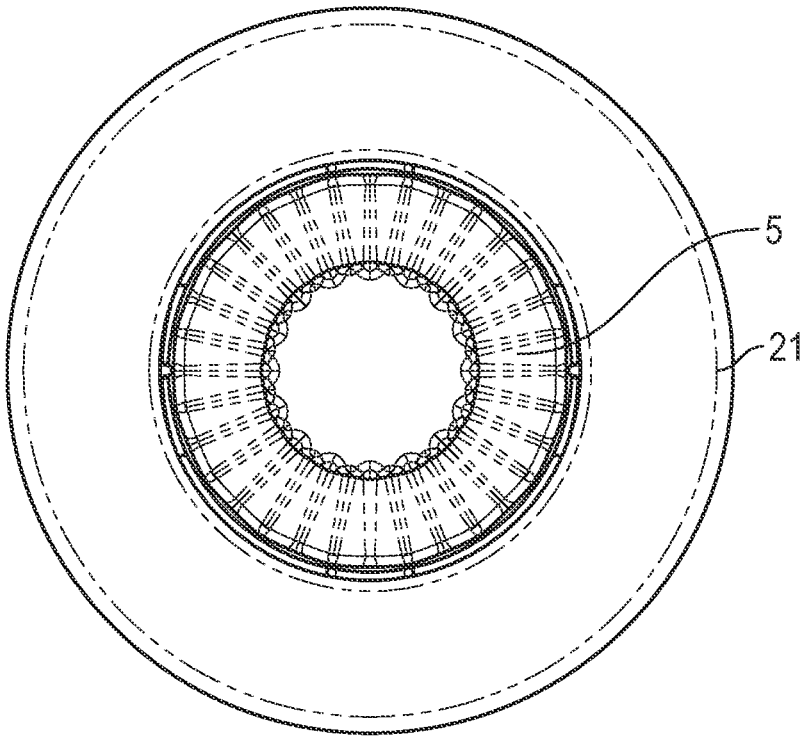
Figure 4:
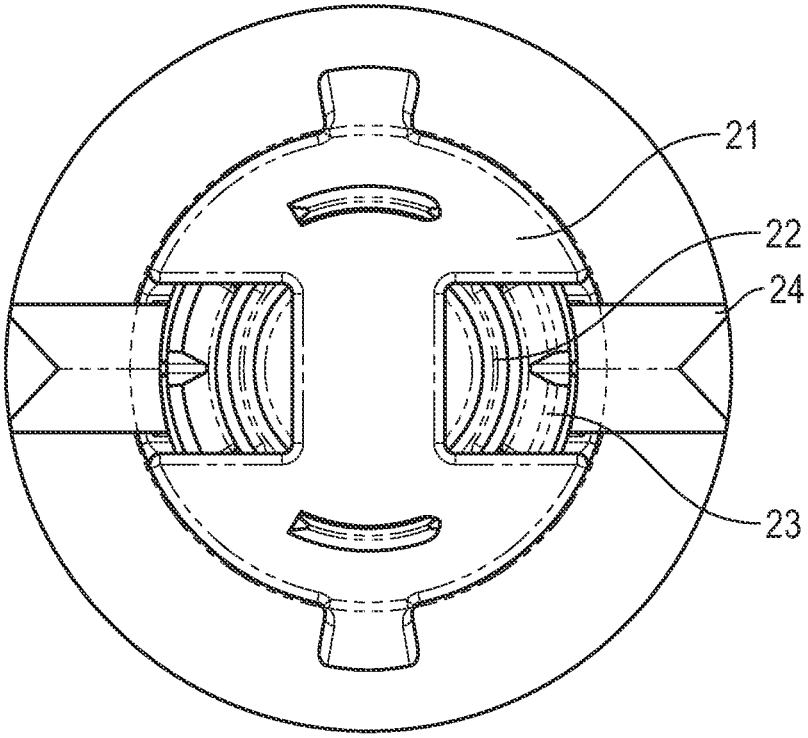
Figure 5:
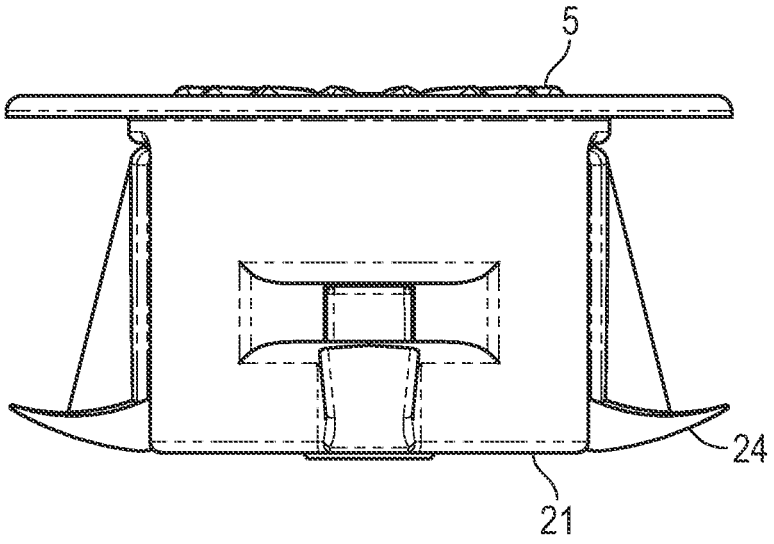
Figure 6:
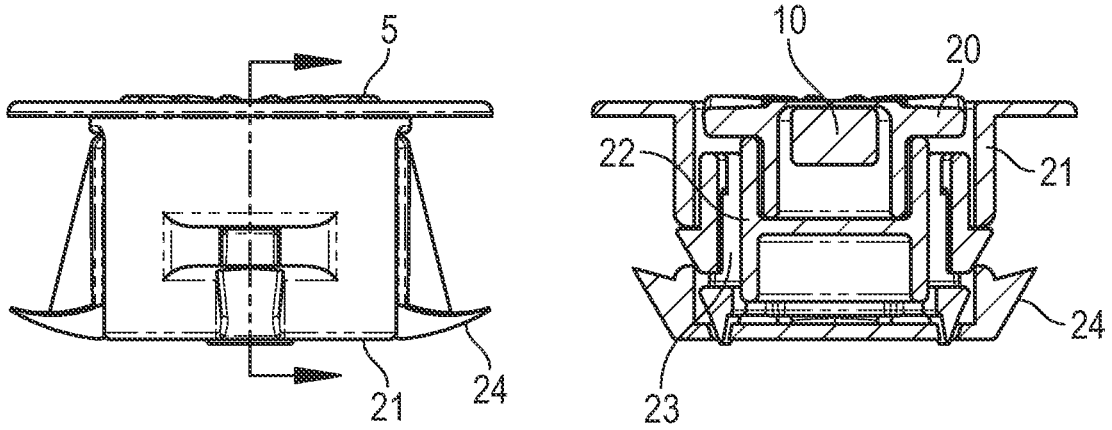
Figure 7:
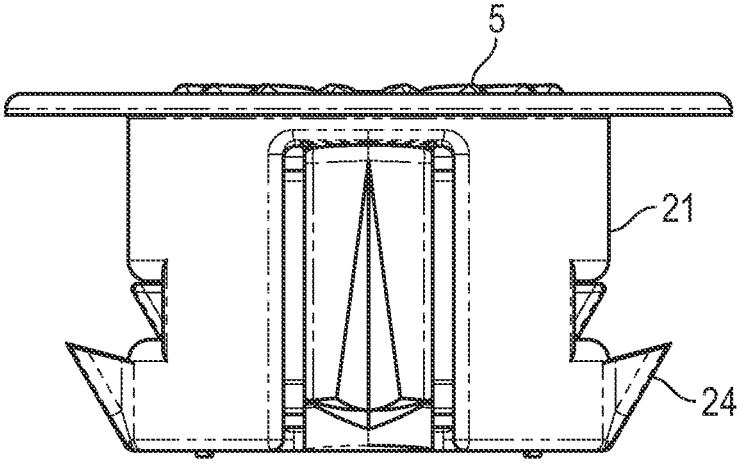
Figure 8:
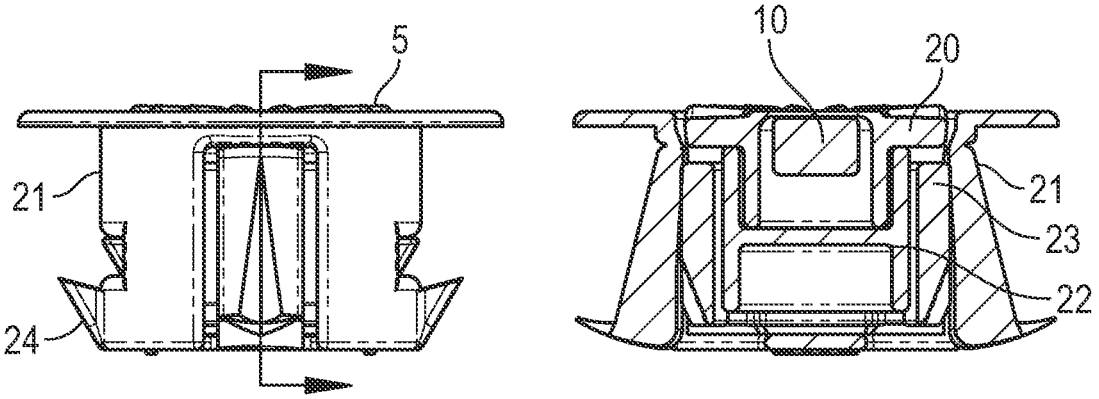
Figure 9:
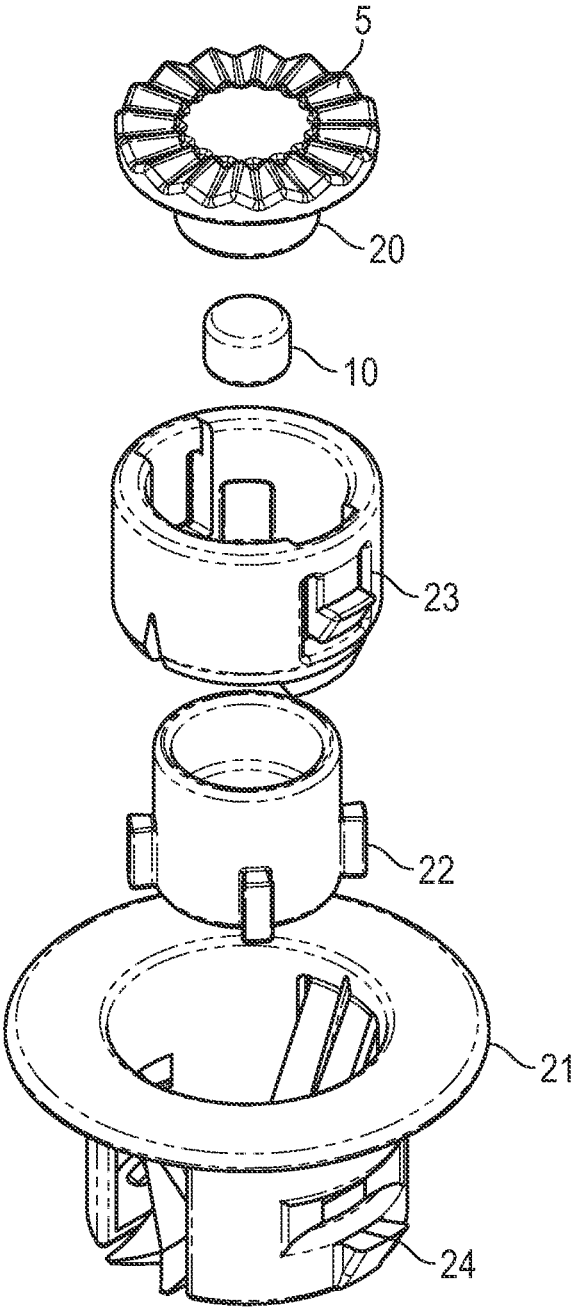
Figure 10:
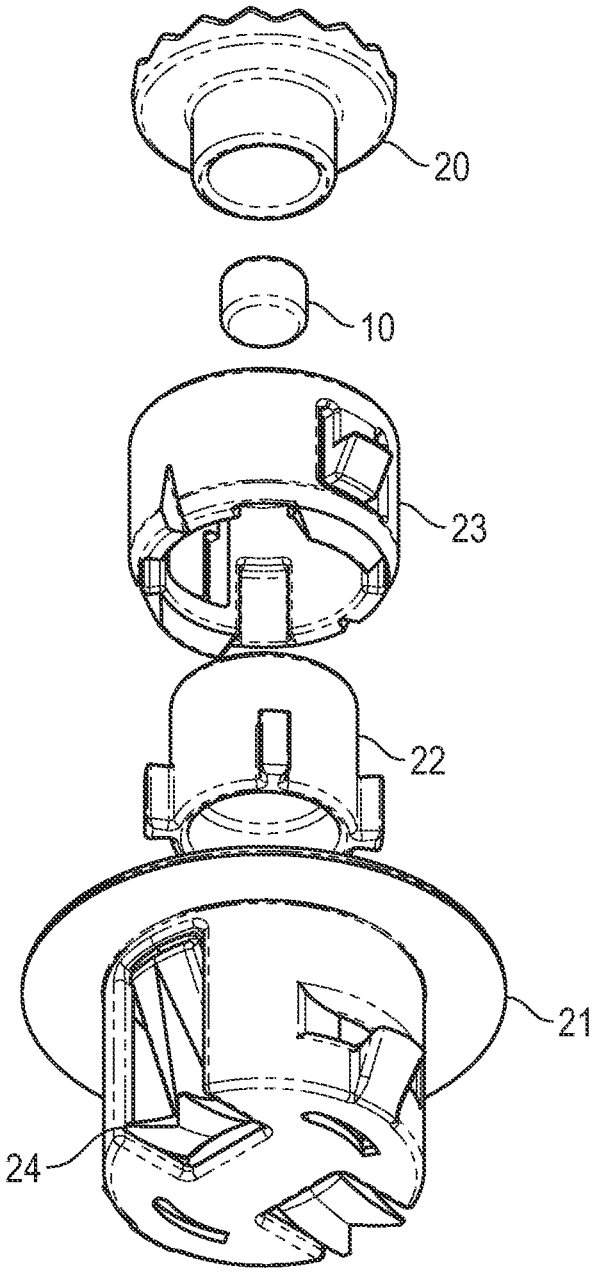

The exemplary embodiment is further described with reference to FIGS. 1-10, in which:

FIG. 1 is an isometric top view of an assembly with all parts combined and the expanding features deployed;

FIG. 2 is an isometric bottom view of the assembly with the parts combined and the expanding features deployed;

FIG. 3 is a top view of the assembly with the parts combined and the expanding features deployed;

FIG. 4 is a bottom view of an assembly with the parts combined and the expanding features deployed;

FIG. 5 is a front view of an assembly with the parts combined and the expanding features deployed;

FIG. 6 is a front cross-sectional view of an assembly with the parts combined and the expanding features deployed;

FIG. 7 is a side view of an assembly with the parts combined and the expanding features deployed;

FIG. 8 is a side cross-sectional view of the assembly with the parts combined and the expanding features deployed; and FIG. 9 is an exploded top isometric view of an exemplary magnetic housing assembly, that may include a ratcheting face 5, magnet, containment housing 23, rotational limiting housing 22 and anchoring body 21 as it is molded before anchor deployment; and FIG. 10 is an exploded bottom isometric view of the magnetic housing assembly that may include a ratcheting face 5, magnet, containment housing 23, rotational limiting housing 22 and anchoring body 21 as it is molded before anchor deployment.

In this embodiment, the ratcheting cap 20 may have a structure similar to that which is described above in reference to FIGS. 126-135, and the general shape of the containment housing 23 may be similar to that of the main housing body described in those figures, with the addition of the anchor body tabs 24. The ratcheting cap 20 may be ultrasonically welded to the rotational limiting housing 22, to define the water tight chamber or hermetically sealed chamber which contains the magnet 10 therein. The ratcheting cap 20/rotational limiting housing 22 assembly may then be inserted into the containment housing 23, which can then be inserted into the anchoring body 21 to produce the final magnetic housing assembly 200. The anchor body tabs 24 may allow for the magnetic housing assembly 200 to be secured to a foam block, or other secondary housing structure, by digging into the foam when rotated or inserted.

Figure 11:
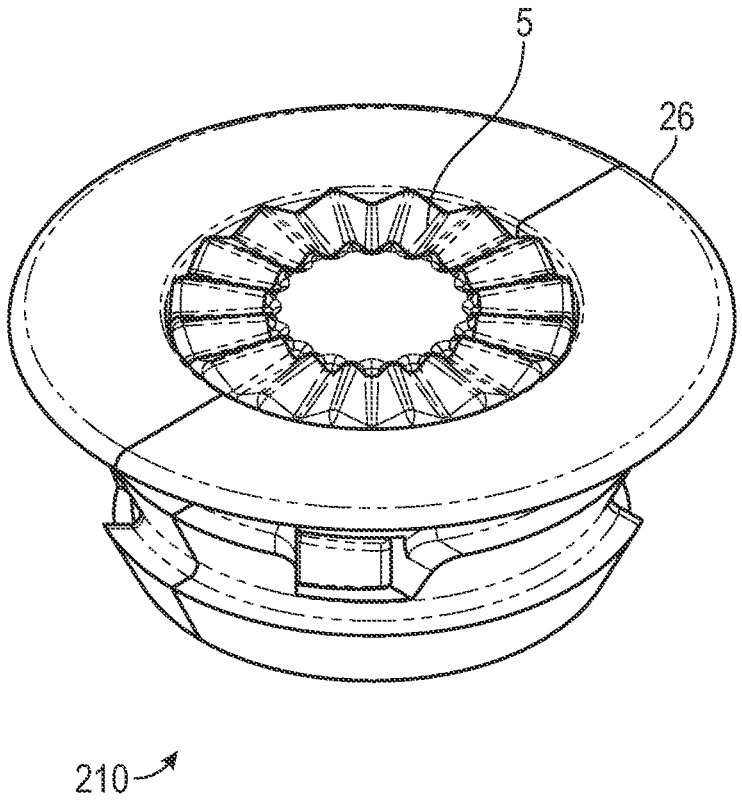
FIGS. 11-20 show various perspective views, a top view, a side view, cross-sectional views, and exploded views of an exemplary embodiment of a magnetic housing assembly which utilizes a ratcheting cap.
Figure 12:
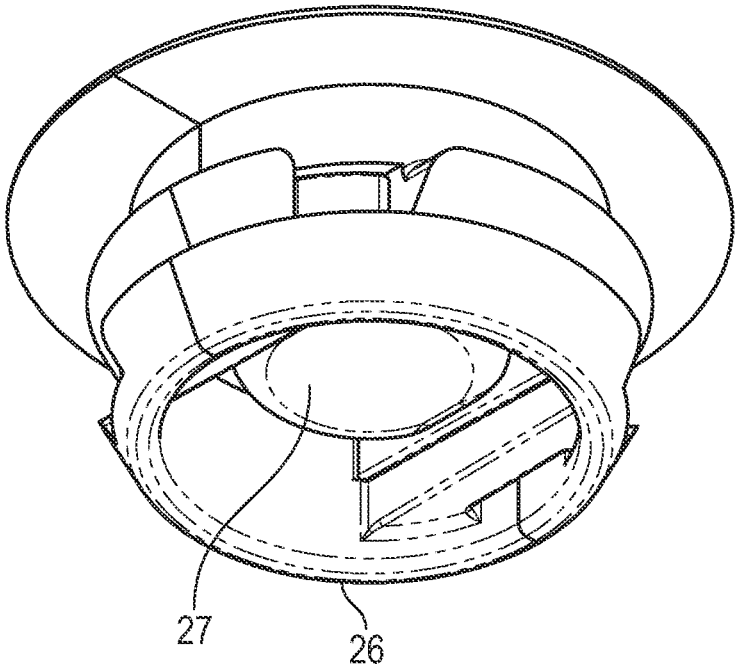
Figure 13:
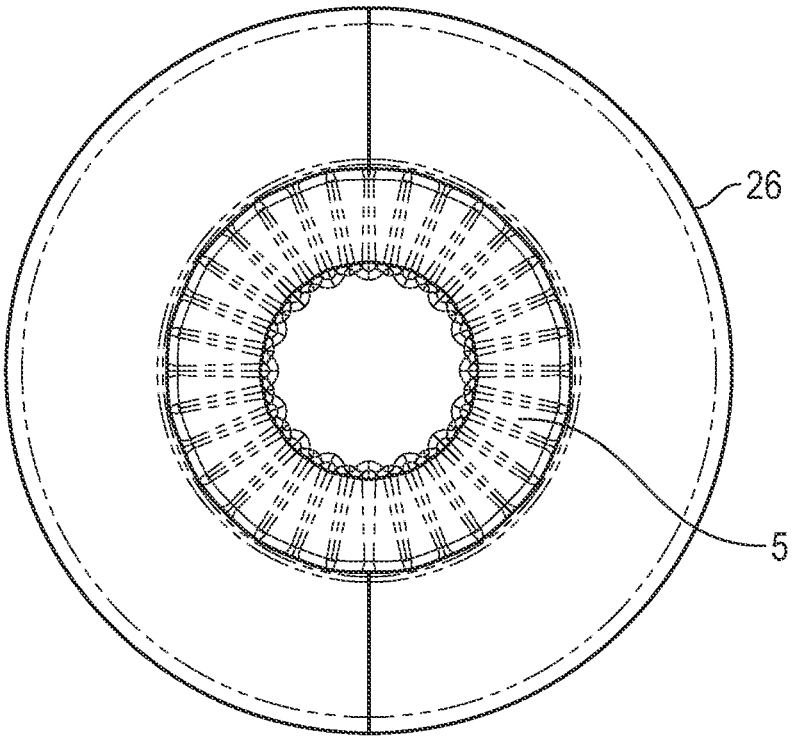
Figure 14:
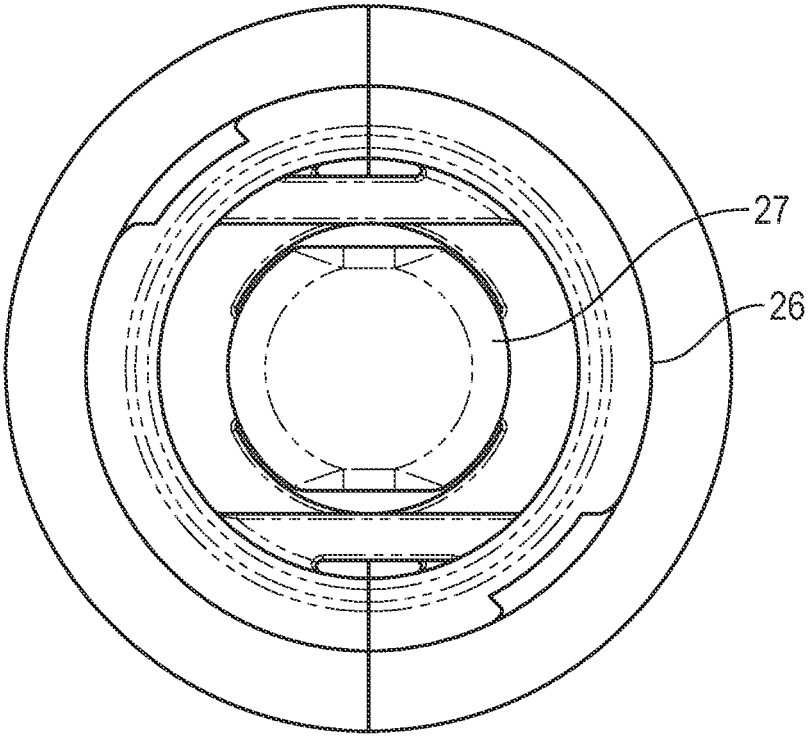
Figure 15:
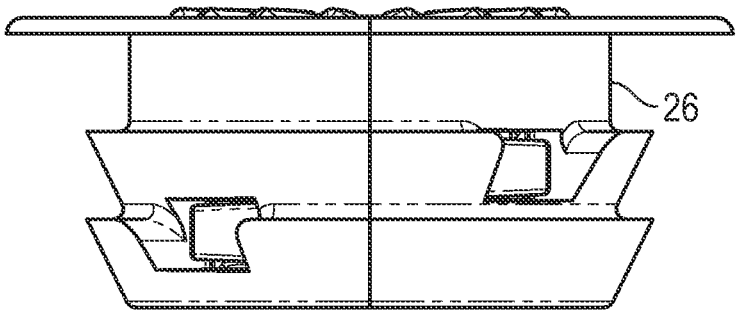
Figure 16:
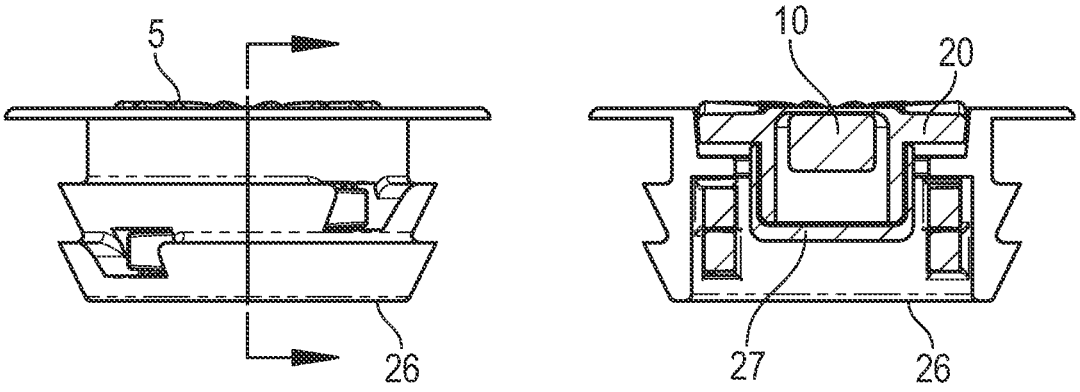
Figure 17:
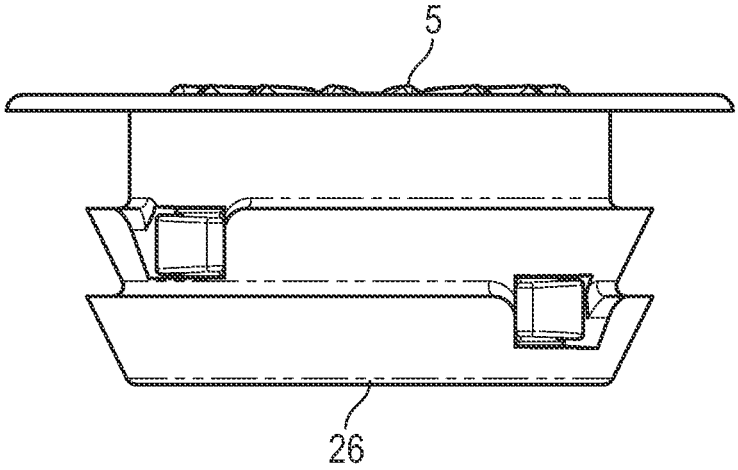
Figure 18:
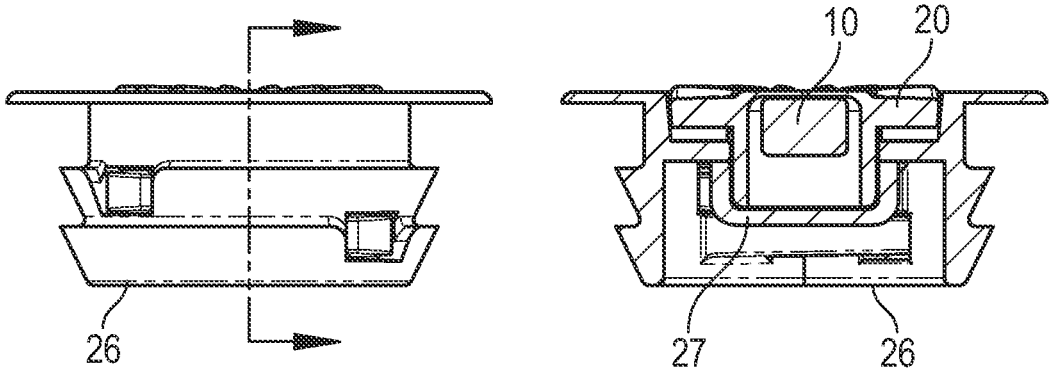
Figure 19:
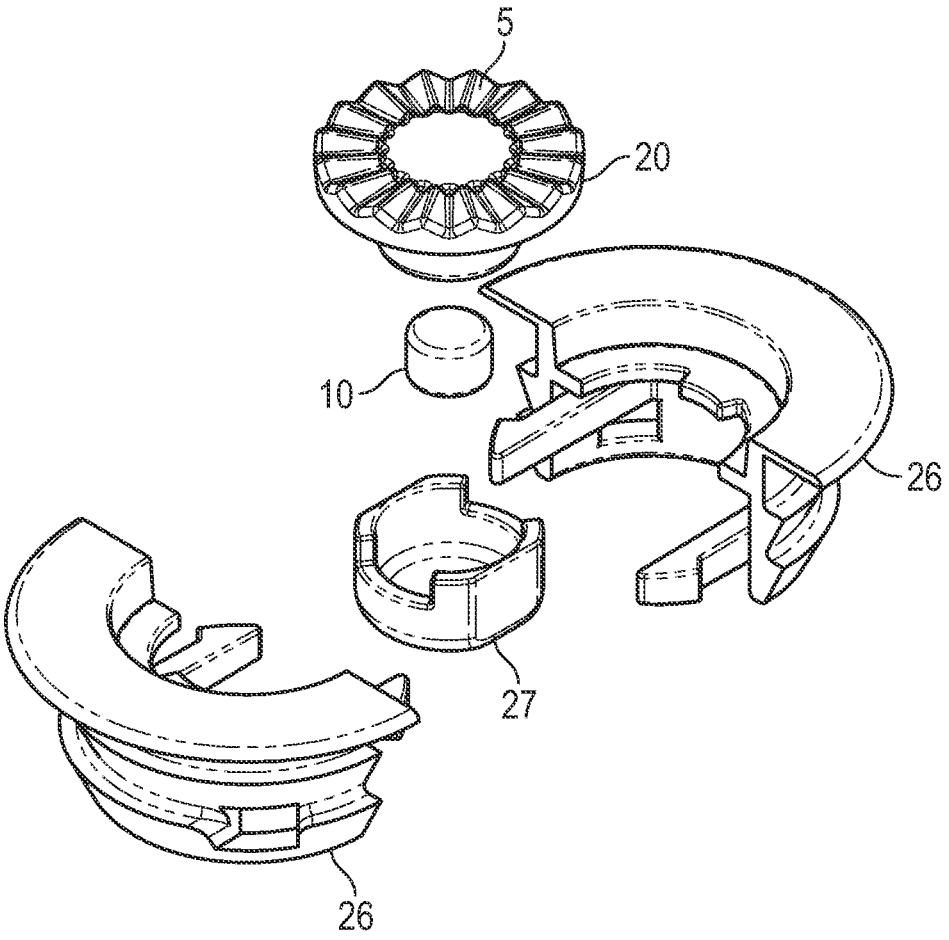
Figure 20:
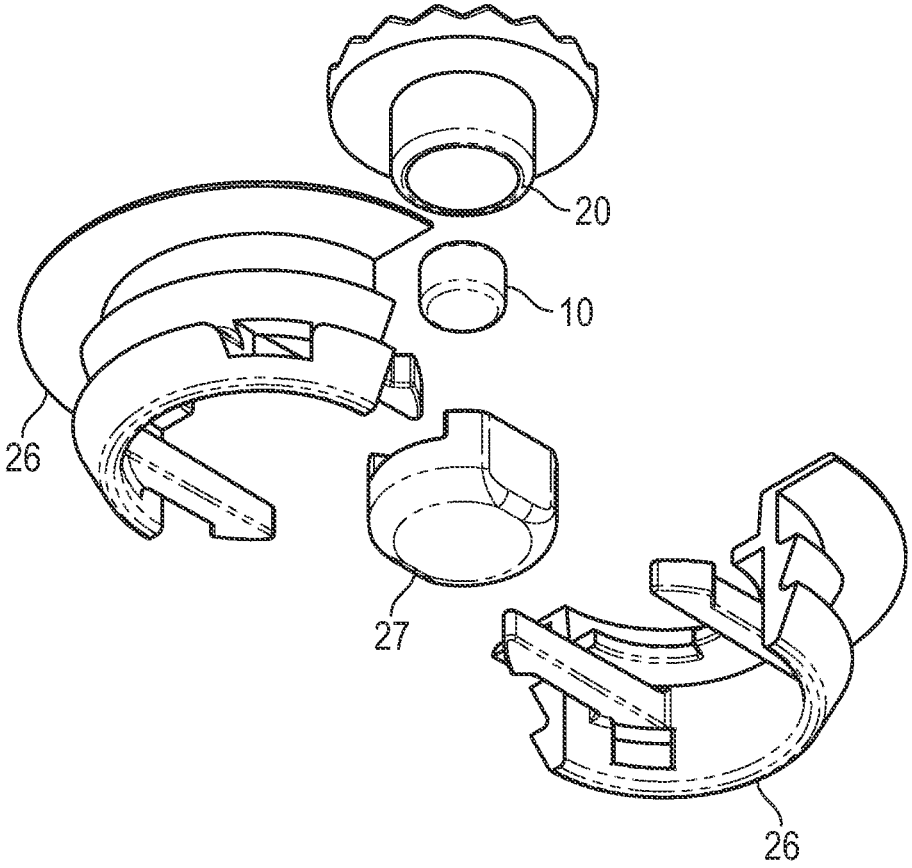

In another exemplary embodiment shown in FIGS. 11-20, an assembly of the magnetic housing which may use an ultrasonically, or chemically-welded watertight or hermetically-sealed enclosure to protect the magnet 10 from exposure to wet and corrosive environments, is illustrated. Two outer pieces may use a snap fit to engage together capturing the sealed magnetic housing creating the final magnetic assembly. This embodiment may use glue, large threads, barbs, or other conventional means of adhering to the foam block 60/70. In FIGS. 11-20:

FIG. 11 is an isometric top view of an assembly with parts combined;

FIG. 12 is an isometric bottom view of the assembly with the parts combined. An alternate version of this view can have a cap covering the bottom portion for use in a variation involving injection molding;

FIG. 13 is a top view of the assembly with the parts combined;

FIG. 14 is a bottom view of an assembly with the parts combined. An alternate version of this view can have a cap covering the bottom portion for use in a variation involving injection molding;

FIG. 15 is a front view of an assembly with the parts combined;

FIG. 16 is a front cross-sectional view of an assembly with the parts combined;

FIG. 17 is a side view of an assembly with the parts combined;

FIG. 18 is a side cross-sectional view of the assembly with the parts combined;

FIG. 19 is an exploded top isometric view of an exemplary magnetic housing assembly, that may include a ratcheting face 5, magnet, lower magnetic housing 27, and outer housings with snap fit features 26; and FIG. 20 is an exploded bottom isometric view of the magnetic housing assembly that may include a ratcheting face 5, magnet, lower magnetic housing 27, and outer housings with snap fit features 26.

This embodiment similarly may use a combination of parts to produce an assembly that allows exterior faces of connecting blocks to align in a planar manner. The contacting surfaces may include a ratcheting face 5 to create a loud or audible clicking sound. In one embodiment, the face may be designed to float for a few degrees radially to allow exterior faces of the blocks to align. The faces may also float axially so that the ratcheting teeth can pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

The magnetic housing assembly 210 may be inserted into an aperture configured to receive the body, or may be machined or injection-molded into foam, wood, plastic, or other material. The inner assembly may contain a watertight or hermetically-sealed enclosed magnet. The shape of the magnet 10 may be a cube, sphere, cylinder, or other shaped component, within a plastic (or other material) housing that may be inserted into outer housings with snap fit features 26. The connection between the outer housings with snap fit features 26 and the plastic (or other material) assembly may be accomplished through a snap-fit tab locking the two parts together tightly or permanently. The outer housings with snap fit features 26 may be fastened to the mating block through chemical bonding or conventional mechanical interfaces, such as threads, barbs, expanding areas or mating snap-fit inner features.

This embodiment may also allow for the magnet 10 to flip within the housing, thereby allowing each magnet 10 to orient itself into the correct polarity to couple to another magnetic block assembly.

In this embodiment, the outer housings with snap fit features 26 may be bisected, and have one or more plastic arms that inserts into a corresponding slot in the opposite outer housing. The ratcheting cap 20 may have a similar structure as the ratcheting cap described in reference to FIGS. 126-135. The hermetically sealed chamber which houses the magnet 10 may be defined by the lower magnetic housing 27 and the ratcheting cap 20, which may be ultrasonically welded together. The ratcheting cap 20/lower magnetic housing 27 assembly may then be inserted into the outer housings with snap fit features 26 to complete the magnetic housing assembly 210.

Figure 21:
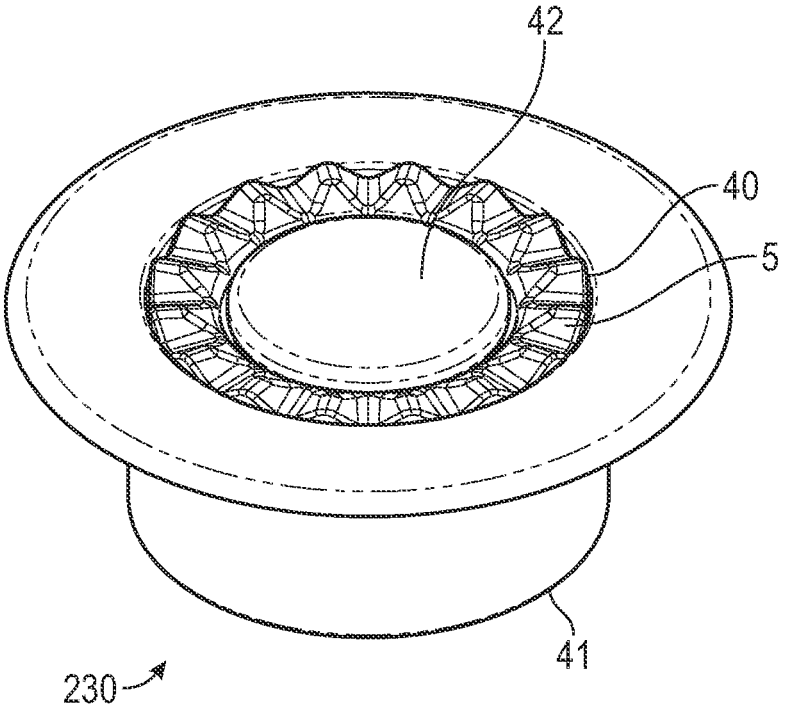
FIGS. 21-30 show various perspective views, a top view, a side view, cross-sectional views, and exploded views of an exemplary embodiment of a magnetic housing assembly which utilizes a ratcheting ring.
Figure 22:
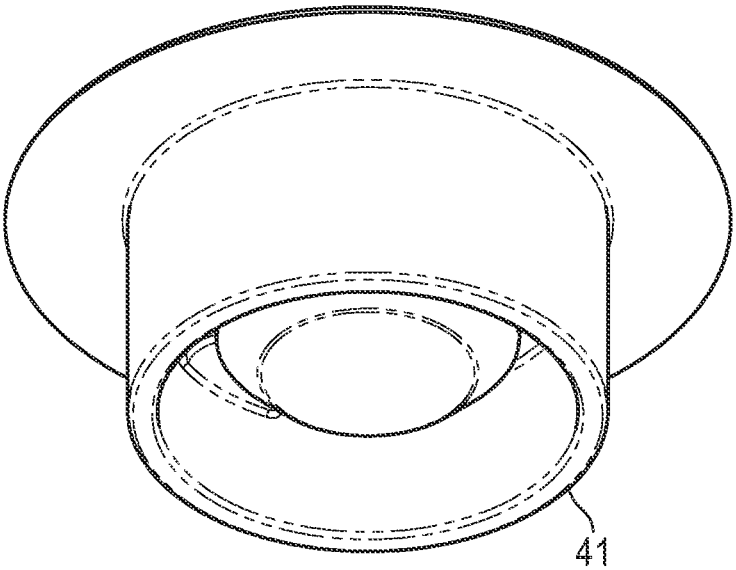
Figure 23:
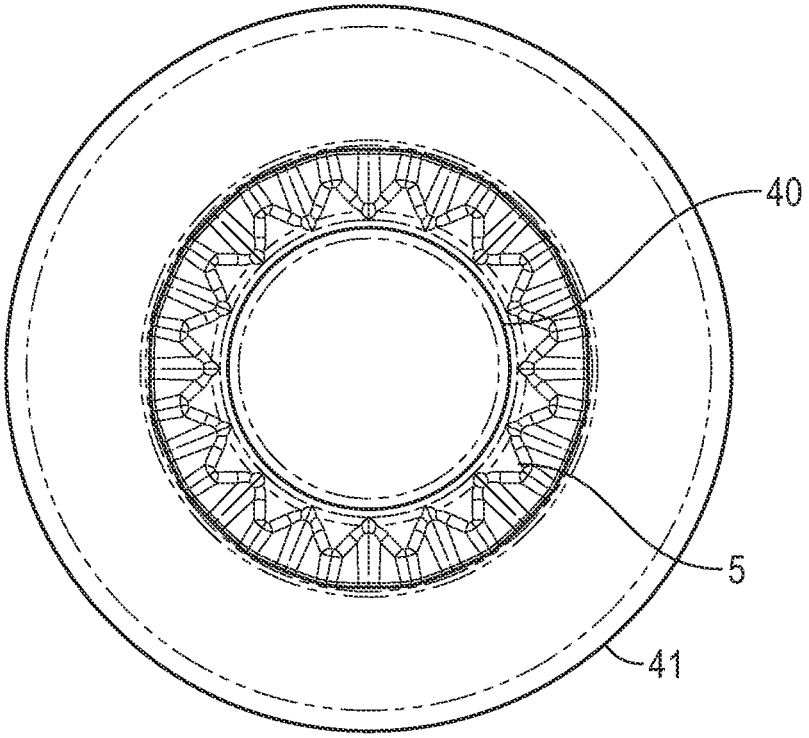
Figure 24:
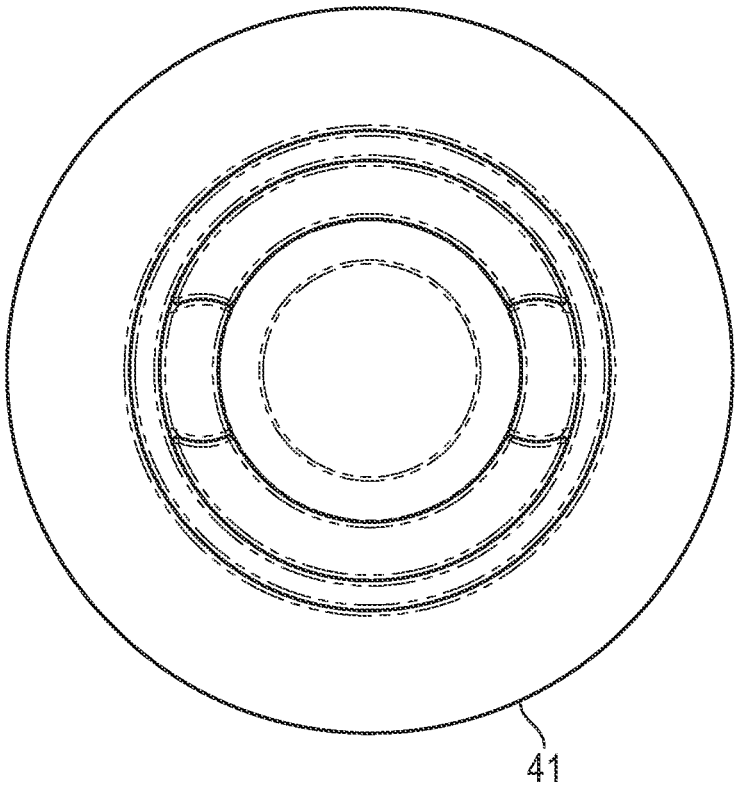
Figure 25:
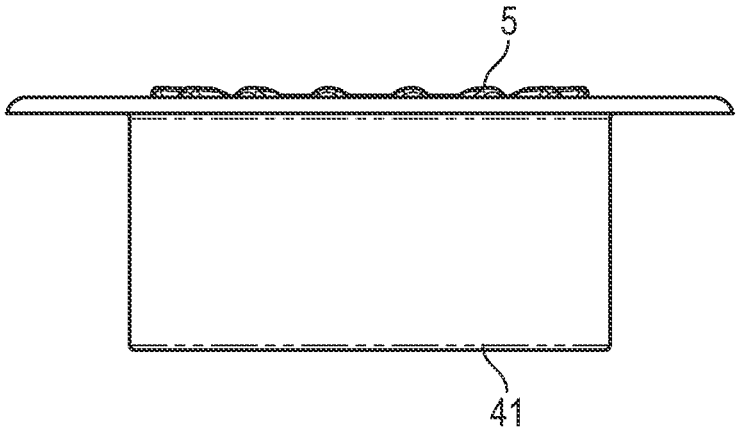
Figure 26:
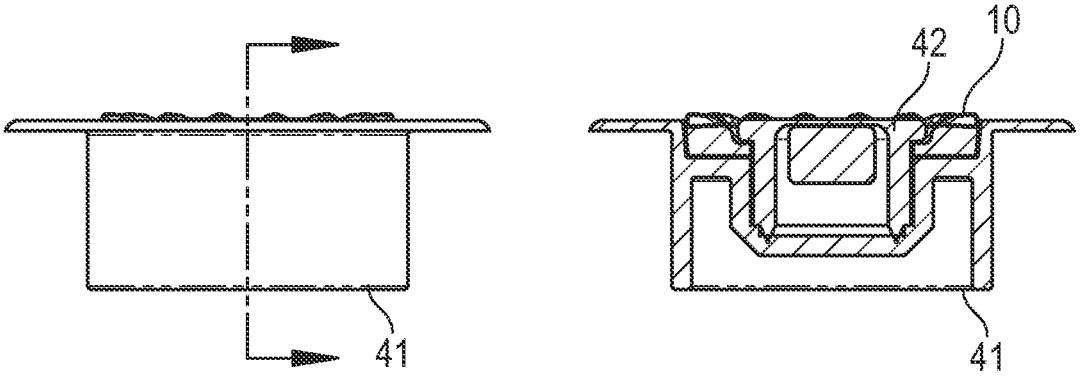
Figure 27:
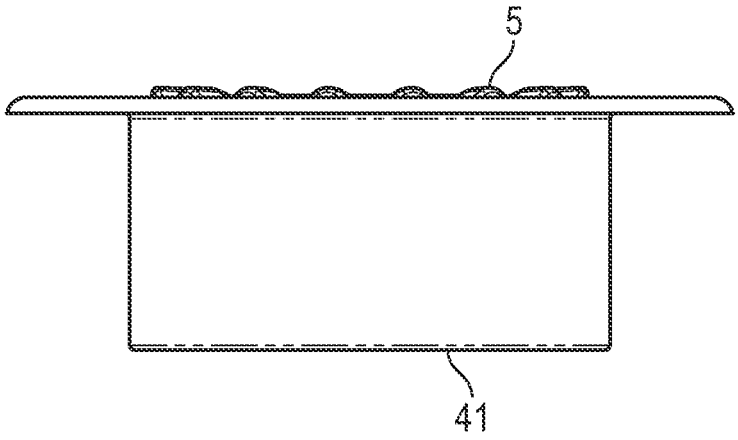
Figure 28:
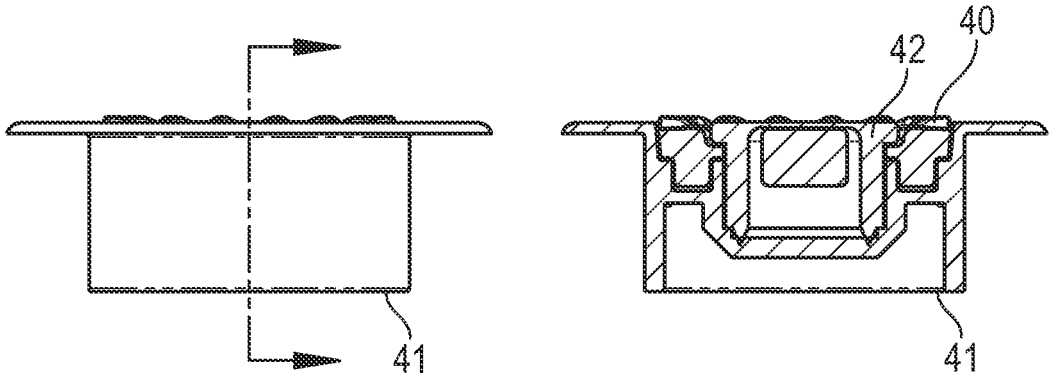
Figure 29:
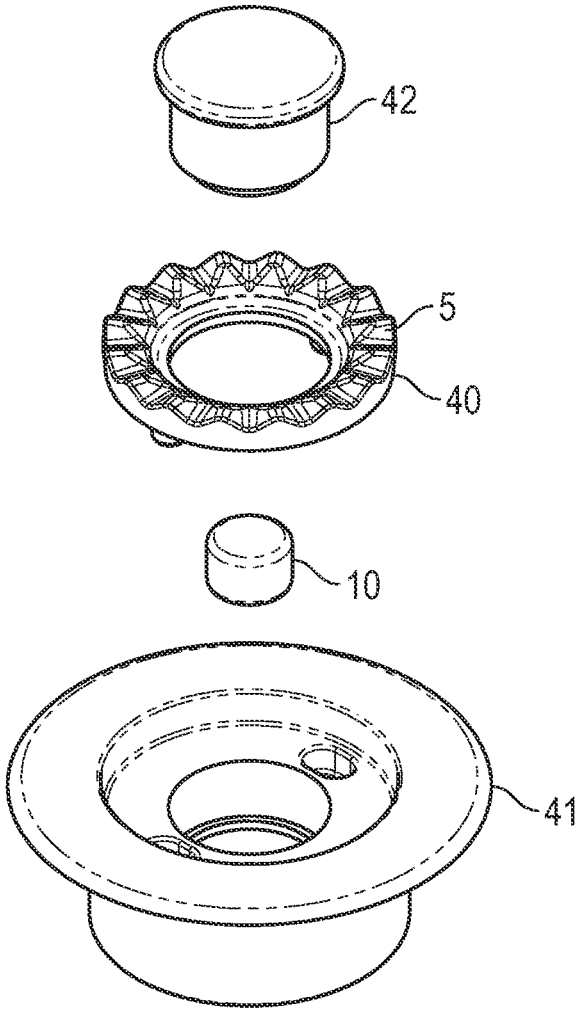
Figure 30:
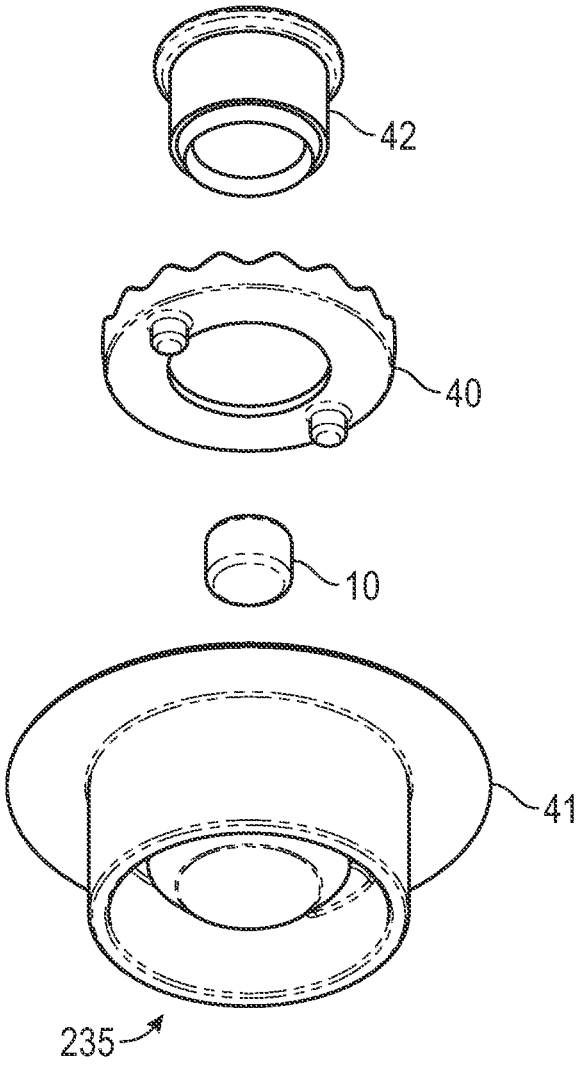

In another exemplary embodiment shown in FIGS. 21-30, a magnetic housing assembly may include an ultrasonically, or chemically-welded watertight or hermetically-sealed enclosure to protect the magnet 10 from exposure to wet and corrosive environments. This embodiment may use glue, large threads, barbs, or other conventional means of adhering to the foam (or other material) block. In FIGS. 21-30:

FIG. 21 is an isometric top view of the assembly with parts combined;

FIG. 22 is an isometric bottom view of the assembly with the parts combined;

FIG. 23 is a top view of the assembly with the parts combined;

FIG. 24 is a bottom view of an assembly with the parts combined;

FIG. 25 is a front view of an assembly with the parts combined;

FIG. 26 is a front cross-sectional view of an assembly with the parts combined;

FIG. 27 is a side view of an assembly with the parts combined;

FIG. 28 is a side cross-sectional view of the assembly with the parts combined;

FIG. 29 is an exploded top isometric view of an exemplary magnetic housing assembly, that may include an upper retention cap 42, ratcheting ring 40, magnet 10 and lower housing 41; and FIG. 30 is an exploded bottom view of the magnetic housing assembly that may include an upper retention cap 42, ratcheting ring 40, magnet 10 and lower housing 41.

In this embodiment, the bottom of the ring may include two protruding posts at the bottom of the ring to interface with a slot of a few degrees to limit the amount the ratcheting ring 40 can move rotationally, and may provide a few degrees of rotational motion in one or more embodiments. For example, the degree of rotational motion may be between about 5 and 12 degrees, and may be between 5.625 and 11.25 degrees.

This embodiment may include a combination of parts to produce an assembly that allows exterior faces of connecting blocks to align in a planar manner. The contacting surfaces may incorporate a ratcheting interface to create a loud or audible clicking sound. The face may float for a few degrees radially to allow exterior faces of the blocks to align. The mated faces will ramp up and down axially so that the ratcheting teeth may pass one another such that the previously mated surfaces of the block will stay parallel and centered as the blocks may be twisted in opposing directions. Blocks may be centered in line with each other through magnetism and the ratcheting teeth geometry which both interlocks and nests within the geometry of the mated block preventing misalignment through sheer force.

In one embodiment, magnetic housing assembly 230 may be inserted into an aperture configured to receive the body, or may be machined, or injection-molded into foam, wood, plastic, or other material. The inner assembly preferably contains a hermetically-sealed or watertight enclosed magnet, in which the shape of the magnet 10 may be a cube, sphere, cylinder, or other shaped component, within a plastic (or other material) housing that may be inserted into the anchor body 21. The outer housing may be fastened to the mating block through chemical bonding or conventional mechanical interface methodology, which may include threads, barbs, expanding areas, barbs or mating snap-fit inner features.

This embodiment may allow for the magnets to flip within the housings, thereby allowing each magnet 10 to orient itself into the correct polarity to couple with another magnetic block assembly.

Figure 31:
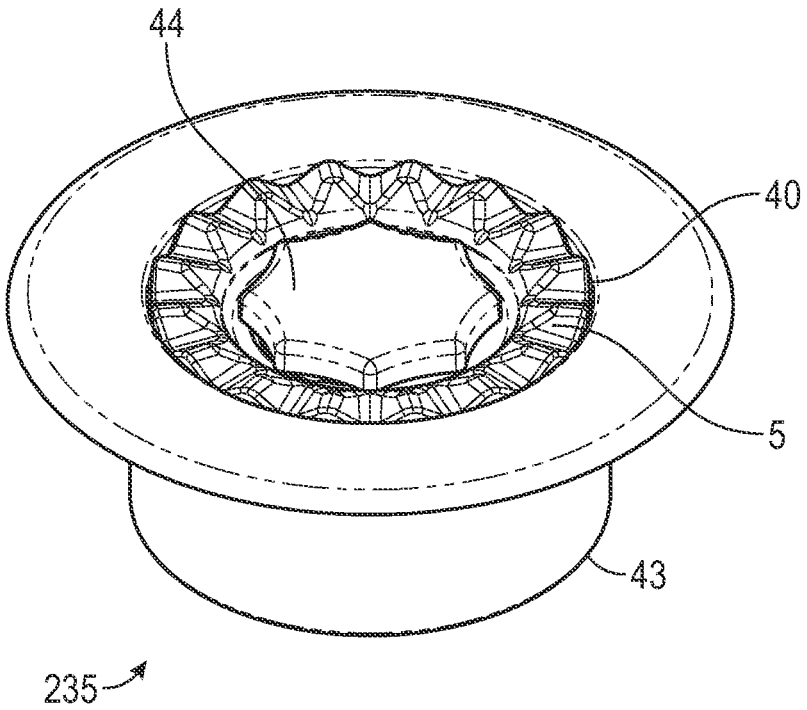
FIGS. 31-40 show various perspective views, a top view, a side view, cross-sectional views, and exploded views of an exemplary embodiment of a magnetic housing assembly which utilizes a ratcheting ring.
Figure 32:
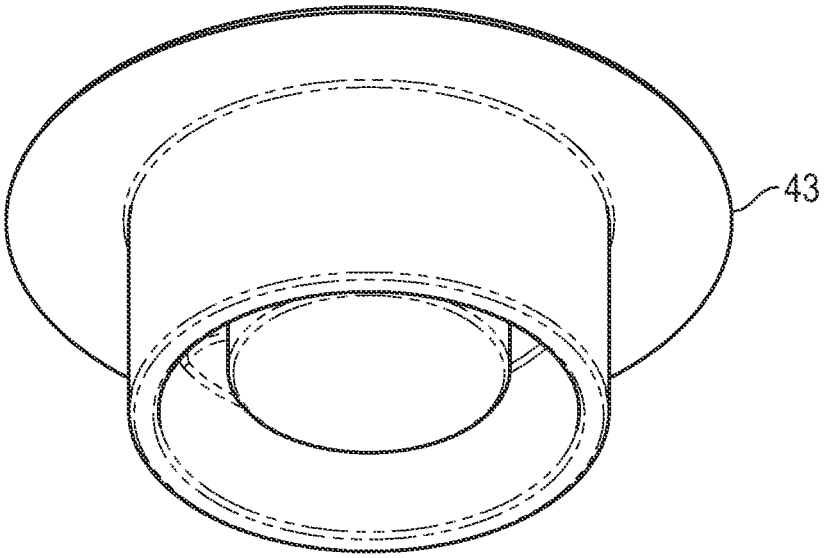
Figure 33:
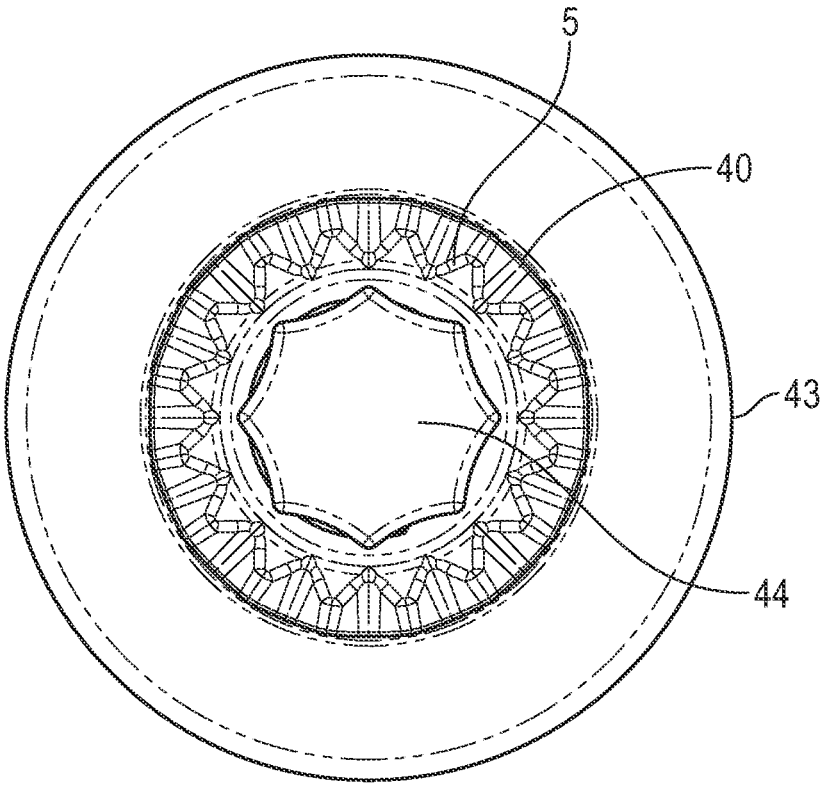
Figure 34:
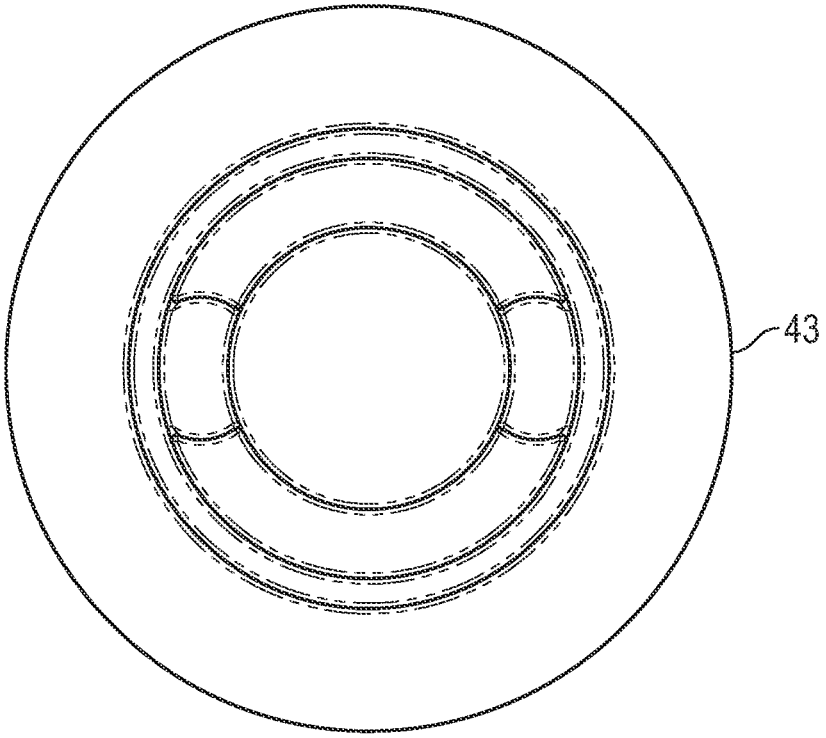
Figure 35:
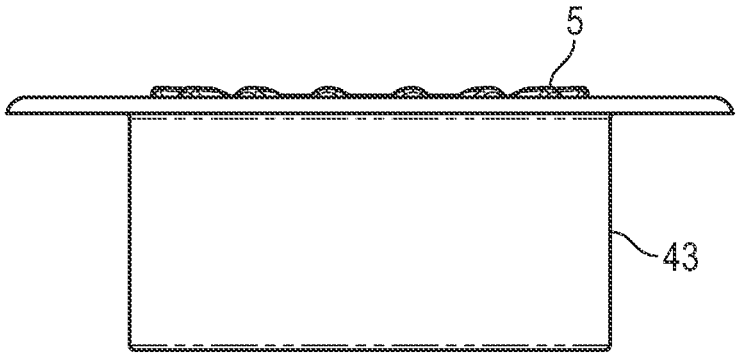
Figure 36:
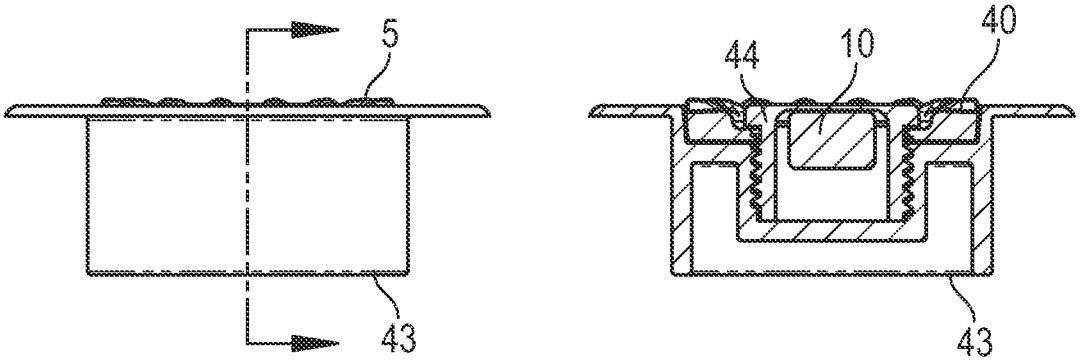
Figure 37:
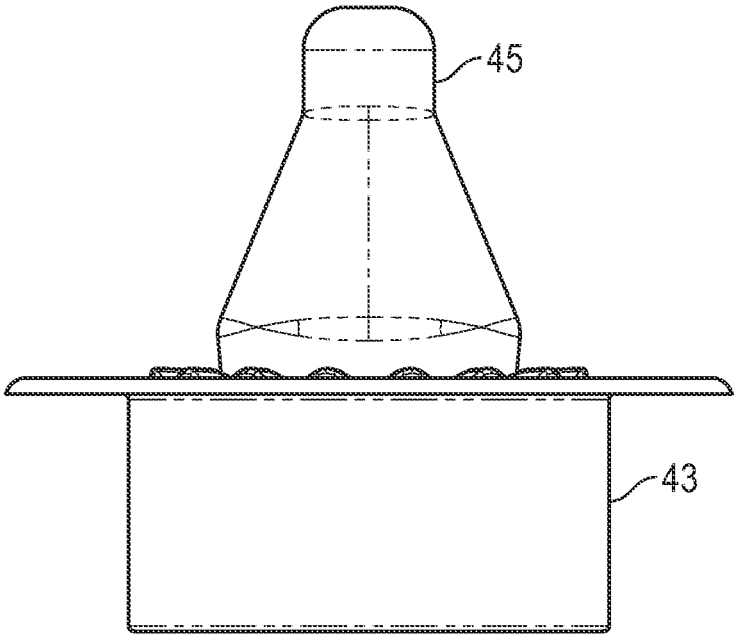

FIGS. 31-40 illustrate an exemplary embodiment of the embodiment shown in FIGS. 21-30. In this embodiment, the assembly of the magnetic housing may include a threaded enclosure to protect the magnet 10 from exposure to wet and corrosive environments. This seal may be created by capturing a magnet 10 between a threaded top cap and a main housing body. This embodiment may use glue, large threads, barbs or other means of adhering to the foam (or other material) block. In FIGS. 31-40:

FIG. 31 is an isometric top view of the assembly with parts combined;

FIG. 32 is an isometric bottom view of the assembly with the parts combined;

FIG. 33 is a top view of the assembly with the parts combined;

FIG. 34 is a bottom view of an assembly with the parts combined;

FIG. 35 is a front view of an assembly with the parts combined;

FIG. 36 is a front cross-sectional view of full assembly with the parts combined;

FIG. 37 is a side view of an assembly with the parts combined. This also shows the insertion tool in final threaded position of the assembly.

Figure 38:
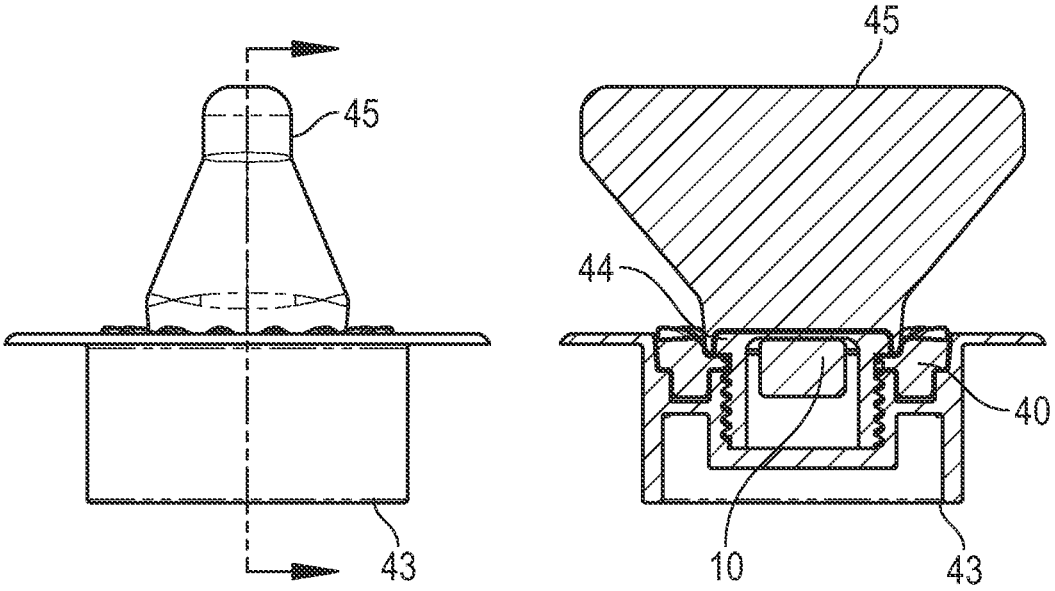

FIG. 38 is a side cross-sectional view of the assembly with the parts combined.

This also shows the insertion tool in final threaded position of the assembly.

Figure 39:
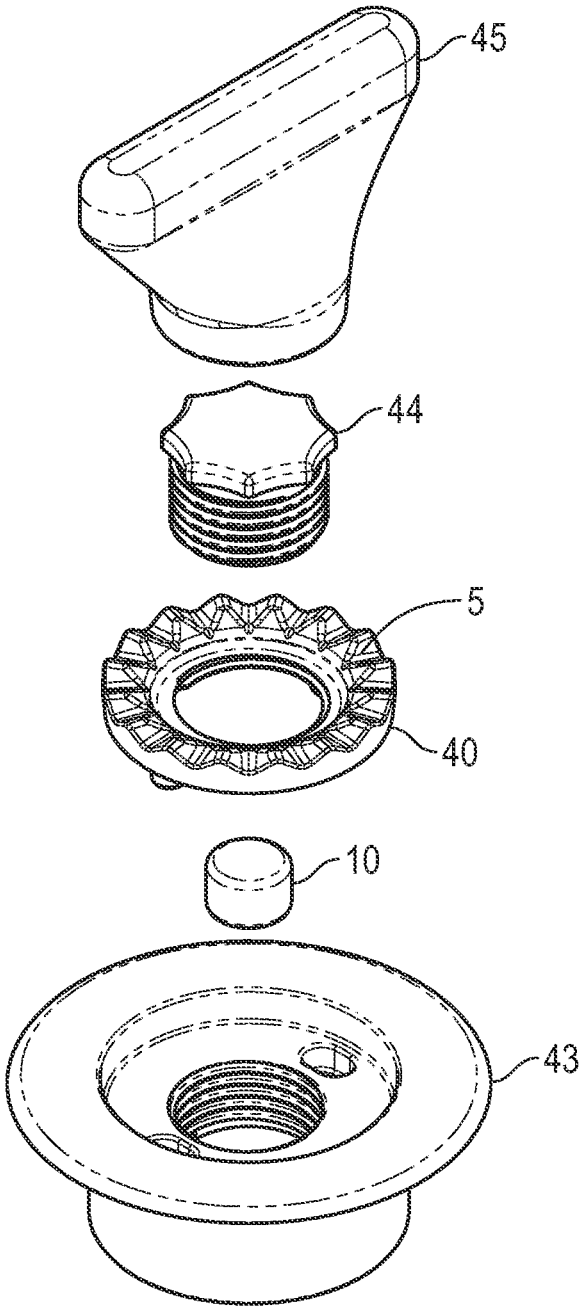
Figure 40:
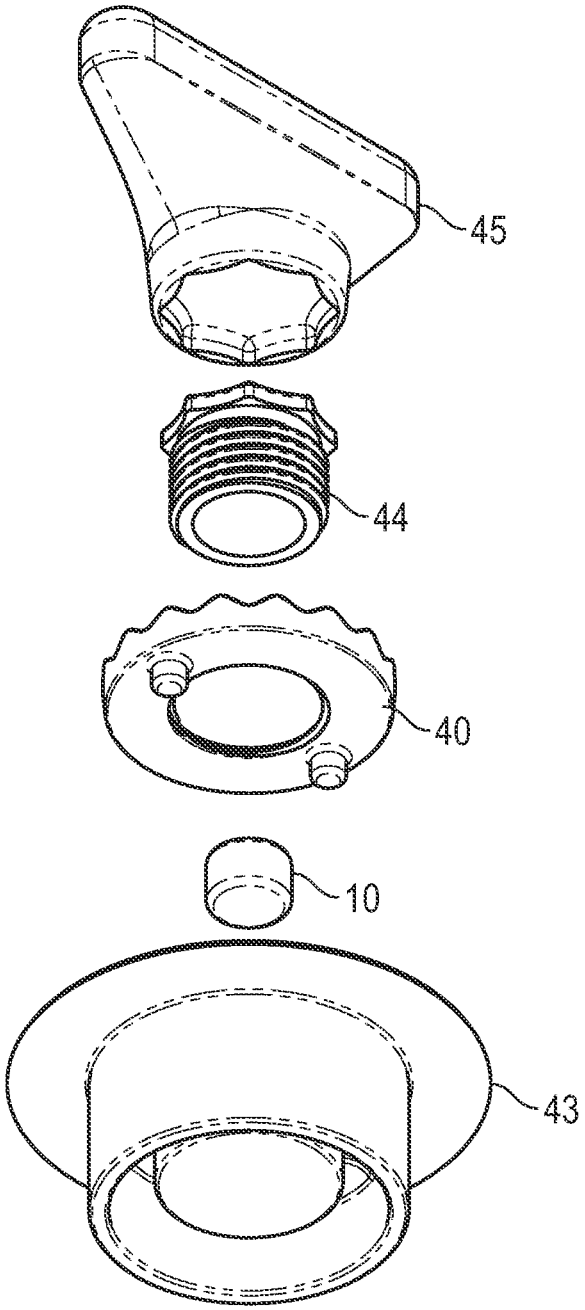

FIG. 39 is an exploded top isometric view of an exemplary magnetic housing assembly, that may include an assembly tool 45, upper threaded cap 44, ratcheting ring 40, magnet 10 and lower threaded housing 43; and FIG. 40 is an exploded bottom isometric view of the magnetic housing assembly that may include an assembly tool 45, upper threaded cap 44, ratcheting ring 40, magnet 10 and lower threaded housing 43. The ratcheting surface 5 may be on an upper surface of the ratcheting ring 40.

In one embodiment, the joining of these pieces may be accomplished through a security type adapter to join the threaded portions together, which also captures the ratcheting rotating ring. The bottom of the ring may include two protruding posts to interface with a slot of a few degrees to limit the amount the ratcheting ring 40 may move rotationally.

This embodiment may incorporate a combination of parts to produce an assembly that allows exterior faces of connecting blocks to align in a planar manner. The contacting surfaces may include a ratcheting interface to create a loud or audible clicking sound. The face may float for a few degrees radially to allow exterior faces of the blocks to align. The mated faces will ramp up and down axially so that the ratcheting teeth may pass one another such that the previously mated surfaces of the block will stay parallel and centered as the blocks may be twisted in opposing directions. Blocks may be centered in line with each other through magnetism and the ratcheting teeth geometry which both interlocks and nests within the geometry of the mated block preventing misalignment through sheer force.

The magnetic housing assembly 235 may be inserted into an aperture configured to receive the body or may be machined or injection-molded into foam, wood, plastic, or other material. An inner assembly may contain a hermetically-sealed or watertight enclosed magnet, in which the shape of the magnet 10 may be a cube, sphere, cylinder, or other shaped component, within a plastic (or other material) housing that may be inserted into the lower housing 41. The outer housing may be fastened to the mating block through chemical bonding or conventional mechanical interface methodology, which may include threads, barbs, expanding areas or mating snap-fit inner features.

This design may allow for the magnet 10 to flip within the housing, thereby allowing each magnet 10 to orient itself into the correct polarity to pair with another magnetic block assembly.

In this embodiment, the water tight chamber or hermetically sealed chamber may be created by capturing a magnet 10 between an upper retention cap 42 and a lower housing 41, with a ratcheting ring 40 in between the upper retention cap 42 and the lower housing 41. In this embodiment the lower housing 41 may have a continuous surface along a portion bottom face as to define the lower portion of the hermetically sealed chamber. The magnet 10 within the hermitically sealed chamber in the lower housing 41 may define the magnetic housing assembly 225.

In one or more embodiments, such as those illustrated in FIGS. 31-40, the ratcheting face 5 may have a differing shape, and, for example, may be defined by a plurality of curved, sloped ridges. The curved, sloped ridges may define a generally concave shape between them, before reversing curvature and becoming convex at the top of the ridge where it intersects with a subsequent ridge. Each ridge may be defined by a first concave portion, a second concave portion, a first convex portion, a second convex portion, a third concave portion, and a fourth concave portion.

In this embodiment, the water tight chamber or hermetically sealed chamber may be created by capturing a magnet 10 between an upper threaded cap 44 and a lower threaded housing 43. In this embodiment the lower threaded housing 43 may have a continuous surface along a portion bottom face as to define the lower portion of the hermetically sealed chamber. The ratcheting ring 40 may be positioned above the lower threaded housing 43, and below the upper threaded cap 44, which may be rotated using the assembly tool 45 to tighten down the upper threaded cap 44 to form the magnetic housing assembly 235.

Figure 41:
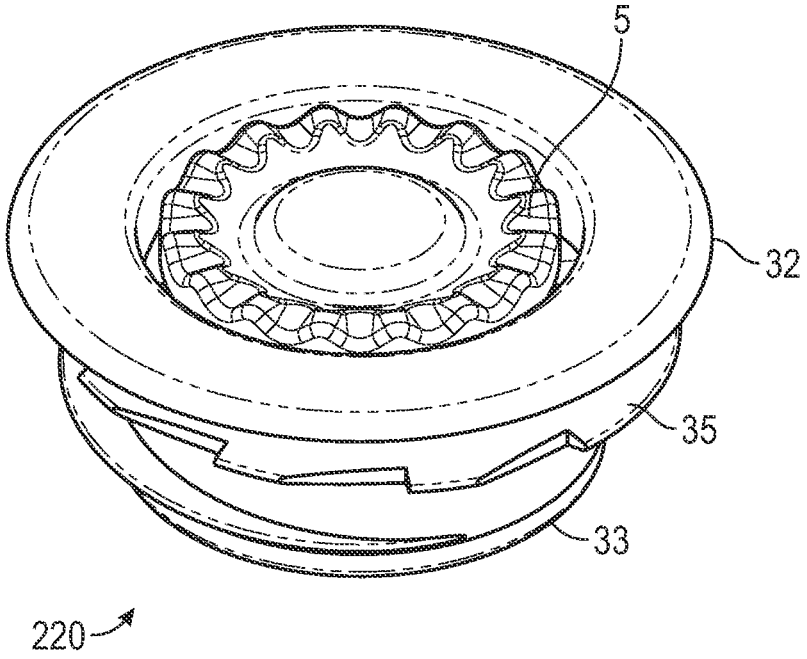
FIGS. 41-50 show various perspective views, a top view, a side view, cross-sectional views, and exploded views of an exemplary embodiment of magnetic housing assembly which utilizes a ratcheting cap.
Figure 42:
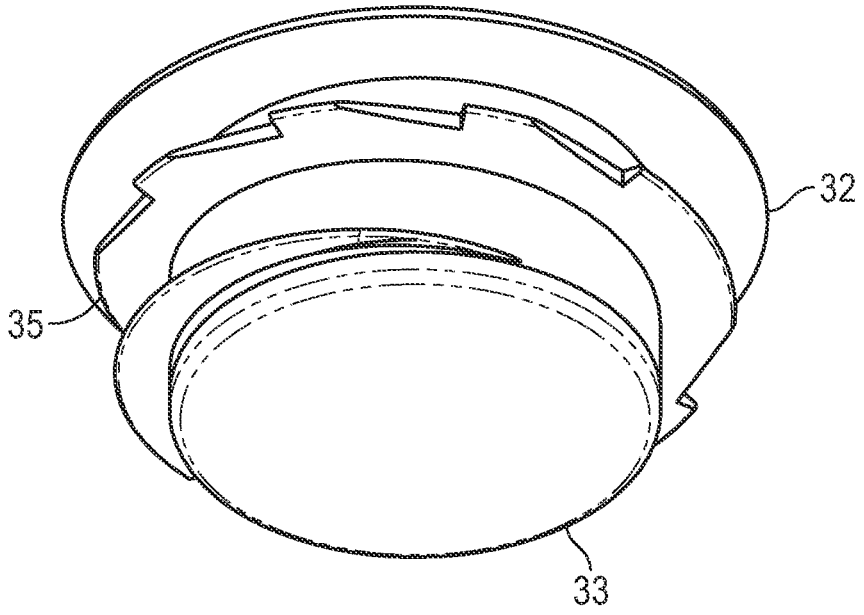
Figure 43:
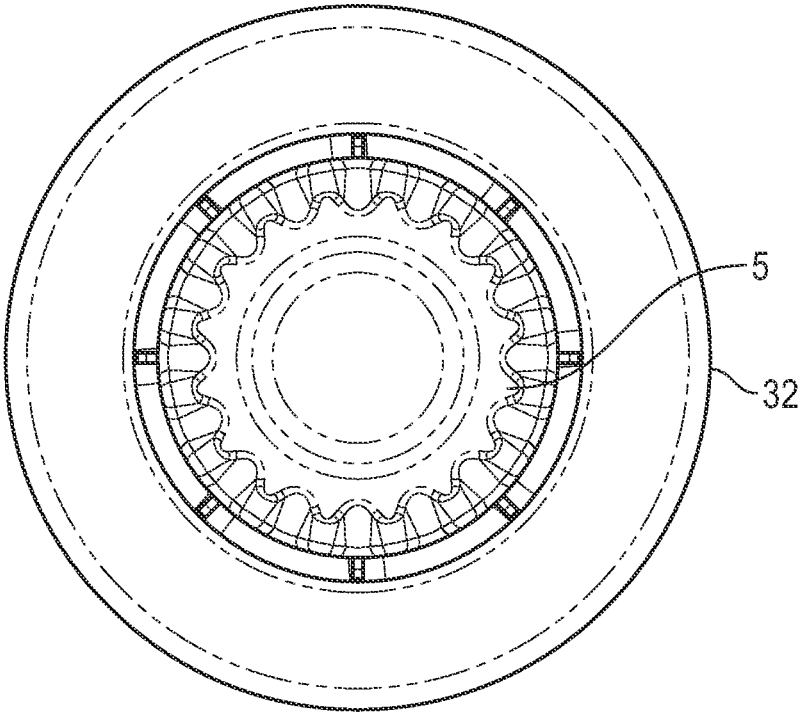
Figure 44:
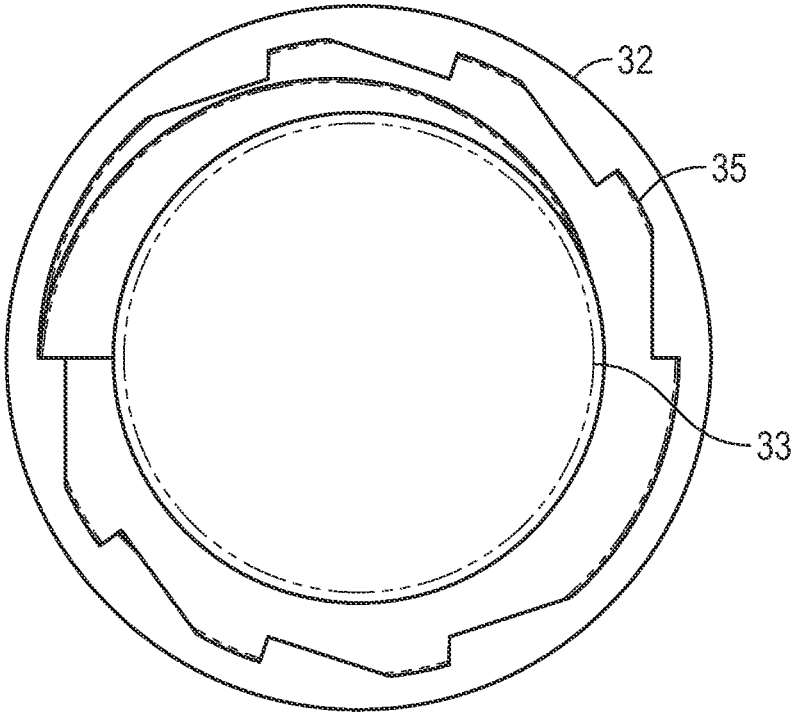
Figure 45:
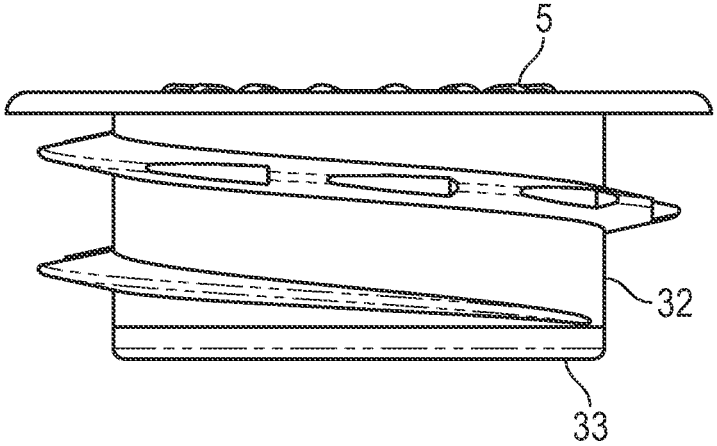
Figure 46:
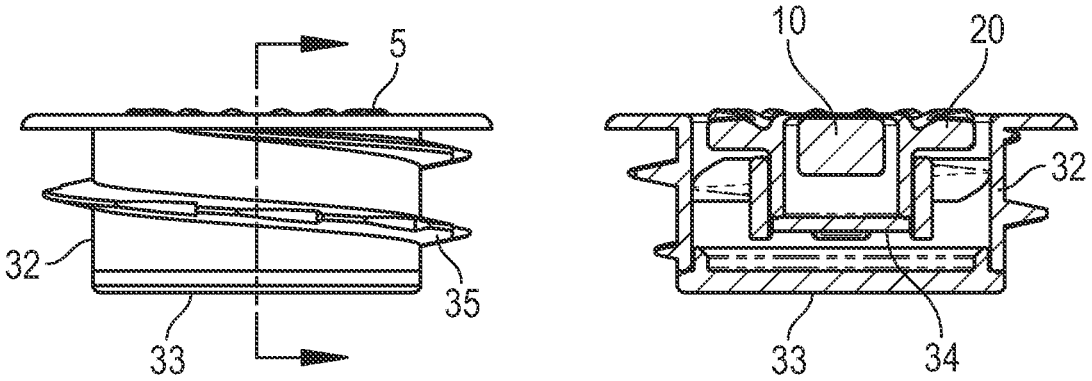
Figure 47:
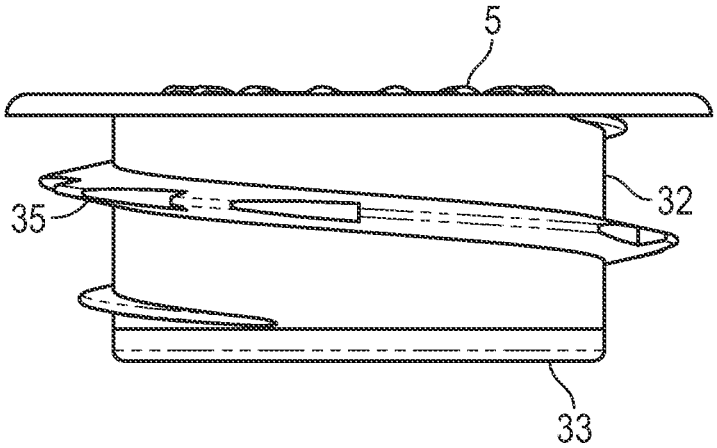
Figure 48:
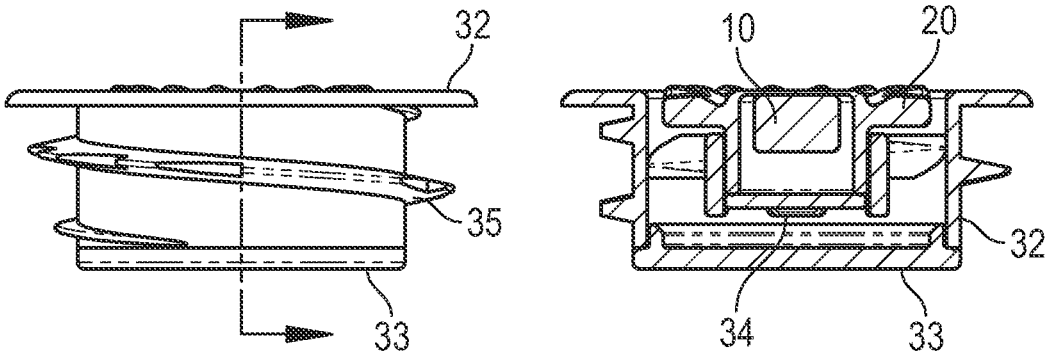
Figure 49:
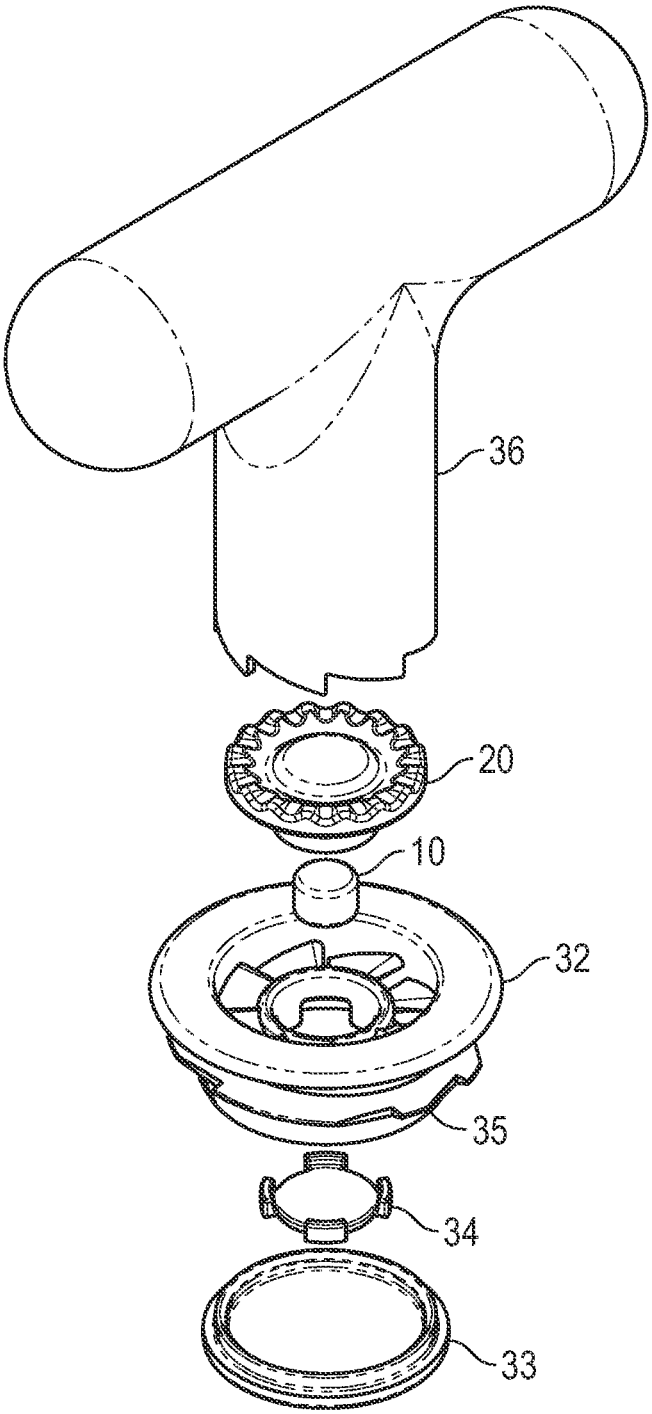
Figure 50:
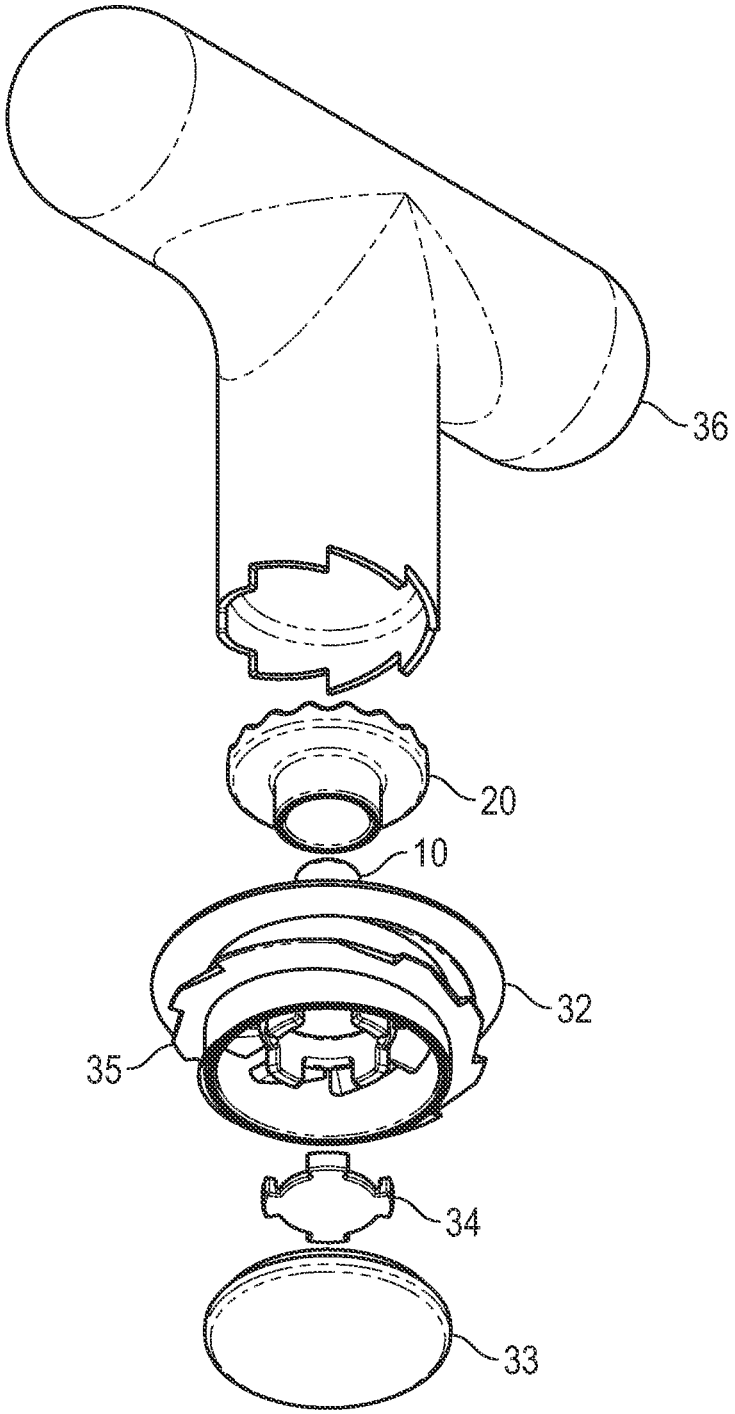

Another exemplary embodiment is further described with reference to FIGS. 41-50. In reference to FIGS. 41-50:

FIG. 41 is an isometric top view of an assembly with parts combined;

FIG. 42 is an isometric bottom view of the assembly with the parts combined;

FIG. 43 is a top view of the assembly with the parts combined;

FIG. 44 is a bottom view of an assembly with the parts combined;

FIG. 45 is a front view of an assembly with the parts combined;

FIG. 46 is a front cross-sectional view of an assembly with the parts combined;

FIG. 47 is a side view of an assembly with the parts combined;

FIG. 48 is a side cross-sectional view of the assembly with the parts combined;

FIG. 49 is an exploded top isometric view of an exemplary magnetic housing assembly, that may include a housing insertion tool 36, upper ratcheting cap 20, magnet 10, main housing body, lower cap 34 and optional bottom housing cap; and FIG. 50 is an exploded bottom isometric view of the magnetic housing assembly, that may include a housing insertion tool 36, upper ratcheting cap 20, magnet 10, main housing body, lower cap 34 and optional bottom housing cap.

In these drawings, shown is an assembly of the magnetic housing 220 that may include an ultrasonically, or chemically-welded watertight or hermetically-sealed enclosure to protect the magnet 10 from exposure to wet or corrosive environments. The seal may be created by capturing a magnet 10 between a ratcheting cap 20, the main housing body 32, and a lower cap 34. This embodiment may use glue, large threads, barbs or other means of adhering to the foam (or other material) block.

A housing cap 33 may also be welded to the bottom portion of the housing. This may help to ensure that water (liquid) will not seep into the remainder of the foam (or other material) block housing. In this embodiment, the main housing body may include fan-like shapes, or threading ridge 35, surrounding its perimeter. This allows water (liquid) to readily evacuate the main housing cavity. For blocks with complete through-holes, the housing cap 33 may be excluded to allow water to drain through the whole block.

The ratcheting cap 20 and the main housing body 32 may have structures and shapes similar to those described in FIGS. 126-135. The water tight chamber or hermetically sealed chamber may be created by capturing a magnet 10 between the ratcheting cap 20, the main housing body 32, and a lower cap 34. The main housing body may also include an interior chamber with a slotted surface, which may be fan-like shapes in one or more embodiments, therein allowing for the passage of water in and out of the interior of the otherwise hollow main housing body 32.

In this embodiment, the assembly may include a housing insertion tool 46 that engages with the fan-like shapes to spin its exterior threads into the mating foam (or other material) block. The wide shape of the threads secures the housing to the foam (or other material). Notches in the lower extensions of the housing threads help to prevent the housing from backing out from the formed threads in the foam (or other material) block.

This design may include a combination of parts to produce an assembly that allows exterior faces of connecting blocks to align in a planar manner. The contacting surfaces use a ratcheting interface to create a loud or audible clicking sound. The face may float for a few degrees radially to allow exterior faces of the blocks to align. The faces may also float axially to enable the ratcheting teeth to pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Alternate forms of this embodiment may also eliminate the exterior cutting threads and may instead include a smooth glue-in method, barbs or a snap-in feature.

The main housing body 32 may be inserted into a hole-cut, or may be machined, or injection-molded into, foam, wood, plastic, or other material. The inner assembly containing a hermetically-sealed or watertight enclosed magnet 10 housed within a plastic (or other material) housing that may be inserted into main housing body 32. The shape of the magnet 10 may be a cube, sphere, cylinder, or other shaped component. The outer housing may be fastened to the mating block through chemical bonding or mechanical interface methodology which can include threads, barbs, expanding areas or mating snap-fit inner features.

This design may allow for the magnet 10 to flip within the housing, thereby allowing each magnet 10 to flip into the correct polarity orientation to pair with another magnetic block assembly.

Figure 51:
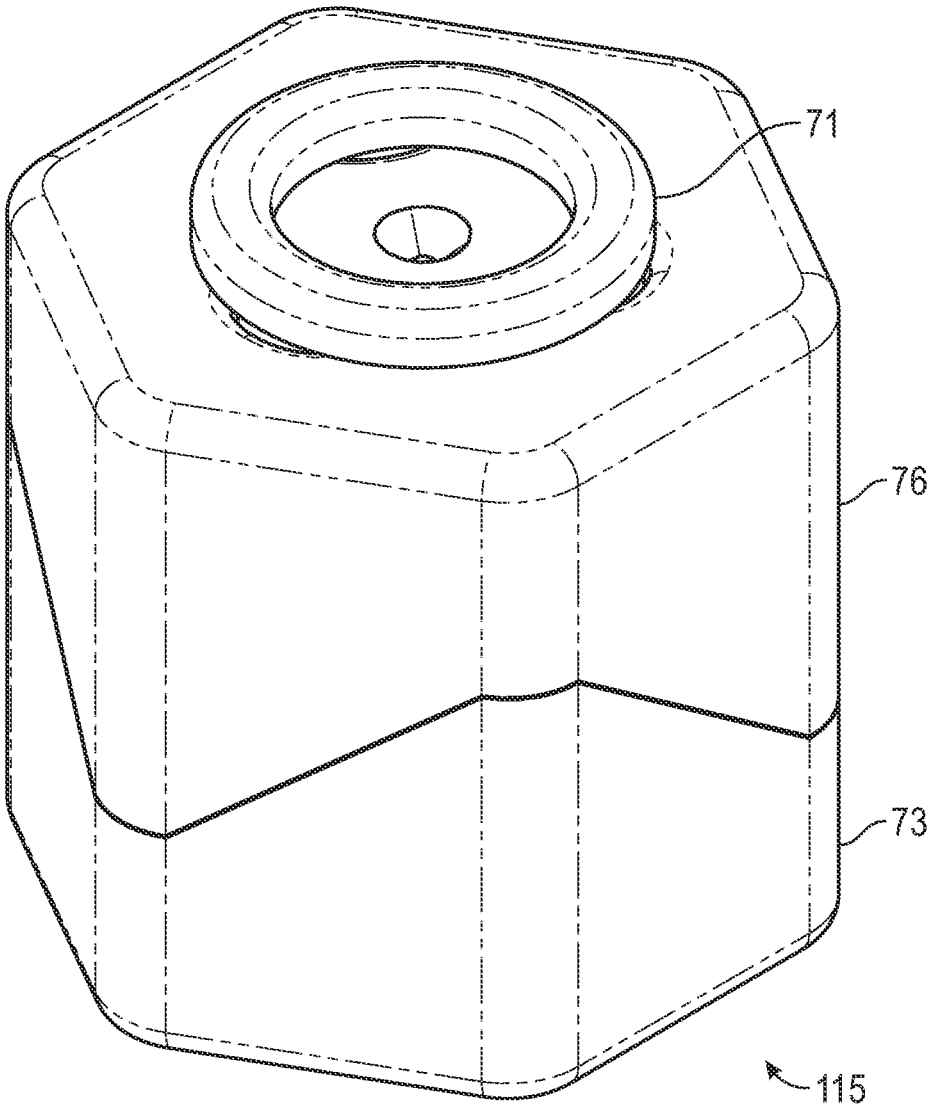
FIGS. 51-60A show various perspective views, a top view, a side view, cross-sectional views, and exploded views of an exemplary embodiment of structures and methods which may be used to produce the attachment members of one or more embodiments.
Figure 52:
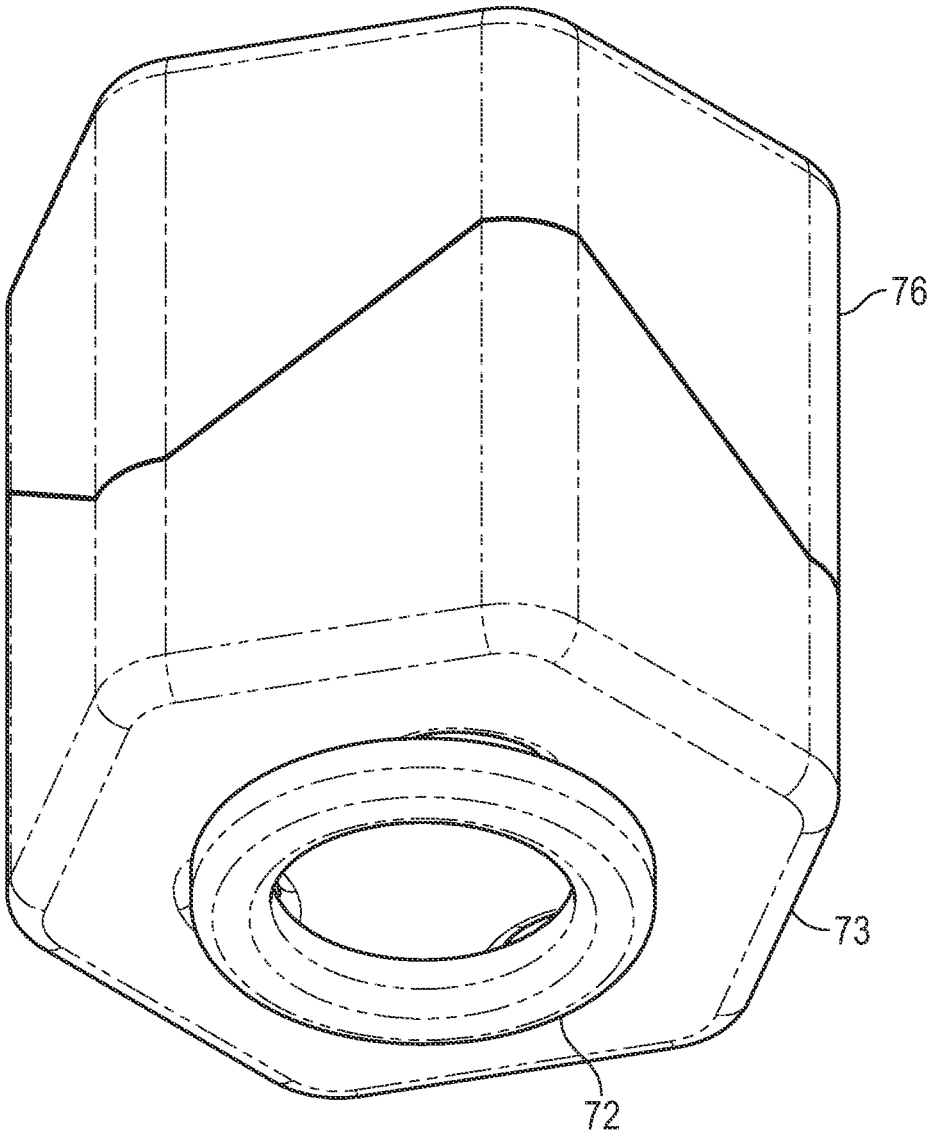
Figure 53:
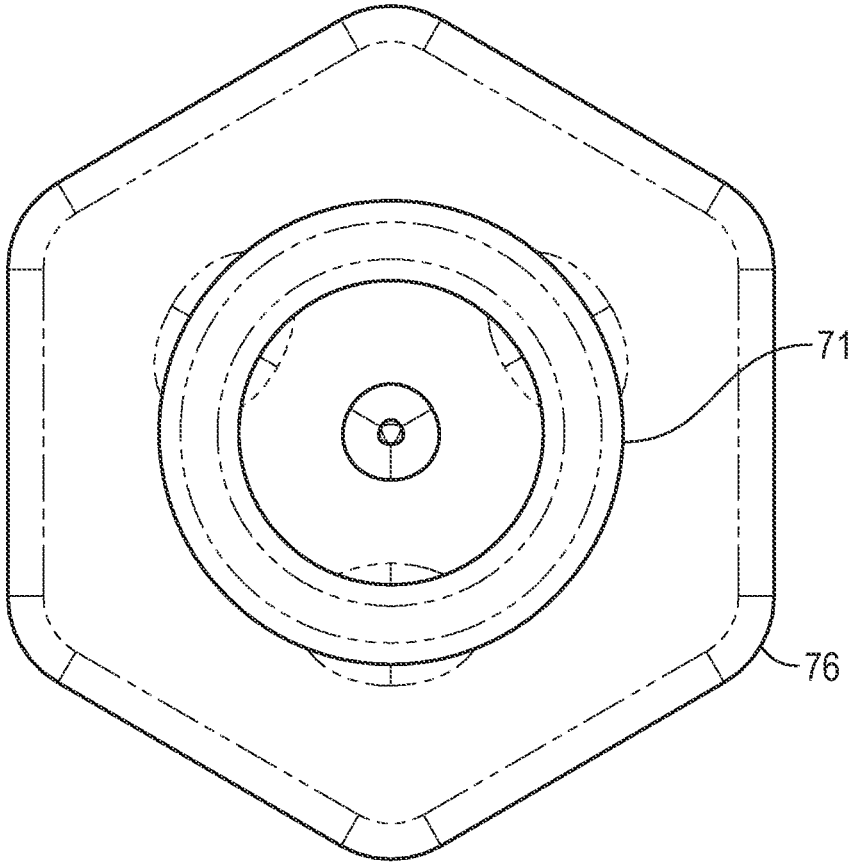
Figure 54:
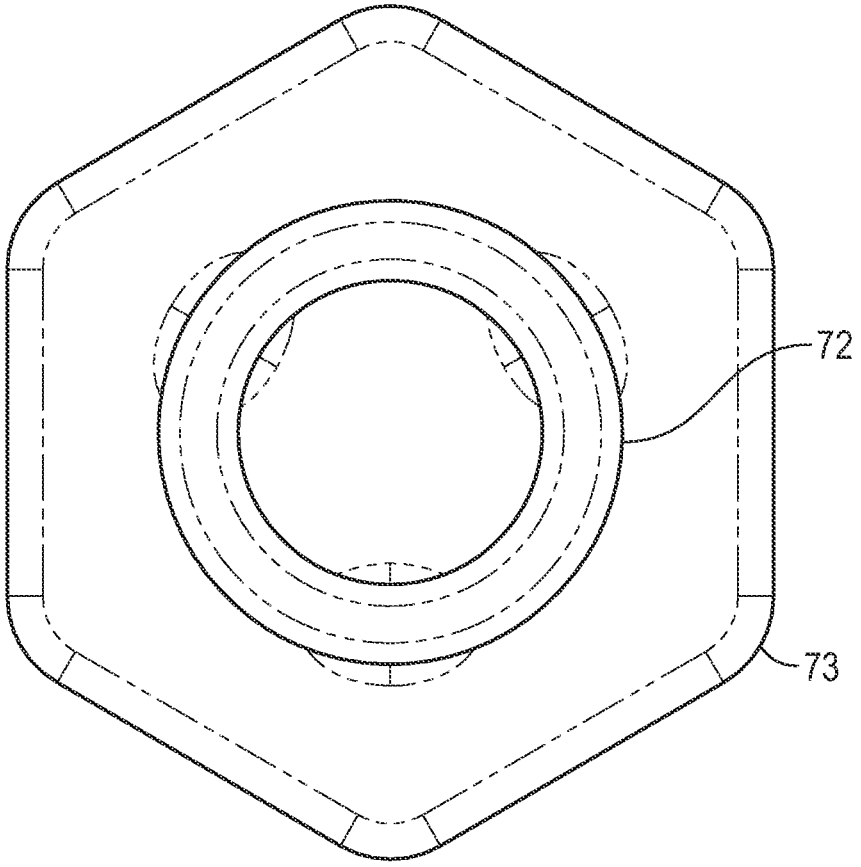
Figure 55:
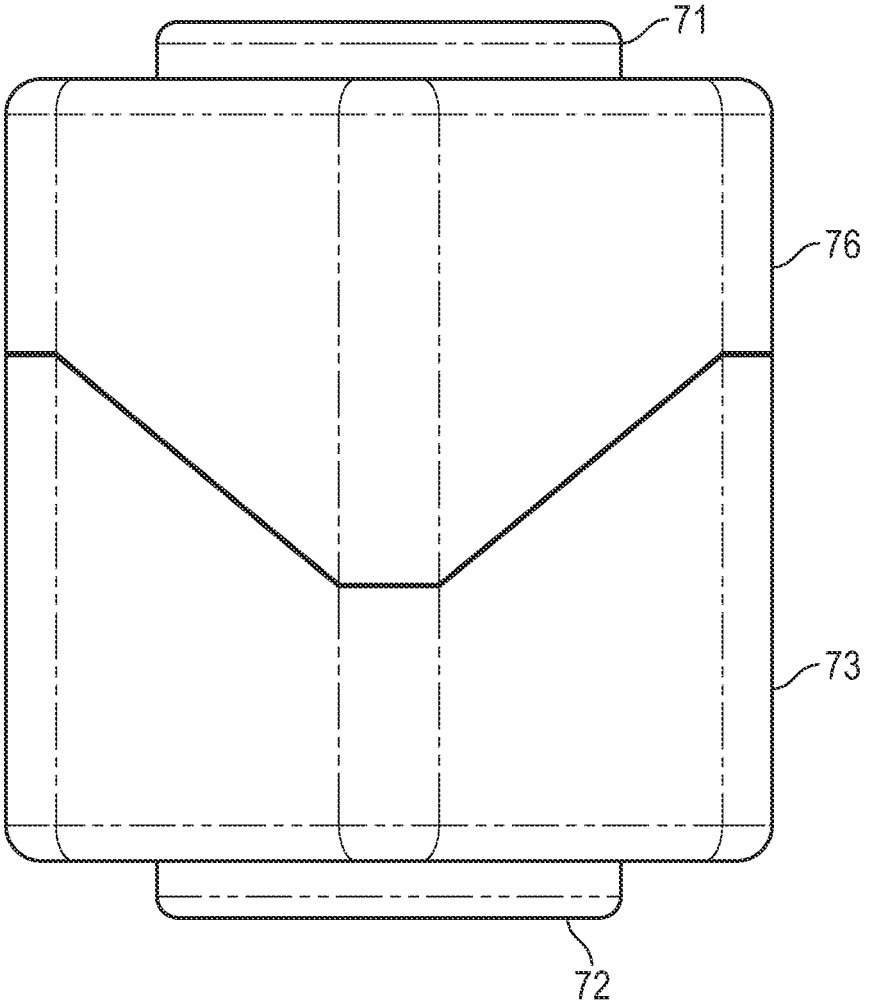
Figure 56:
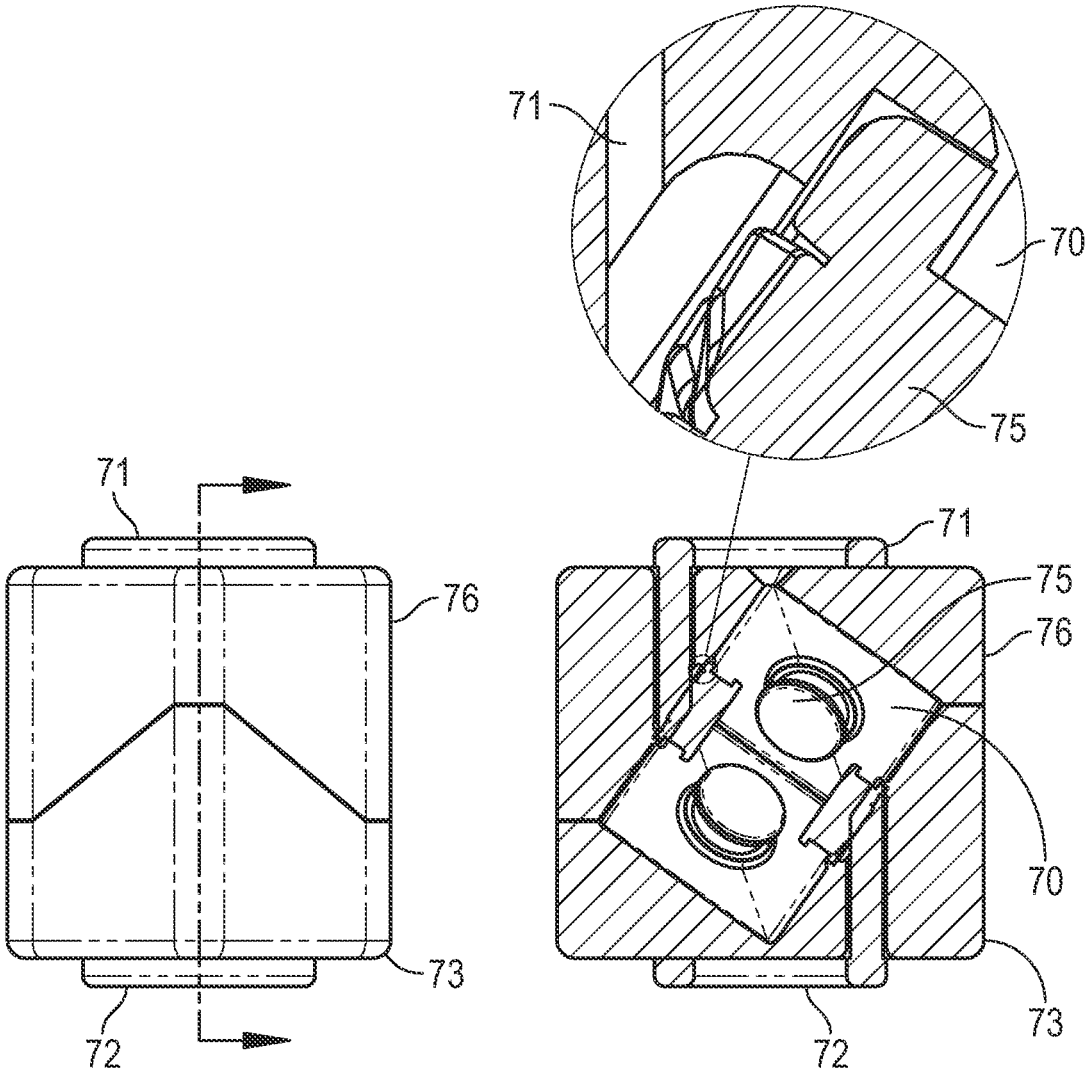
Figure 57:
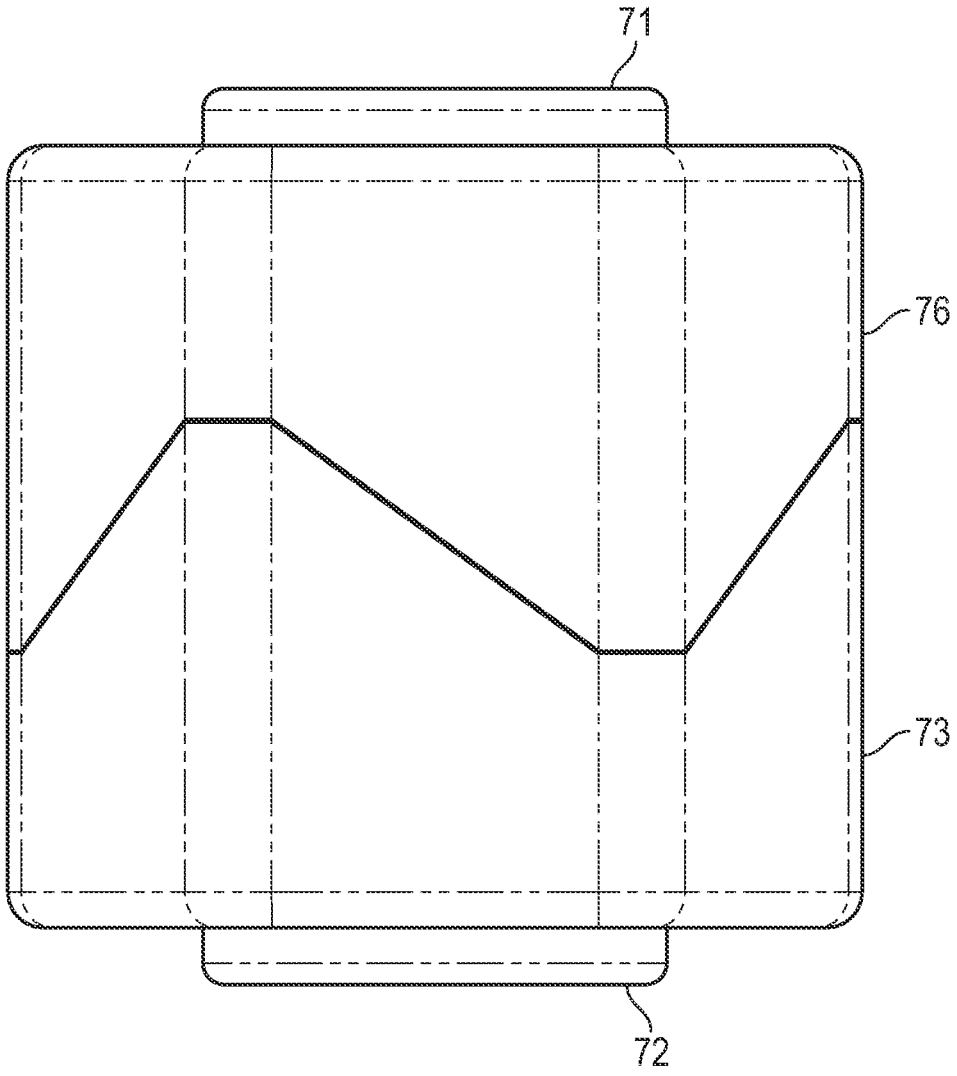
Figure 58:
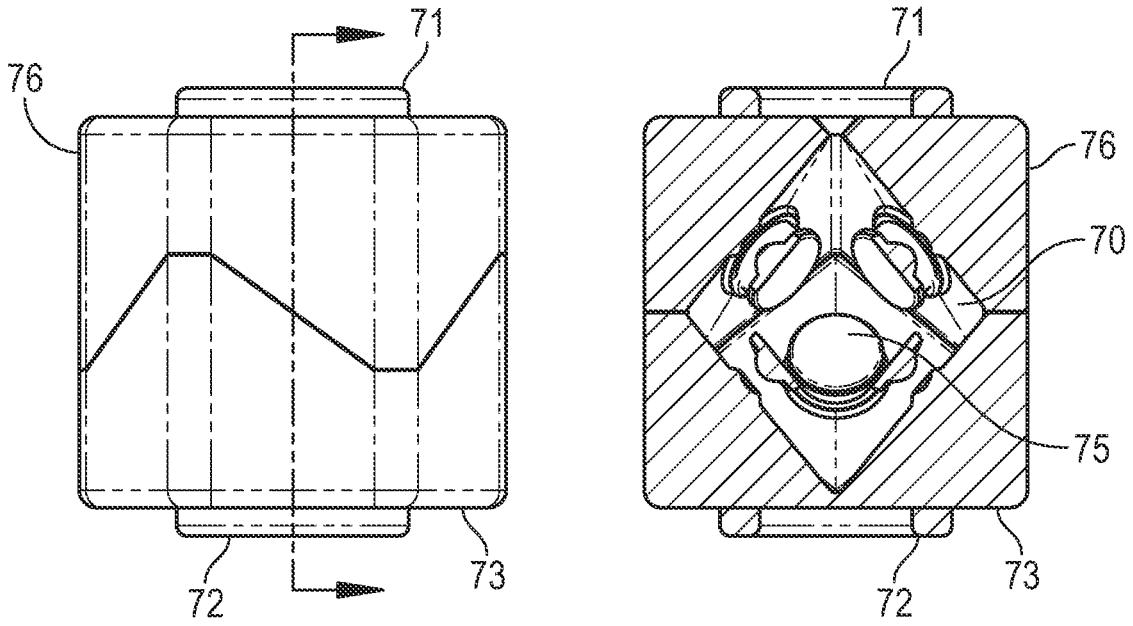
Figure 59:
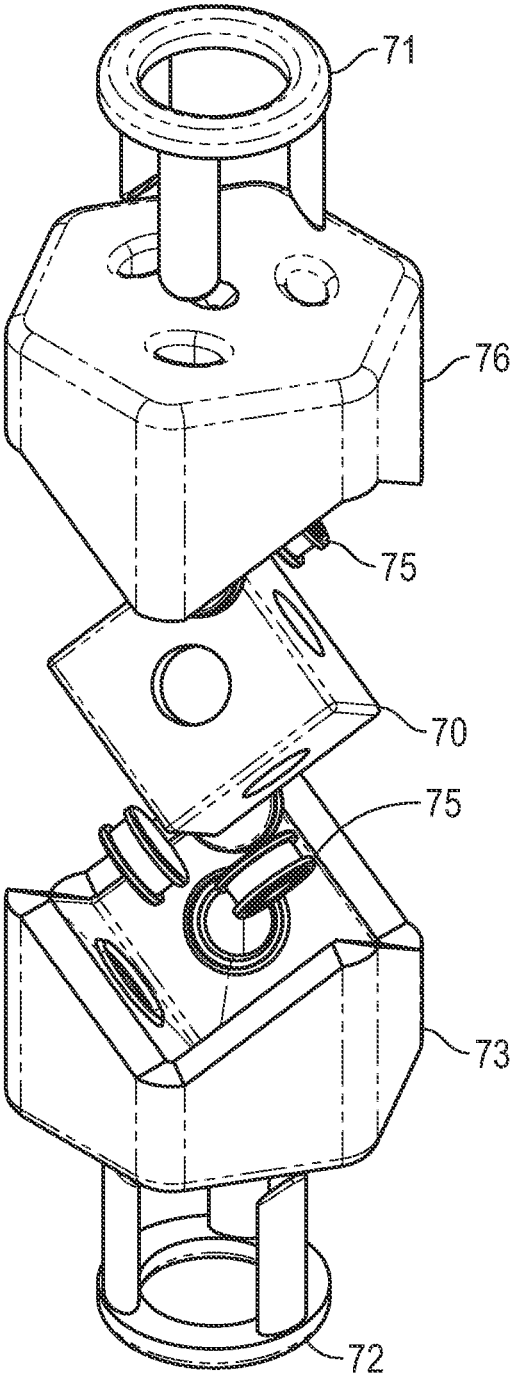
Figure 60:
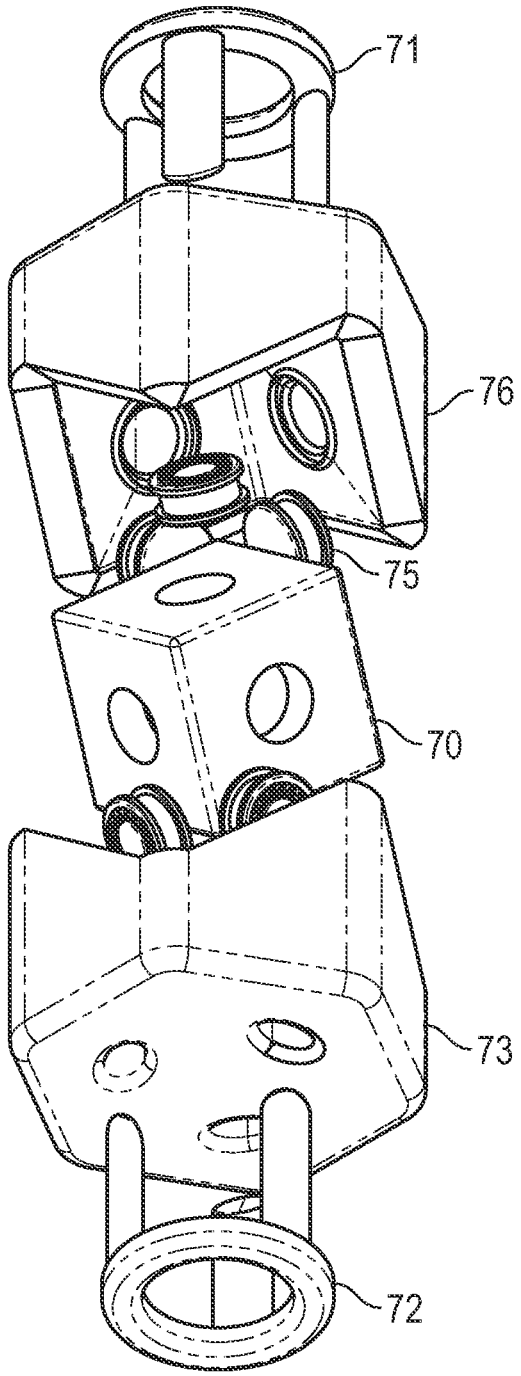

FIGS. 51-60 illustrate aspects of a methodology for producing a magnetic foam (or other material) block that decreases production time and confronts or overcomes challenges of bonding two low-surface energy materials together in a durable or permanent way. In FIGS. 51-60:

FIG. 51 is a top isometric view of the mold including the rod-like demolding insert 71/72;

FIG. 52 is a bottom isometric view of the mold including the rod-like demolding insert 71/72;

FIG. 53 is a top view of the mold including the rod-like demolding insert 71/72;

FIG. 54 is a bottom view of the mold including the rod-like demolding insert 71/72;

FIG. 55 is front view of the mold including the rod-like demolding insert 71/72;

FIG. 56 is a front cross-sectional view of the mold including the rod-like demolding insert 71/72;

FIG. 57 is a side view of the mold including the rod-like demolding insert 71/72;

FIG. 58 is side cross-sectional view of the mold including the rod-like demolding insert 71/72;

FIG. 59 is an exploded top isometric view of the mold including the rod-like demolding insert 71/72, which may include the upper rod-like demolding insert 71/72, upper mold housing 73, plastic inserts 75, foam block 60/70, lower mold housing 76, and lower rod-like demolding insert 71/72; and FIG. 60 is an exploded bottom isometric view of the mold including the rod-like demolding insert 71/72, which may include the upper rod-like demolding insert 71/72, upper mold housing 73, plastic inserts 75, foam block 60/70, lower mold housing 76, and lower rod-like demolding insert 71/72.

Figure 60A:
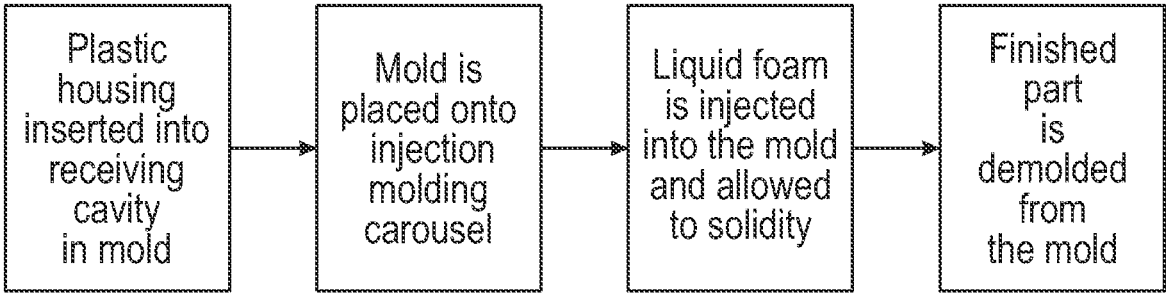

FIG. 60A is a flow chart illustrating a method for producing a magnetic foam (or other material) wherein block plastic (or other material) magnetic housings may be inserted into receiving cavities or apertures within the molds according to one or more embodiments of the present disclosure.

In this exemplary method, plastic (or other material) magnetic housings may be inserted into receiving cavities or apertures within the molds. A tight interference between these mating parts may be provided to ensure the parts are not allowed to move during processing or allow an injected material to migrate to the exterior face of the plastic insert. Geometry at the base of the plastic insert may be constructed in a way that a physical entanglement will occur reducing a need for a chemical bond between the joining components. A molding carousel may be used to facilitate production.

An additional step using methods such as chemical priming or atmospheric plasma may be applied to plastic inserts 75 prior to insertion to increase the surface energy, thereby allowing for a stronger chemical bond to take place.

A liquid form of polymer such as PU foam, TPU, EVA foam or other conventional polymer may then be injected into said mold entrapping all plastic inserts 75 as well as forming to the shape of the mold. After a cooling process occurs, a rod-like object may be inserted into the mold helping to remove the plastic inserts 75 from the previously stated interference helping to "demold" the part.

The mold may also be oriented at a 45° angle to help ensure that any parting lines may be placed along six edges of the final part and therefore do not bisect the plastic magnetic housings. Other variations of this mold could embody different angles.

Figure 61:
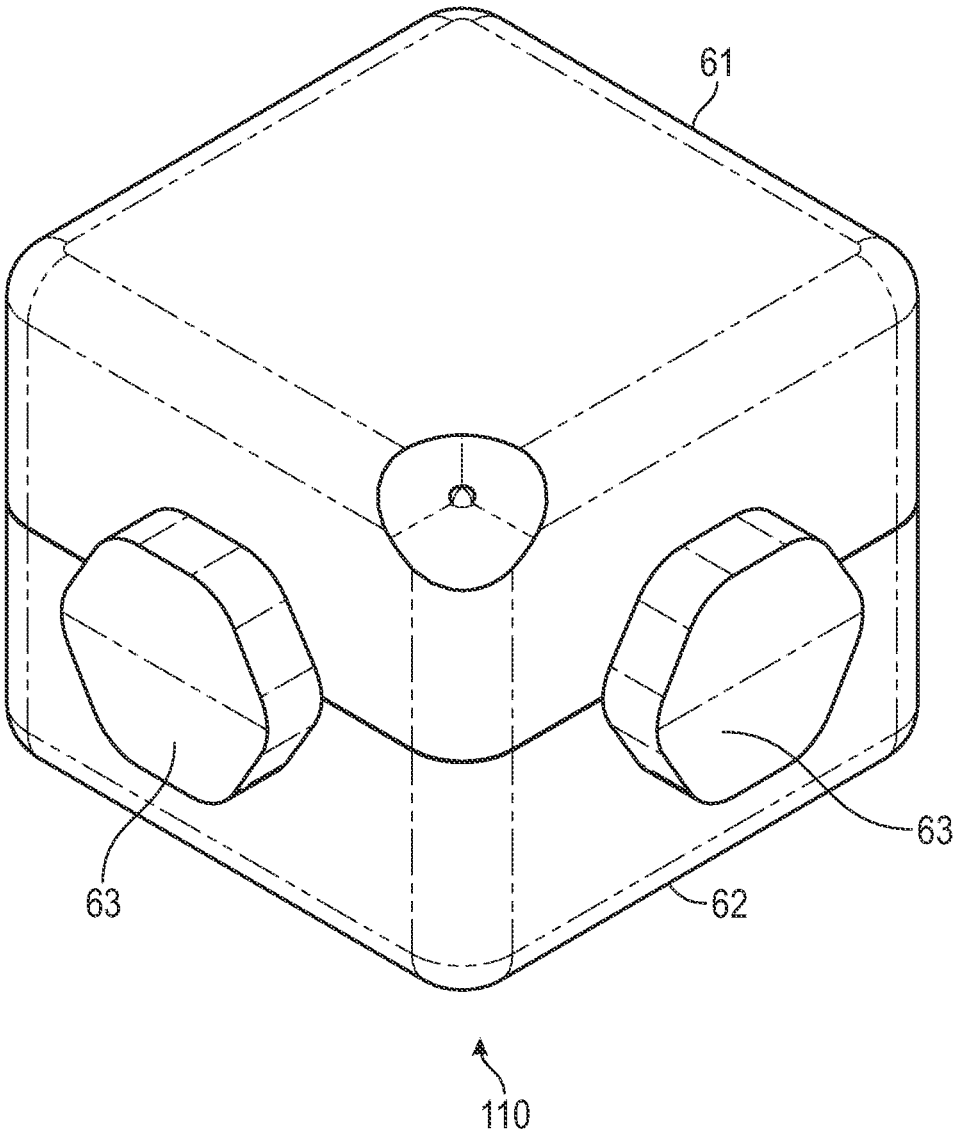
FIGS. 61-70A show various perspective views, a top view, a side view, cross-sectional views, and exploded views of an exemplary embodiment of structures and methods which may be used to produce the attachment members of one or more embodiments.

FIGS. 61-70 illustrate aspects of an alternate exemplary method for producing a magnetic foam (or other material) block that may serve to decrease the amount of time required to produce the item as well as overcome challenges of bonding two low-surface energy materials together in a permanent or durable manner. Shown in these figures are an alternate upper mold housing 61, alternate lower mold housing 62, pick-out-tool-parts 63, foam block 60, and plastic magnetic assembly place holders 65. The exemplary method is further described with reference to FIGS. 61-70, in which:

FIG. 61 is a top isometric view of the mold including the pick-out-tool-parts 63.

Figure 62:
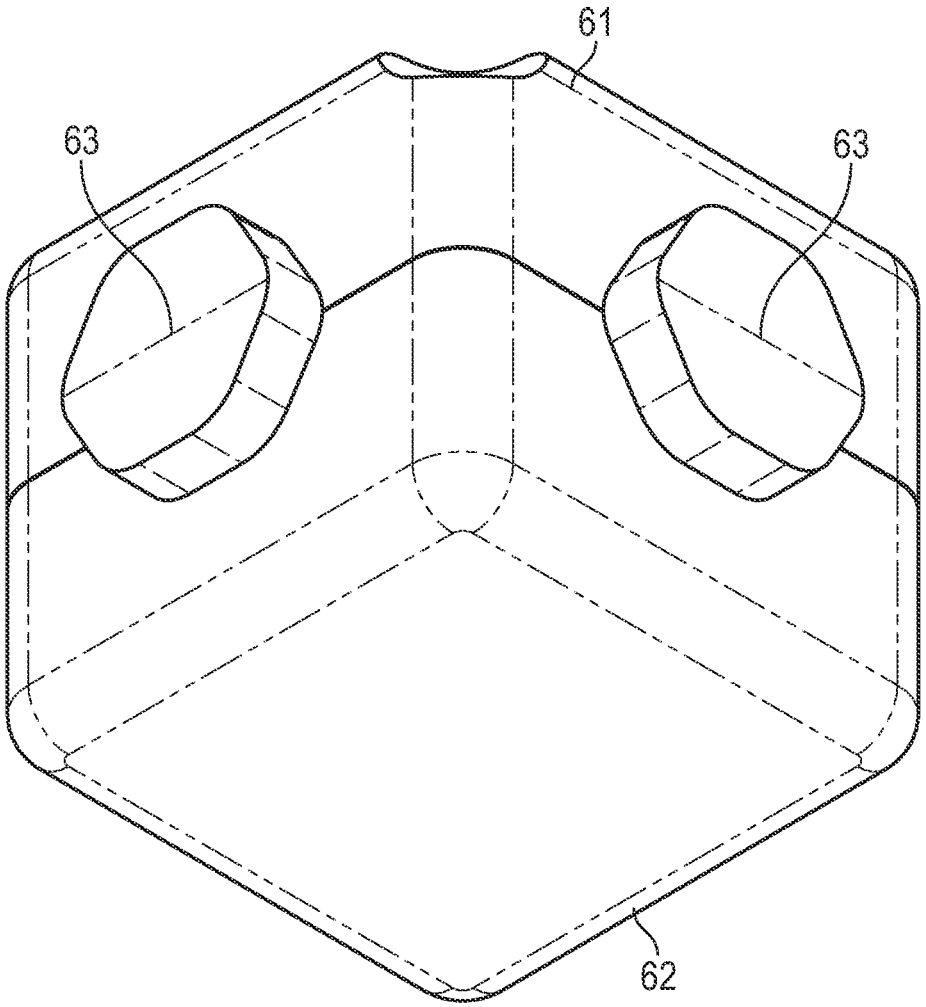
Figure 63:
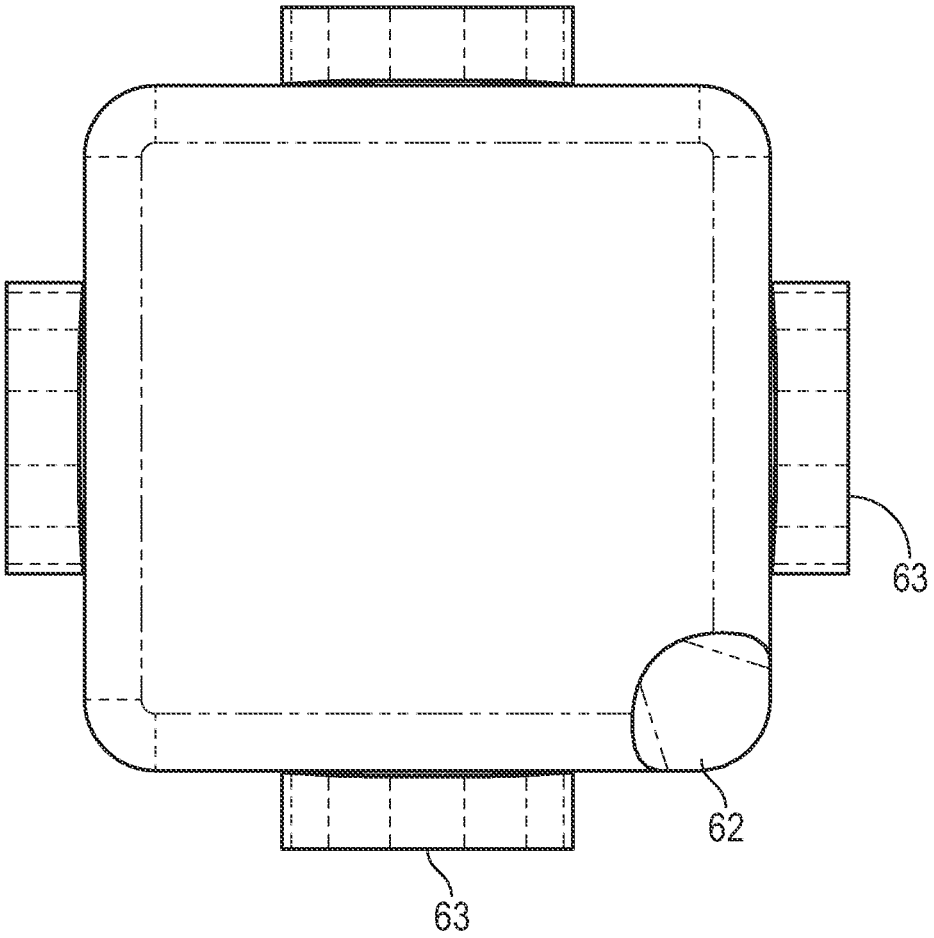
Figure 64:
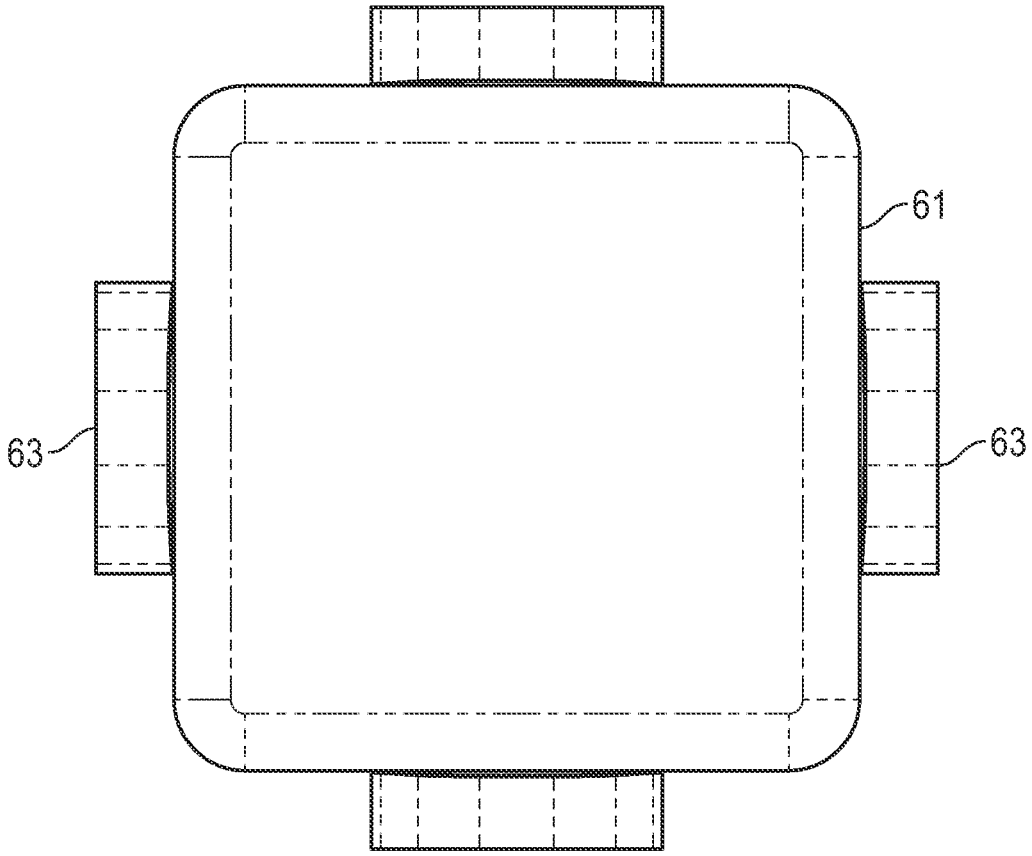
Figure 65:
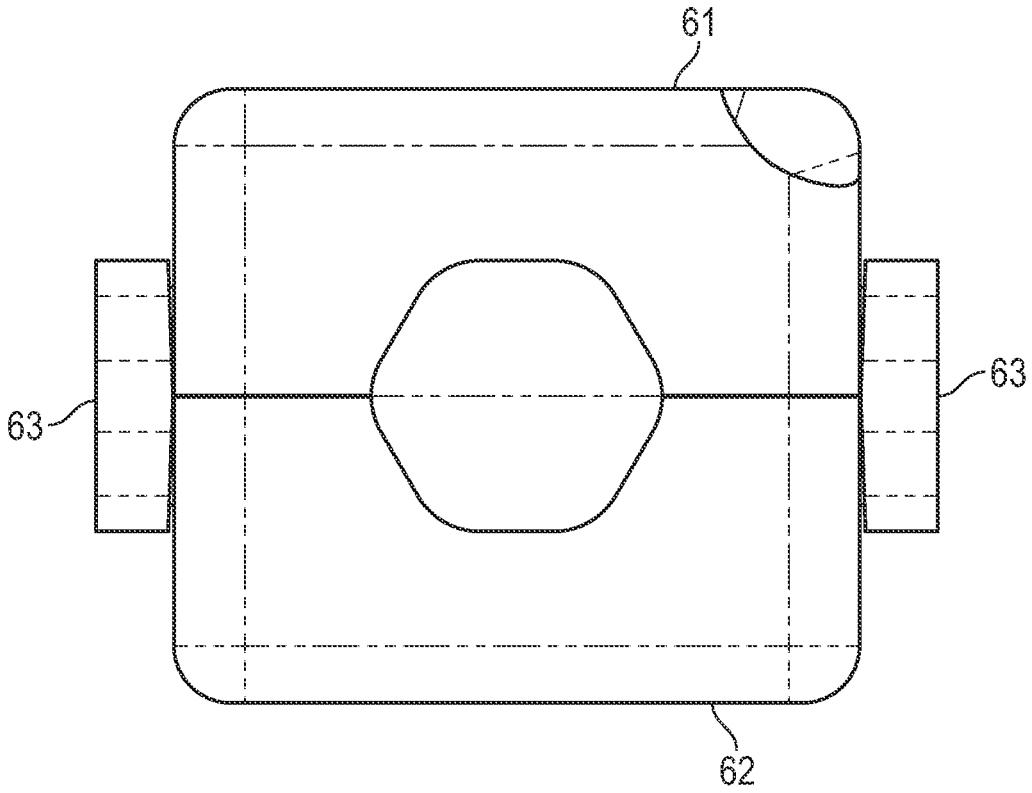
Figure 66:
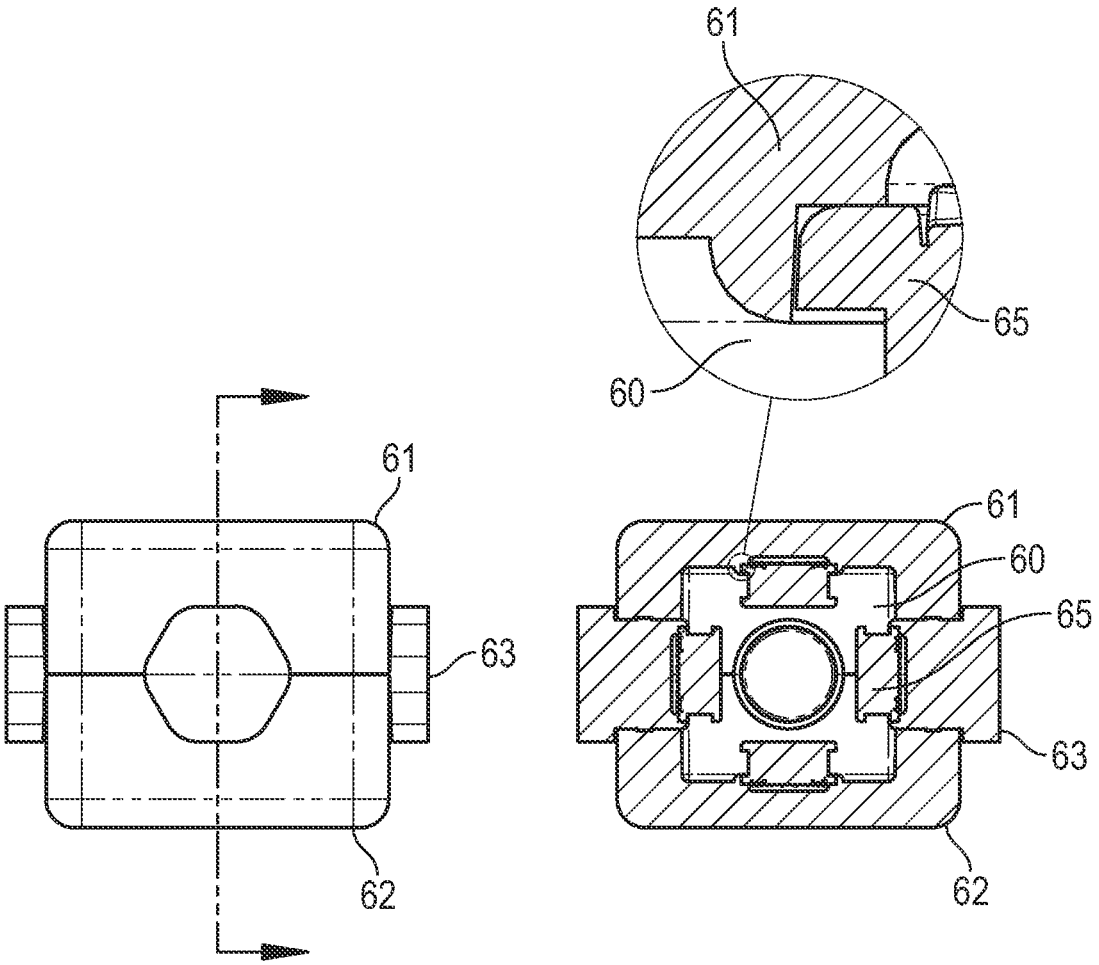
Figure 67:
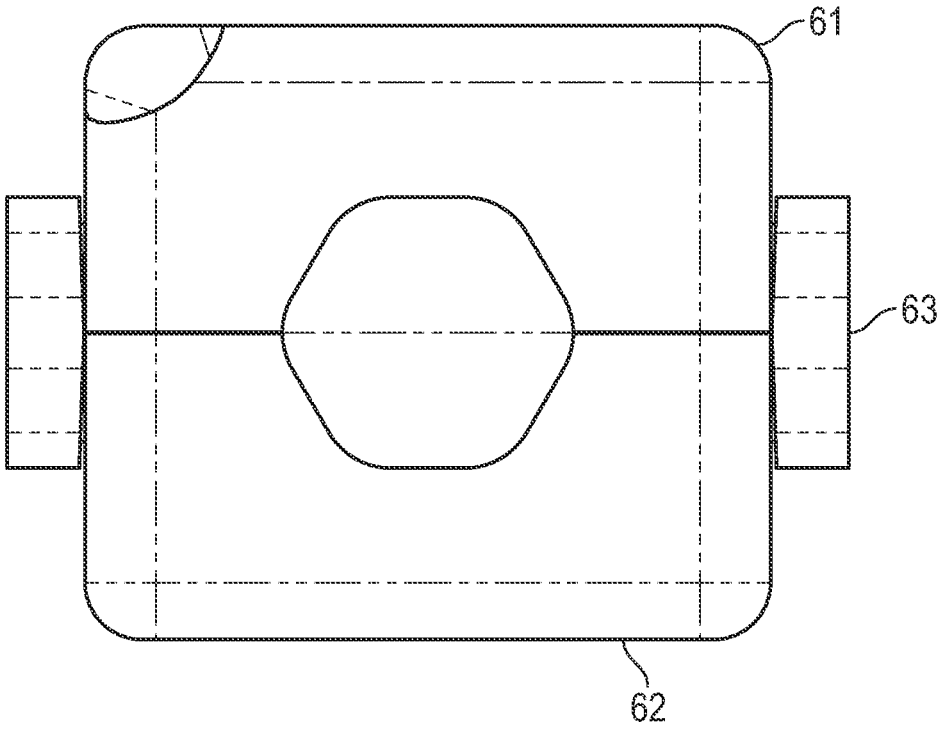
Figure 68:
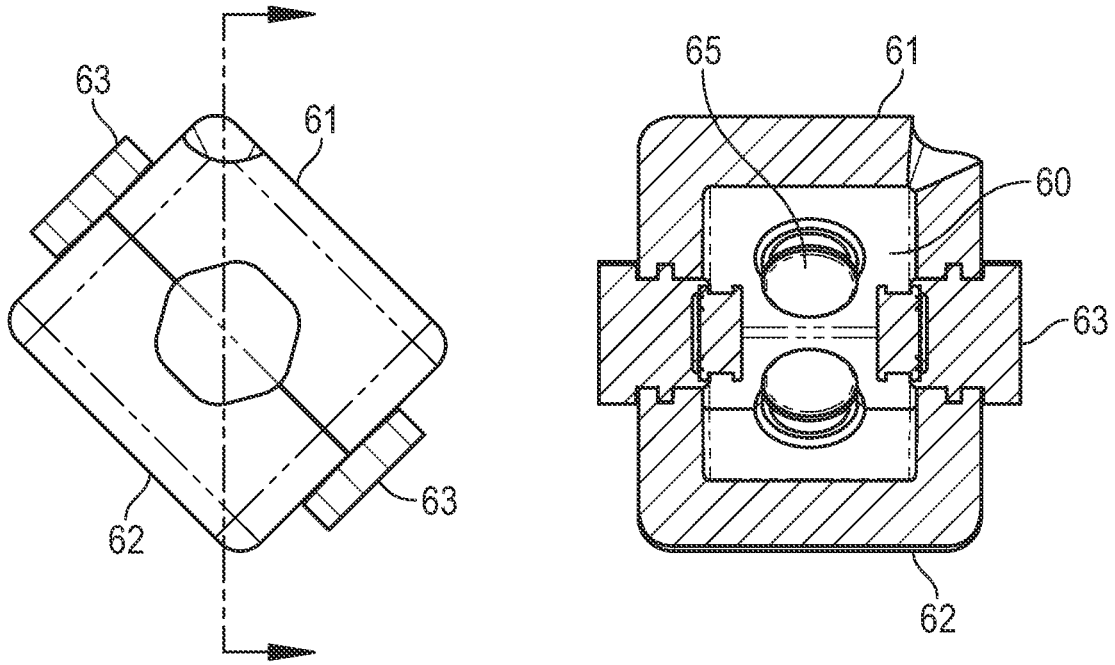
Figure 69:
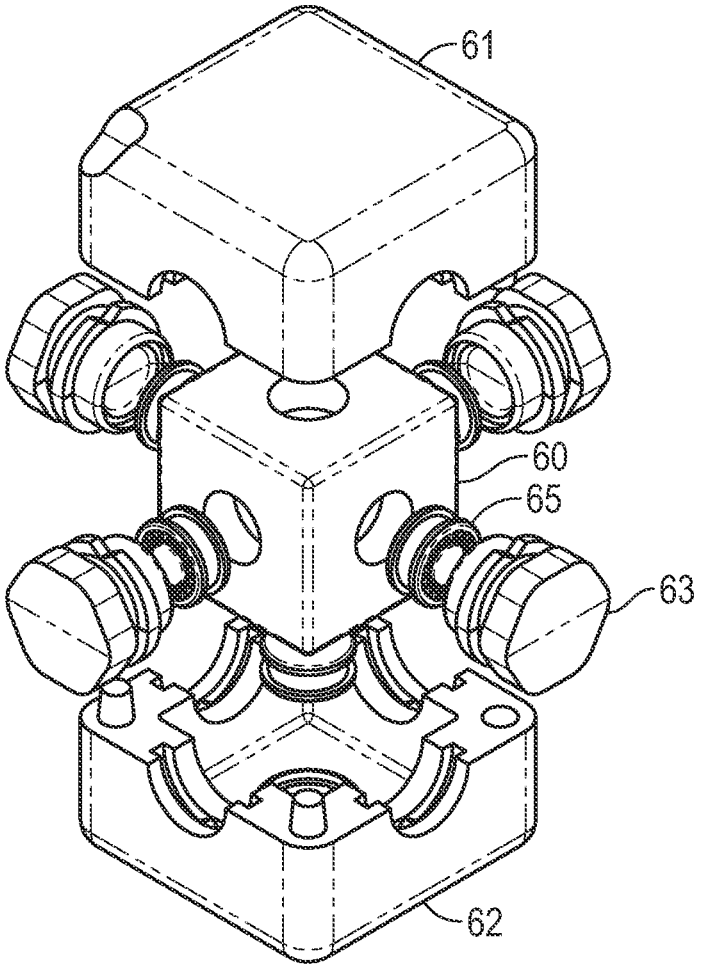
Figure 70:
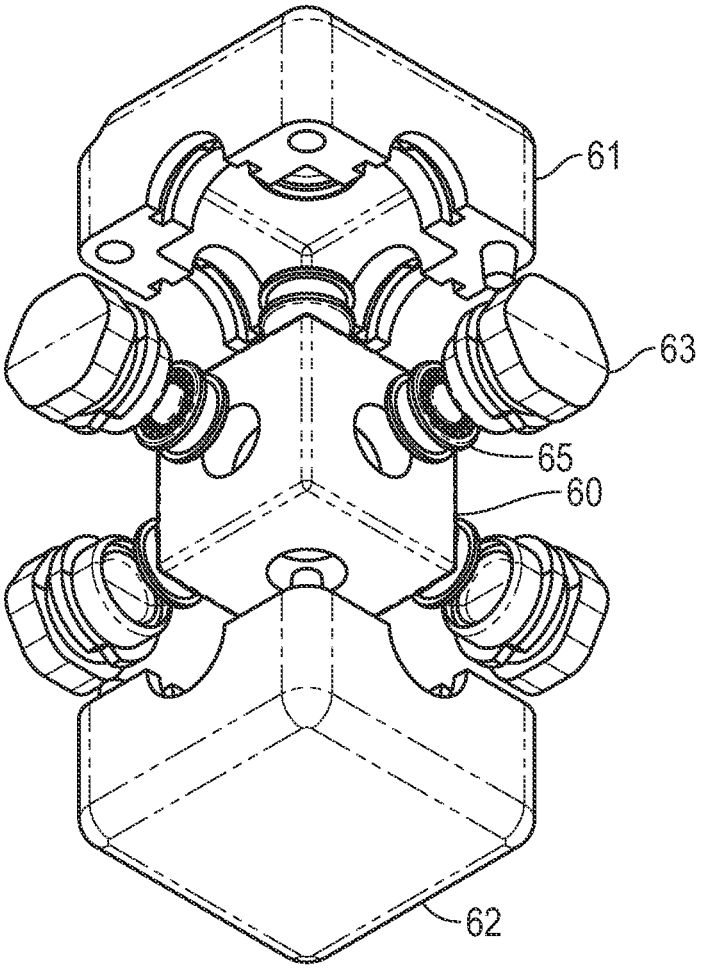

FIG. 62 is a bottom isometric view of the mold including the pick-out-tool-parts 63;

FIG. 63 is a top view of the mold including the pick-out-tool-parts 63;

FIG. 64 is a bottom view of the mold including the pick-out-tool-parts 63;

FIG. 65 is a front view of the mold including the pick-out-tool-parts 63;

FIG. 66 is a front cross-sectional view of the mold including the pick-out-tool-parts 63;

FIG. 67 is a side view of the mold including the pick-out-tool-parts 63;

FIG. 68 is a side cross-sectional view of the mold including the pick-out-tool-parts 63;

FIG. 69 is an exploded top isometric view of the mold including the upper mold cavity, which may include the pick-out-tool-part 63, plastic magnetic assembly place holders 65, foam block 60/70 and lower mold cavity; and FIG. 70 is an exploded isometric view of the mold including the upper mold cavity, which may include the pick-out-tool-part 63, plastic magnetic assembly place holders 65, foam block 60/70 and lower mold cavity.

Figure 70A:
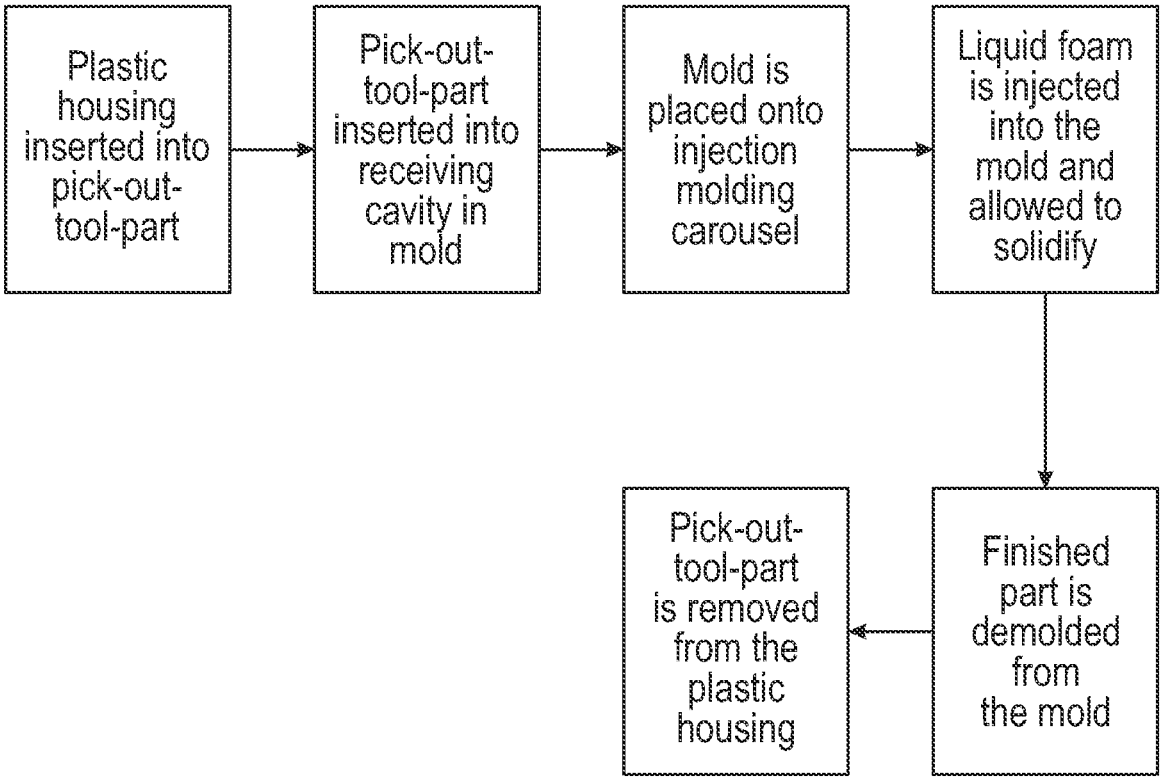

FIG. 70A is a flow chart illustrating a method for producing a magnetic foam (or other material) wherein plastic (or other material) magnetic housings may be inserted into pick-out-tool-parts 63 according to one or more embodiments of the present disclosure.

In this method, plastic (or other material) magnetic housings may be inserted into pick-out-tool-parts 63. A tight interference may be provided between mating parts to help ensure the parts do not move during processing, and to allow an injected material to migrate to the exterior face of the plastic insert. Geometry at the base of the plastic insert may be constructed to cause a physical entanglement to occur, thereby reducing the need for a chemical bond between the joining components.

An additional step using methods such as chemical priming or atmospheric plasma may be applied to the plastic magnetic assembly place holders 65 prior to insertion to increase the surface energy allowing for a stronger chemical bond to take place.

Plastic magnetic housings may also be attached to a single and central chassis as an insert-molded part that assembles all the parts into one assembly that can then be molded around. Alternatively, pucks may be designed to interlock at the center of a block in order to form this insert-mold assembly.

A liquid form of polymer such as PU foam, TPU, EVA foam or other similar polymer may be injected into the mold, thereby entrapping all plastic magnetic assembly place holders 65 as well as forming to the shape of the mold. Post cooling process, the pick-out-tool-parts 63 may be removed from the finished part.

Plastic magnetic housings may also be attached to a single and central chassis as an insert-molded part that assembles all the parts into one assembly that can then be molded around. Alternatively, pucks may be designed to interlock at the center of a block in order to form this insert-mold assembly.

Figure 71:
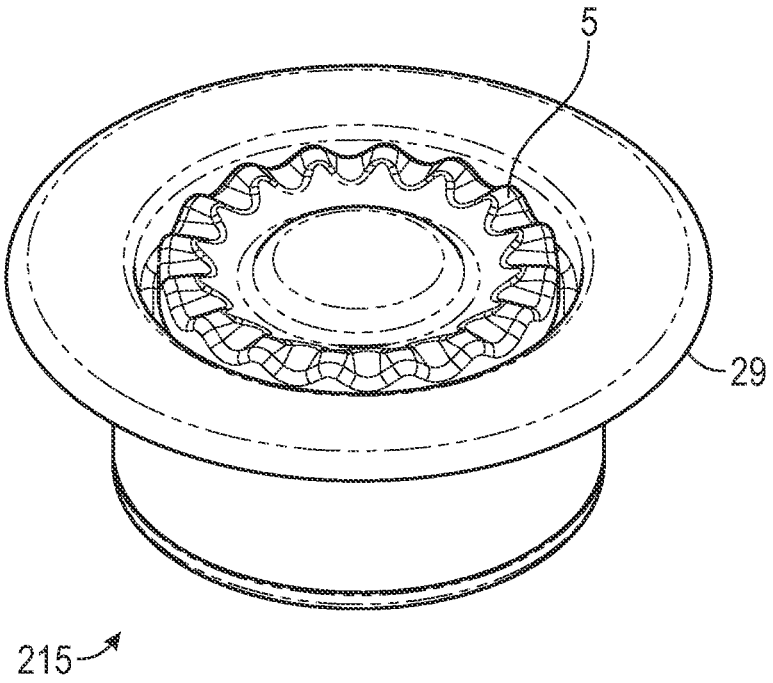
FIGS. 71-80 show various perspective views, a top view, a side view, cross-sectional views, and exploded views of an exemplary embodiment of a magnetic housing assembly which utilizes a ratcheting cap.
Figure 72:
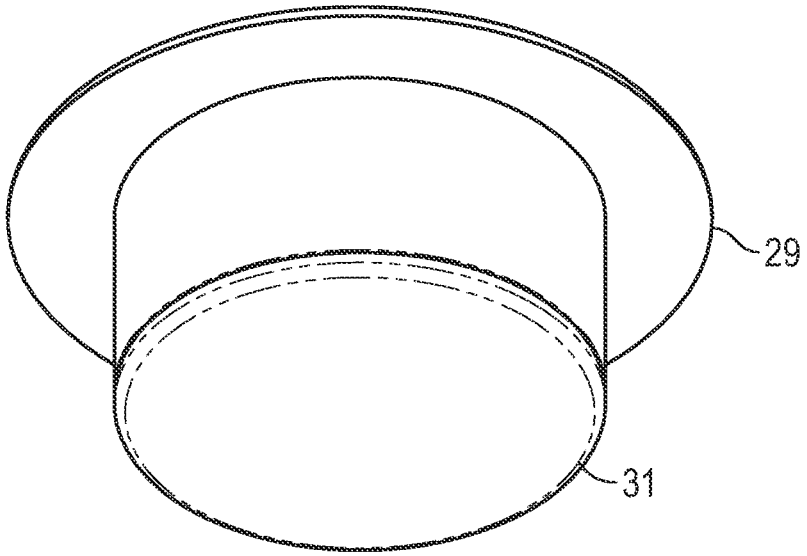
Figure 73:
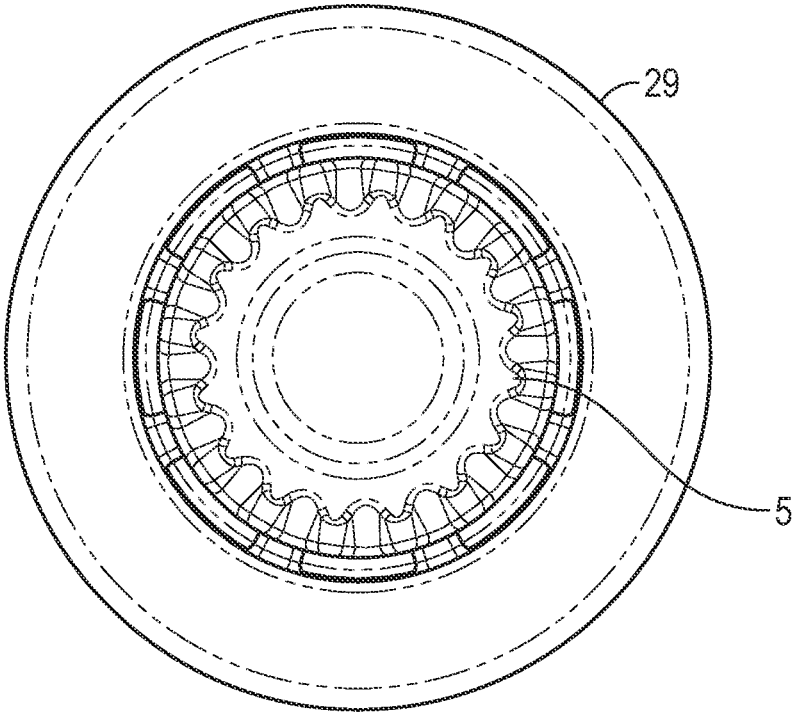
Figure 74:
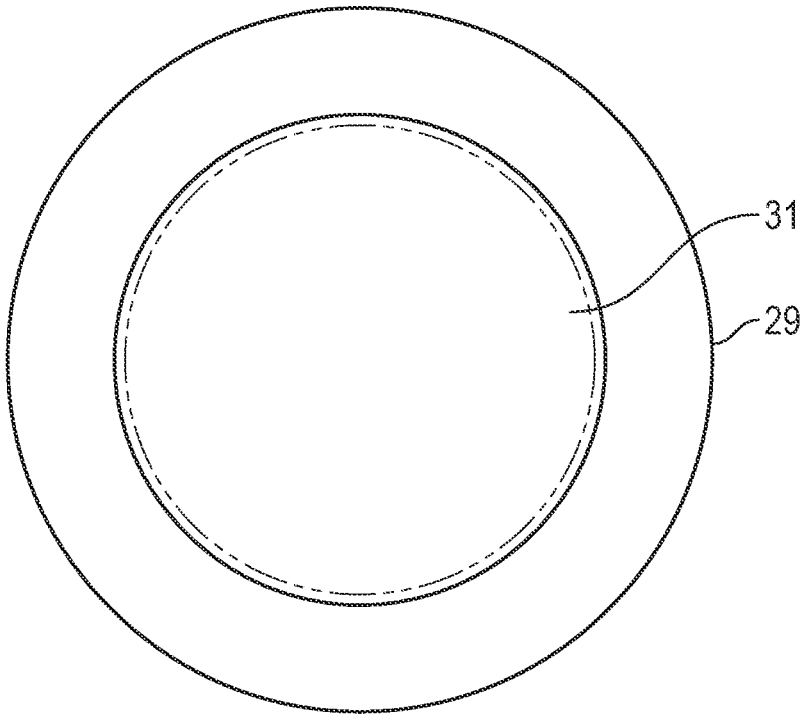
Figure 75:
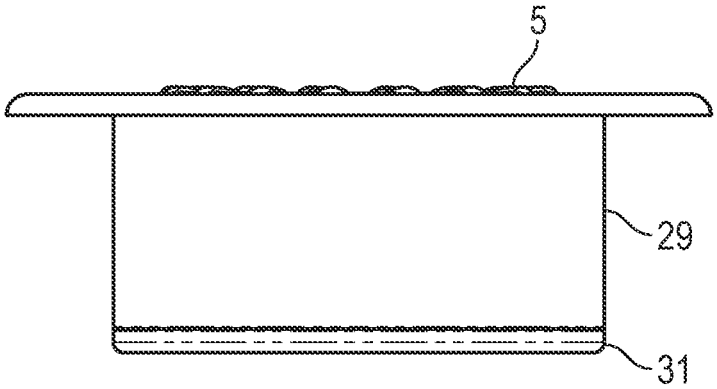
Figure 76:
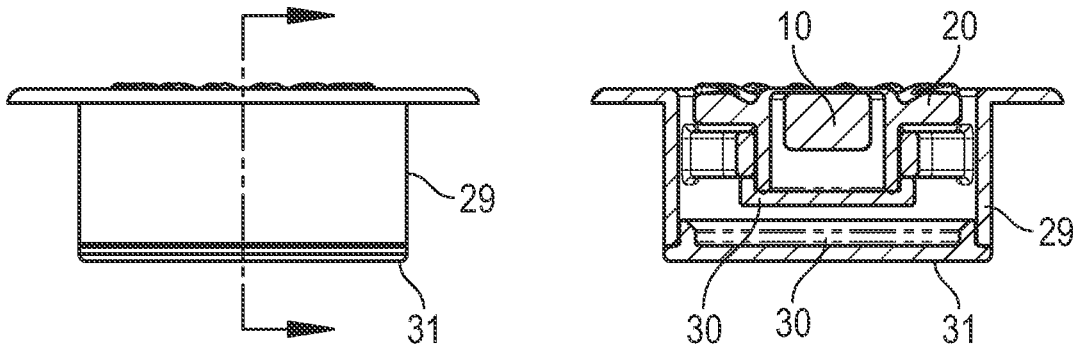
Figure 77:
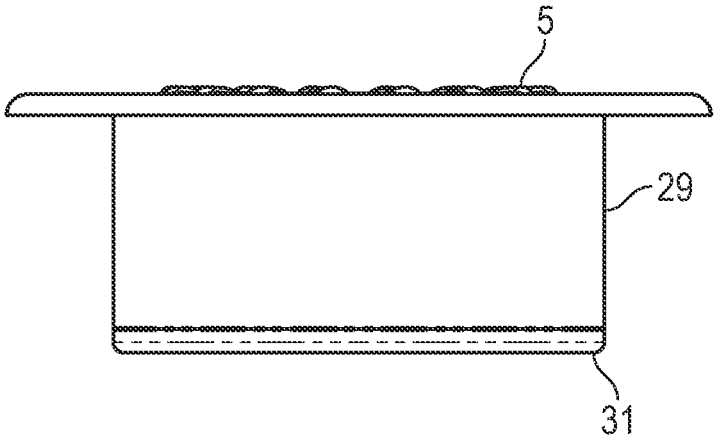
Figure 78:
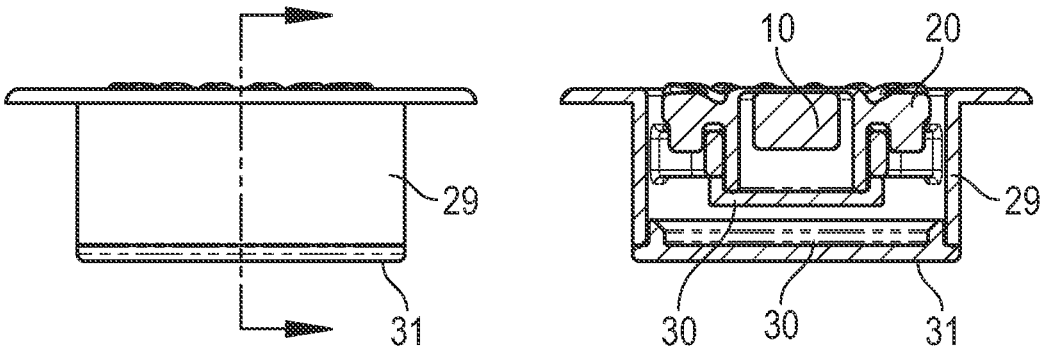
Figure 79:
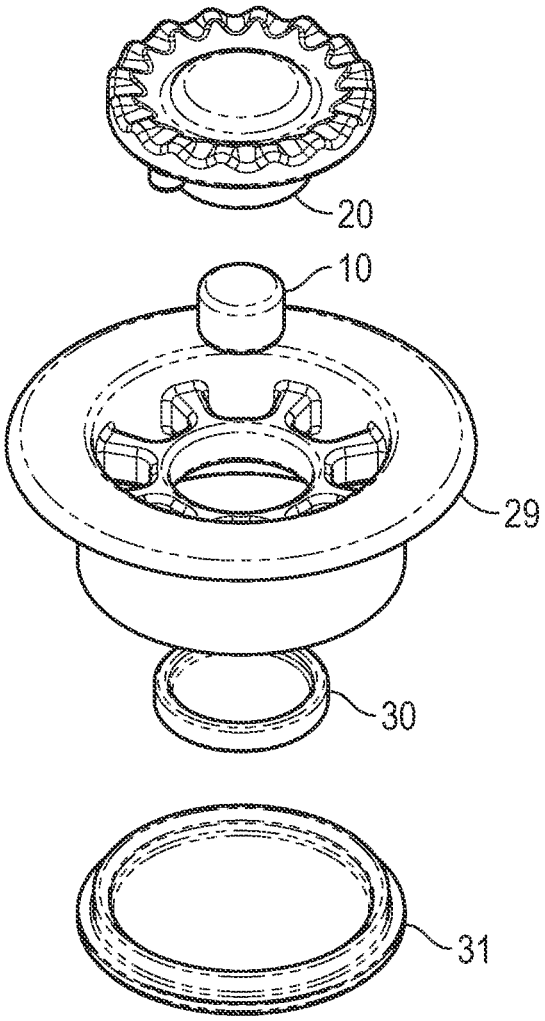
Figure 80:
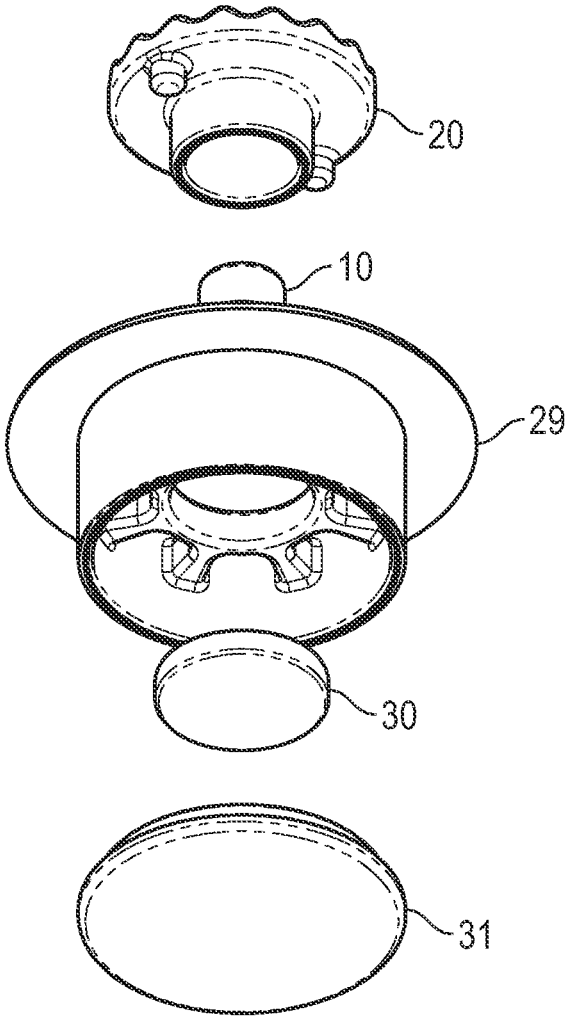

FIGS. 71-80 illustrate an embodiment of a magnetic housing that may include an ultrasonically, or chemically-welded hermetically-sealed or watertight enclosure to protect the magnet 10 from exposure to wet and corrosive environments. This seal may be created by capturing a magnet 10 within a top ratcheting cap 20 and a bottom cover. In FIGS. 71-80:

FIG. 71 is an isometric top view of an assembly with all parts combined;

FIG. 72 is an isometric bottom view of the assembly with the parts combined;

FIG. 73 is a top view of the assembly with the parts combined;

FIG. 74 is a bottom view of an assembly with the parts combined;

FIG. 75 is a front view of an assembly with the parts combined;

FIG. 76 is a front cross-sectional view of an assembly with the parts combined;

FIG. 77 is a side view of an assembly with the parts combined;

FIG. 78 is a side cross-sectional view of the assembly with the parts combined;

FIG. 79 is an exploded top isometric view of an exemplary magnetic housing assembly, that may include an upper ratcheting cap 20, magnet, main exterior housing 29, lower cover 30 and optional main bottom cover 31; and FIG. 80 is an exploded bottom isometric view of the magnetic housing assembly that may include an upper ratcheting cap 20, magnet, main exterior housing 29, lower cover 30 and optional main bottom cover 31.

In this embodiment, the joining of these pieces also captures the main exterior housing 29. The top ratcheting cap 20 has two protruding posts at the bottom side of the ring to interface within slots on the exterior housing. There may be a few degrees of rotational freedom before the interference limits the rotational movement. A small gap may be arranged axially between the main housing and space between the ratcheting cap 20 and lower cover 30. This gap allows the ratcheting face 5 to have float in the axial direction. Radial spaces (e.g. a plurality of slots) along the interior of the external housing to allow liquids or other substances to easily migrate out of the assembly. An additional main bottom cover 31 may be ultrasonically welded onto the housing. This serves to help prevent water (liquid) from migrating past the magnetic housing assembly. For blocks with complete through-holes, the main bottom cover 31 may be excluded to allow water to drain through the whole block.

This embodiment may include a combination of parts to produce an assembly that allows exterior faces of connecting blocks to align in a planar manner. The contacting surfaces may include a ratcheting interface to create a loud or audible clicking sound. This face may float for a few degrees radially to allow exterior faces of the blocks to align. The faces may also float axially so that the ratcheting teeth can pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Alternate forms of this embodiment may also eliminate the exterior smooth glue-in method and instead include cutting threads, barbs, a snap-in feature or other mechanical means of attachment.

In one exemplary embodiment, the magnetic housing assembly 215 may be inserted into a hole-cut, or may be machined or injection-molded into, foam, wood, plastic, or other material. An inner assembly containing a hermetically-sealed or watertight enclosed magnet, may be located within a plastic (or other material) housing that may be inserted into the main exterior housing 29. The magnet 10 may take the form of a cube, sphere, cylinder, or other shaped component. The outer housing may be fastened to the mating block through chemical bonding or mechanical interface methodology which may include threads, barbs, expanding areas or mating snap-fit inner features.

This design may allow for the magnet 10 to flip within the housing, thereby allowing it to orient itself into the correct polarity to pair with another magnetic block assembly.

In this embodiment, the structure of the ratcheting cap 20 and main exterior housing 29 may be substantially similar to the structure described in FIGS. 126-135. The water tight chamber or hermetically sealed chamber may be defined by the ratcheting cap 20 and a lower cap 30, which may be ultrasonically welded to create the hermetically sealed chamber. The ratcheting cap 20/lower cap 30 assembly may then be inserted into the main exterior housing 29, which may then be sealed with a main bottom cover 31 to form the final magnetic housing assembly 215.

Figure 81:
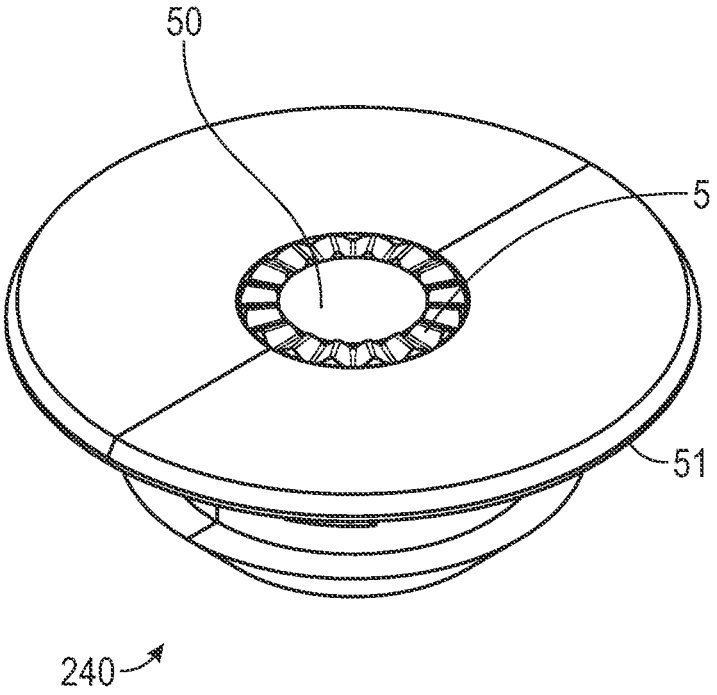
FIGS. 81-90 show various perspective views, a top view, a side view, cross-sectional views, and exploded views of an exemplary embodiment of a magnetic housing assembly which utilizes a ratcheting post.
Figure 82:
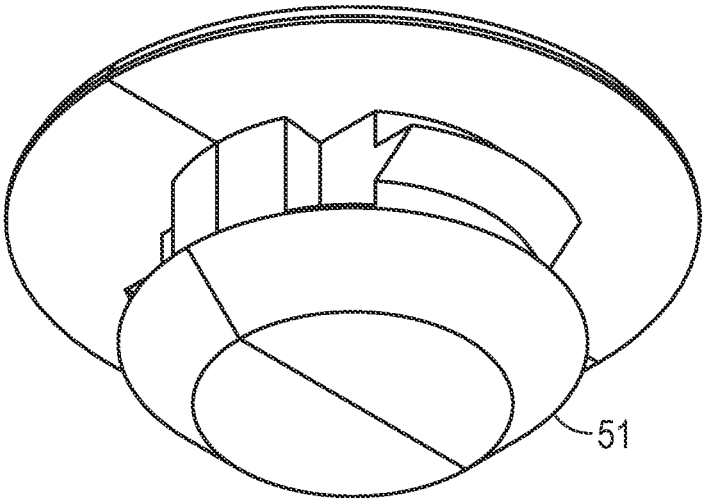
Figure 83:
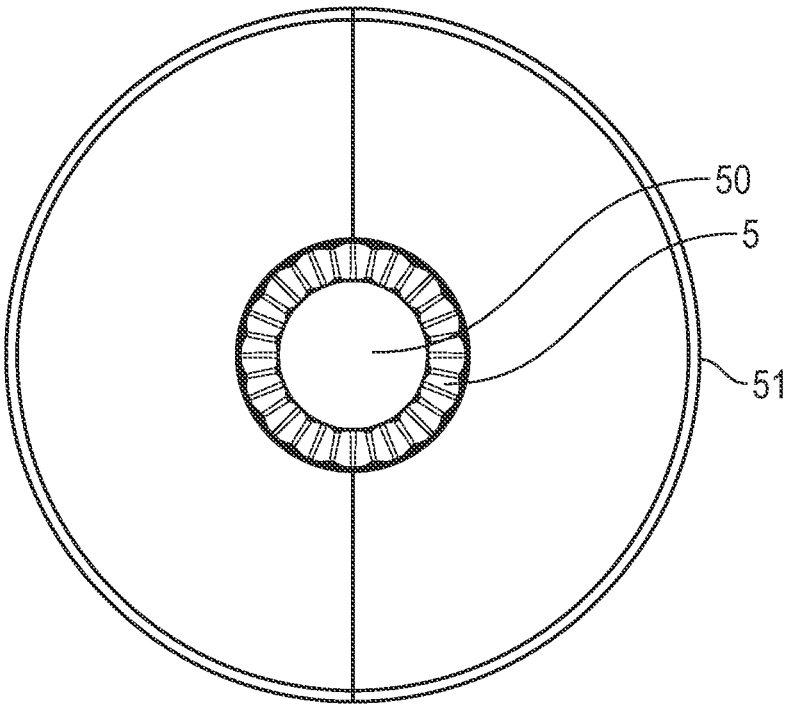
Figure 84:
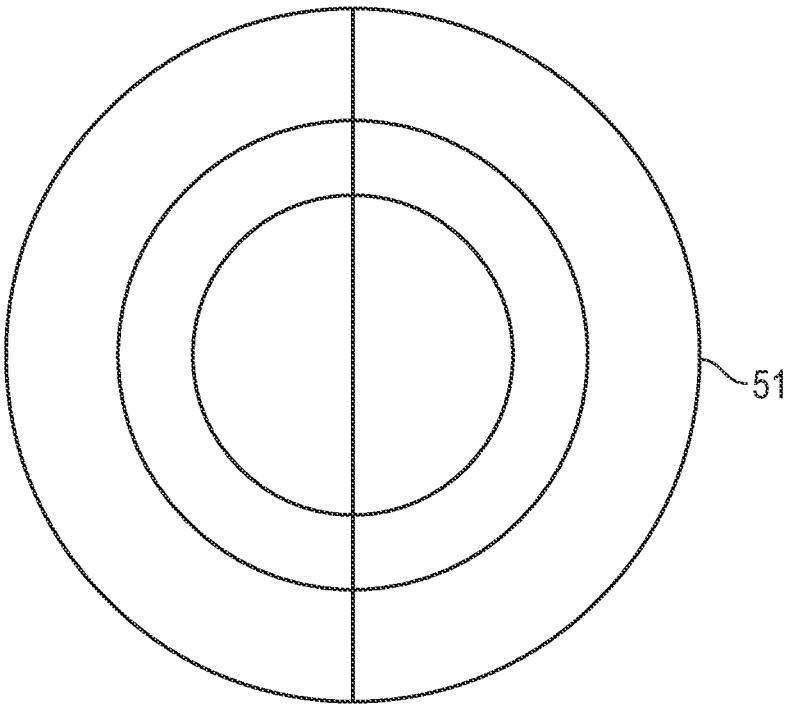
Figure 85:
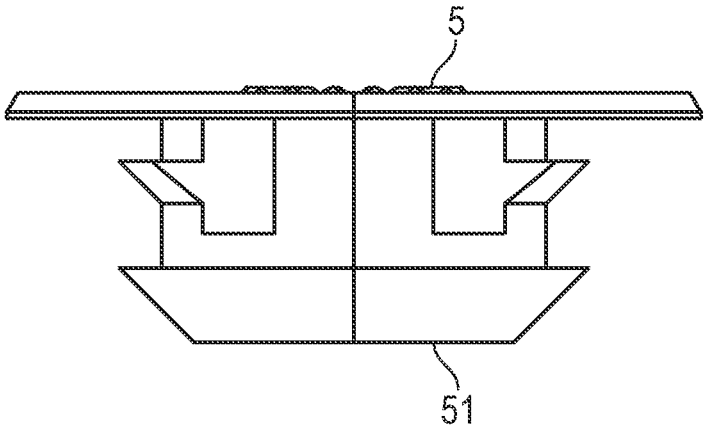
Figure 86:
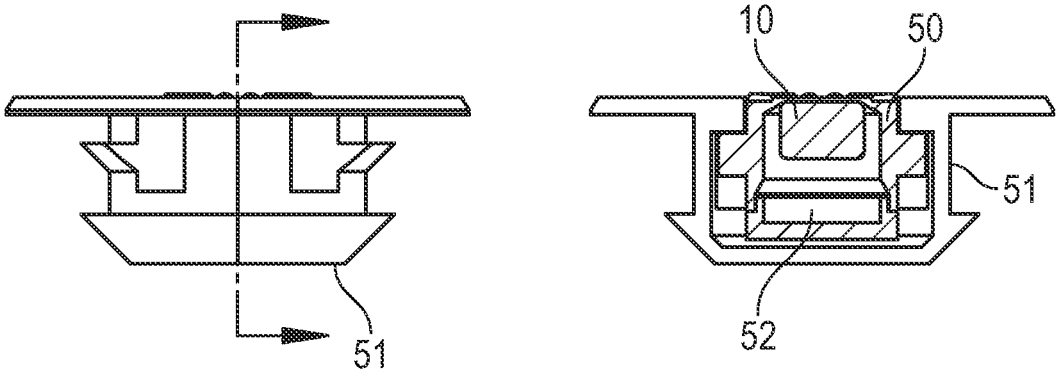
Figure 87:
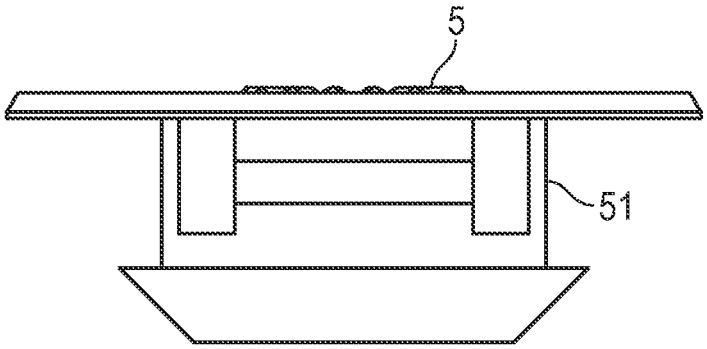
Figure 88:
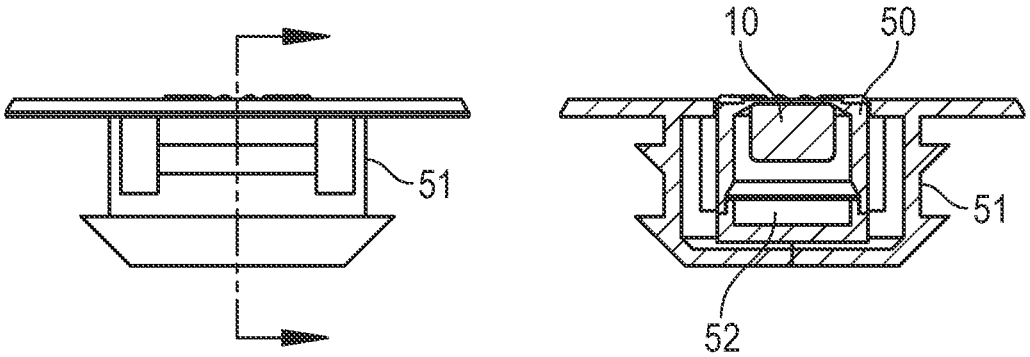
Figure 89:
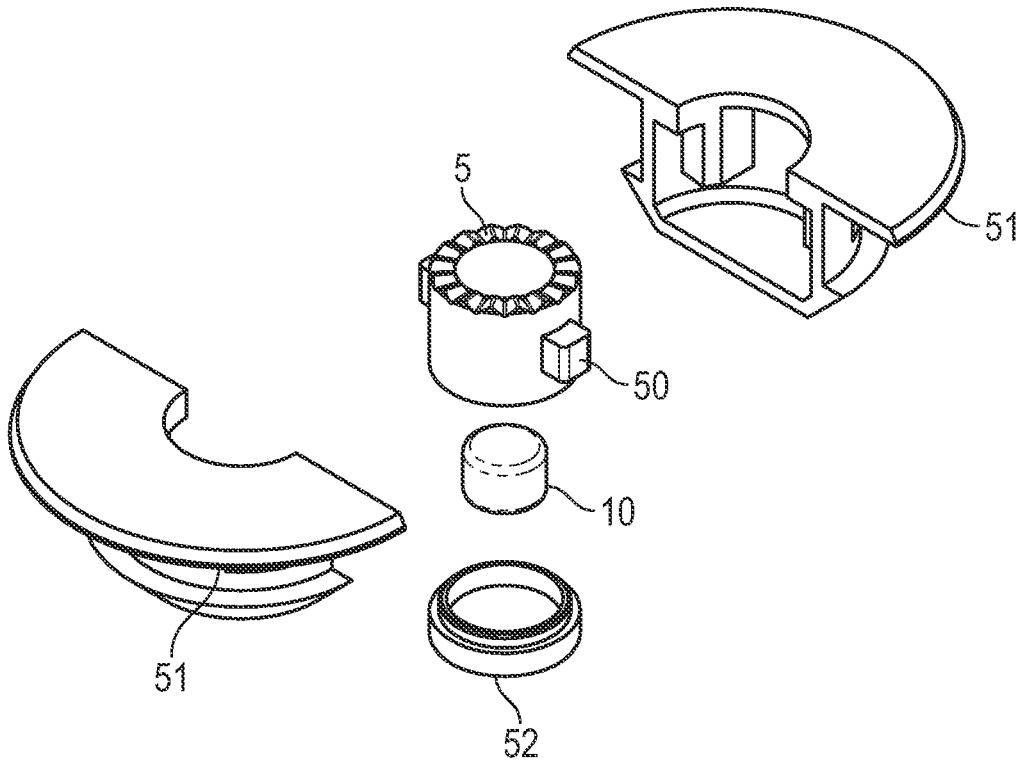
Figure 90:
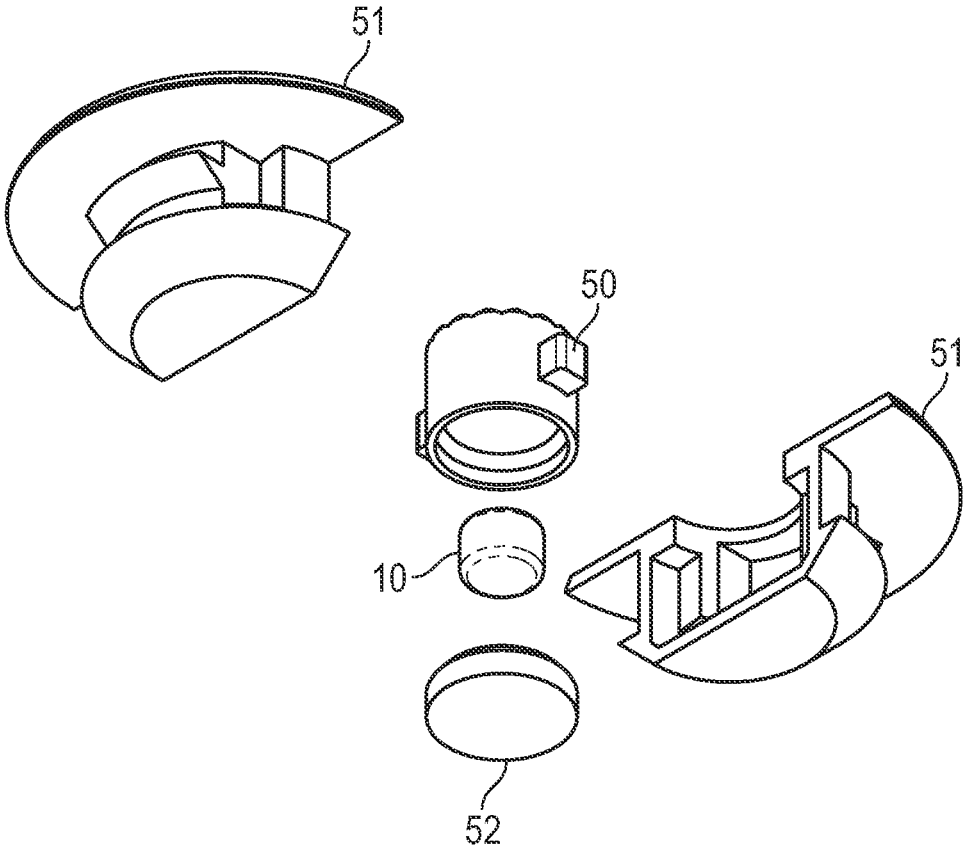

FIGS. 81-90 illustrate an embodiment in which the magnetic housing may include an ultrasonically, or chemically-welded watertight or hermetically-sealed enclosure to protect the magnet 10 from exposure to wet and corrosive environments. This seal may be created by capturing a magnet 10 between a ratcheting post and a lower cap 52. In FIGS. 81-90:

FIG. 81 is an isometric top view of an assembly with all parts combined;

FIG. 82 is an isometric bottom view of the assembly with the parts combined;

FIG. 83 is a top view of the assembly with the parts combined;

FIG. 84 is a bottom view of an assembly with the parts combined;

FIG. 85 is a front view of an assembly with the parts combined;

FIG. 86 is a front cross-sectional view of an assembly with the parts combined;

FIG. 87 is a side view of an assembly with the parts combined;

FIG. 88 is a side cross-sectional view of the assembly with the parts combined;

FIG. 89 is an exploded top isometric view of an exemplary magnetic housing assembly, that may include a ratcheting post, magnet, lower cap 52 and exterior housing 51; and FIG. 90 is an exploded bottom isometric view of the magnetic housing assembly that may include a ratcheting post 50, magnet, lower cap 52 and exterior housing 51.

The exterior housing 51 captures the welded magnet 10 assembly within cavities formed when the two halves may be ultrasonically welded together. This assembly also makes for a second level of water resistance to liquids. Exterior small extrusion barbs with upward angular faces help to facilitate an easy insertion into the mating foam body and a resistance to movement in the opposite direction upon insertion.

This design uses a combination of parts to produce an assembly that allows exterior faces of connecting blocks to align in a planar manner. The contacting surfaces use a ratcheting interface to create a loud or audible clicking sound. This face can float for a few degrees radially to allow exterior faces of the blocks to align. The faces can also float axially so that the ratcheting teeth can pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Alternate forms of this embodiment may also eliminate the exterior barbs and instead include smooth glue-in method, cutting threads, a snap-in feature or other mechanical means of attachment.

The magnetic housing assembly 240 may be inserted into a hole-cut, or may be machined or injection-molded into, foam, wood, plastic, or other material. Next, the inner assembly containing a hermetically-sealed enclosed magnet, wherein the shape of the magnet 10 can be a cube, sphere, cylinder, or other shaped component, within a plastic (or other material) housing that may be inserted into the anchor body 21. The outer housing may be fastened to the mating block through chemical bonding or mechanical interface methodology which can include threads, barbs, expanding areas or mating snap-fit inner features.

This design may allow for the magnet 10 to flip within the housing, allowing each magnet 10 to orient itself into the correct polarity to pair with another magnetic block assembly.

Figure 91:
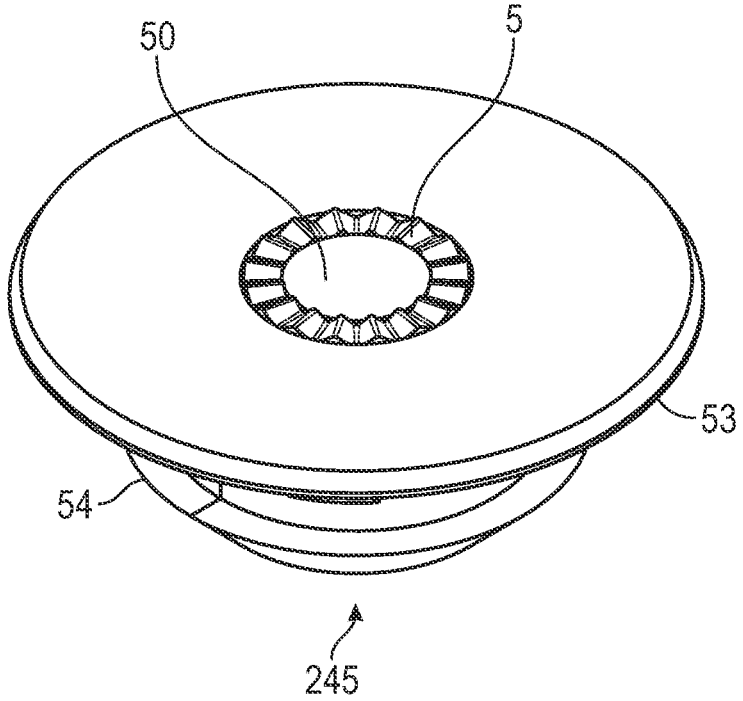
FIGS. 91-100 show various perspective views, a top view, a side view, cross-sectional views, and exploded views of an exemplary embodiment of a magnetic housing assembly which utilizes a ratcheting post.
Figure 92:
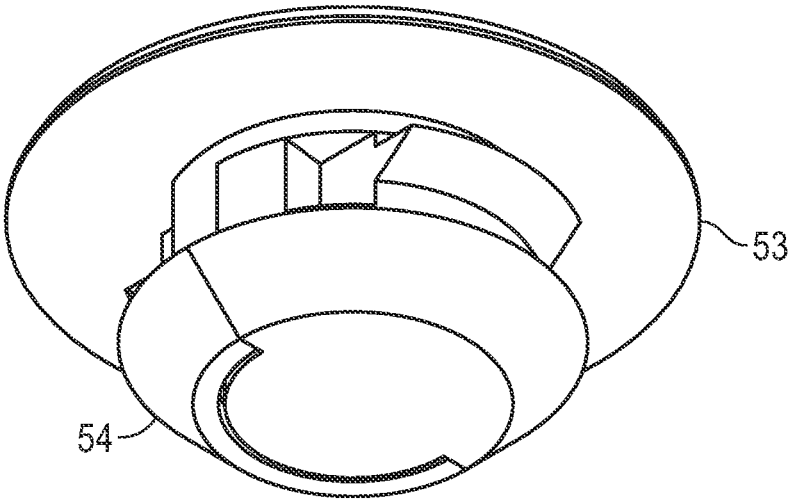
Figure 93:
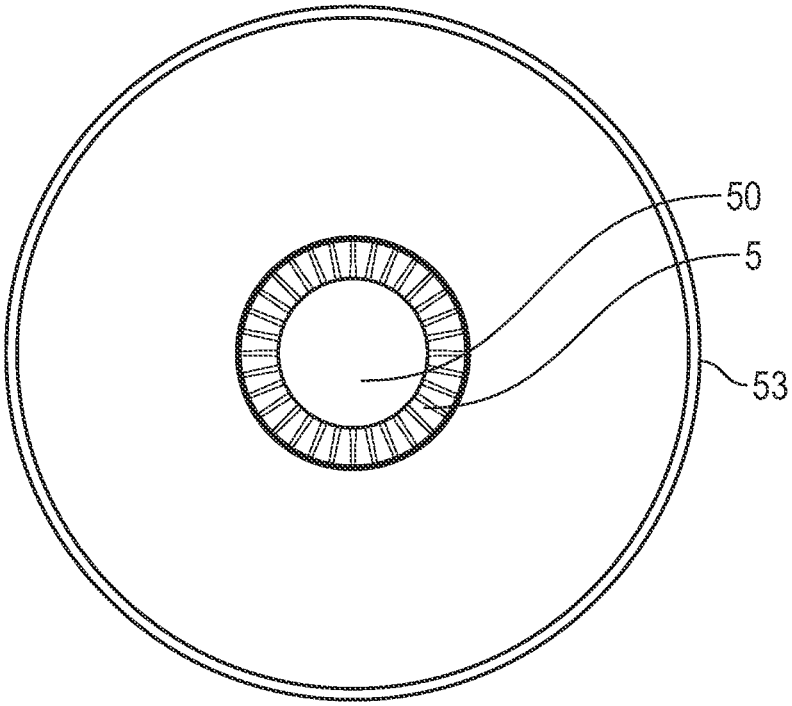
Figure 94:
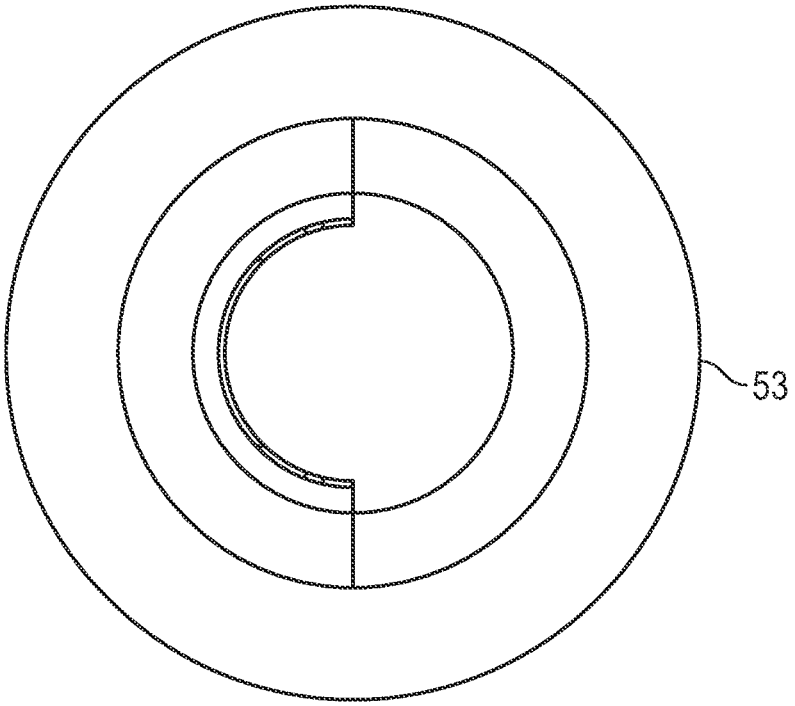
Figure 95:
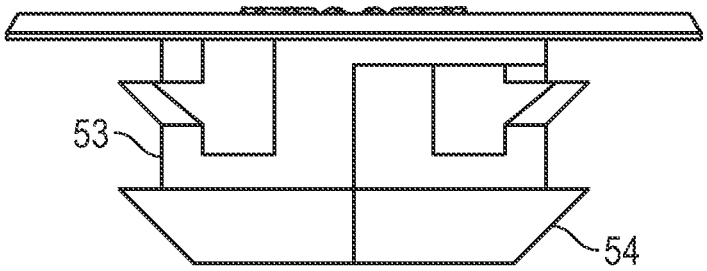
Figure 96:
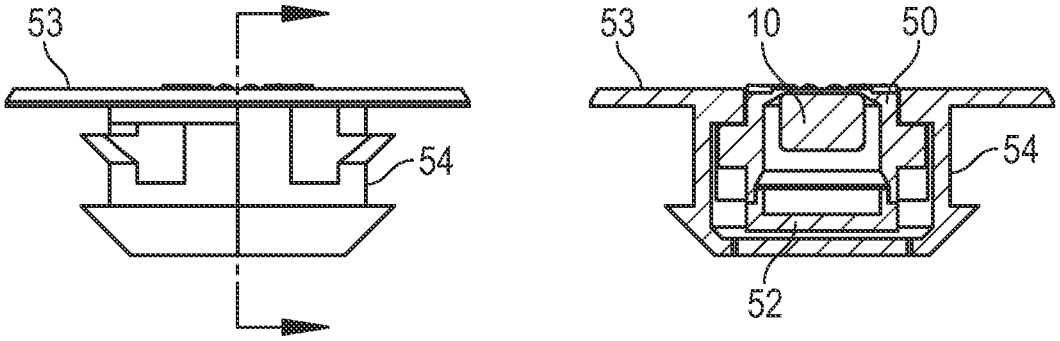
Figure 97:
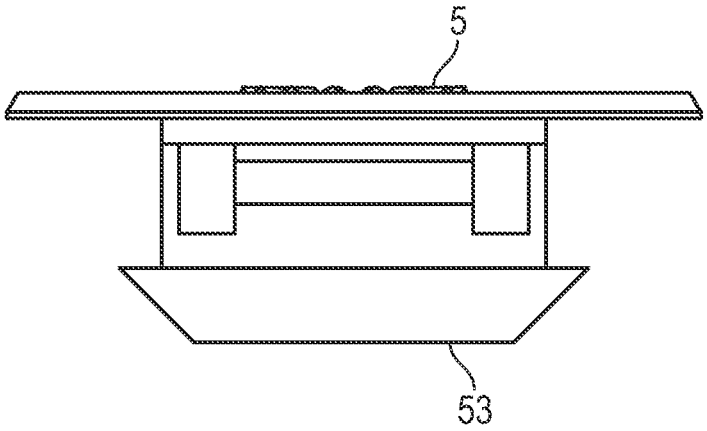
Figure 98:
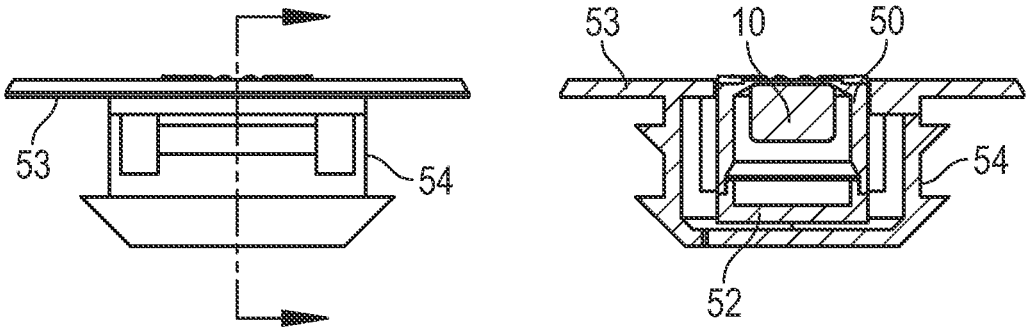

FIGS. 91-100 illustrate an exemplary embodiment that may include magnetic housing assembly that may include an ultrasonically, or chemically-welded hermetically-sealed or watertight enclosure to protect the magnet 10 from exposure to wet and corrosive environments. This seal may be created by capturing a magnet 10 between a ratcheting post and a lower cap 52. In FIGS. 91-100:

FIG. 91 is an isometric top view of the assembly with all parts combined;

FIG. 92 is an isometric bottom view of the assembly with the parts combined;

FIG. 93 is a top view of the assembly with the parts combined;

FIG. 94 is a bottom view of an assembly with the parts combined;

FIG. 95 is a front view of an assembly with the parts combined;

FIG. 96 is a front cross-sectional view of an assembly with the parts combined;

FIG. 97 is a side view of an assembly with the parts combined;

FIG. 98 is a side cross-sectional view of the assembly with the parts combined.

Figure 99:
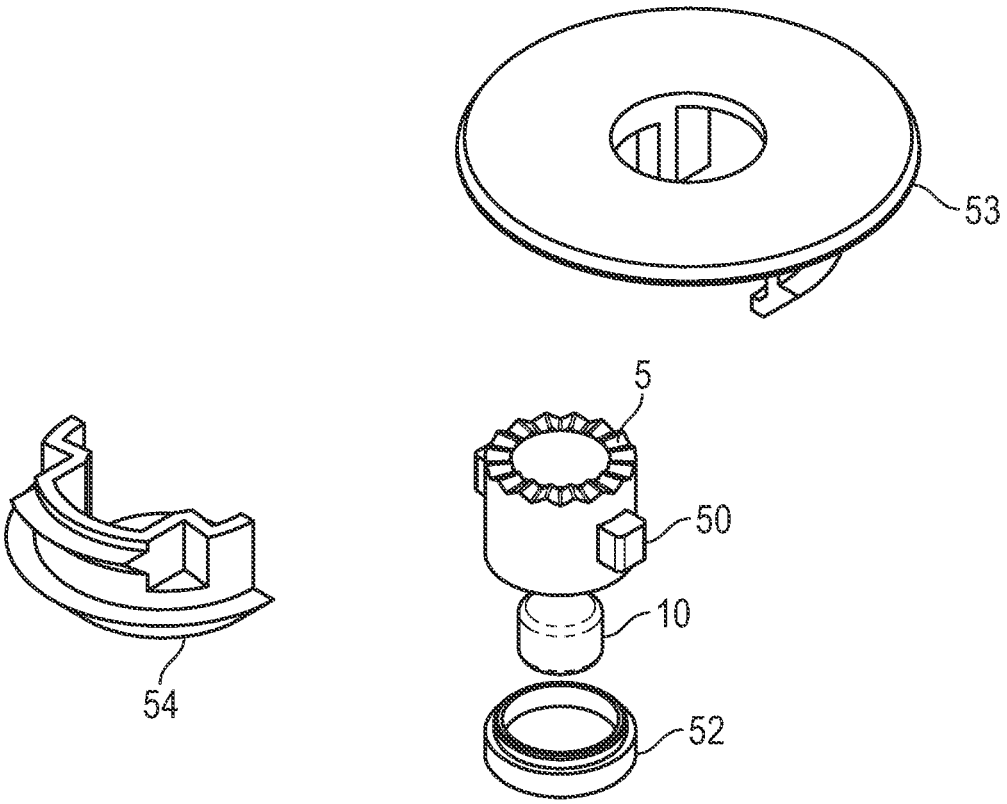
Figure 100:
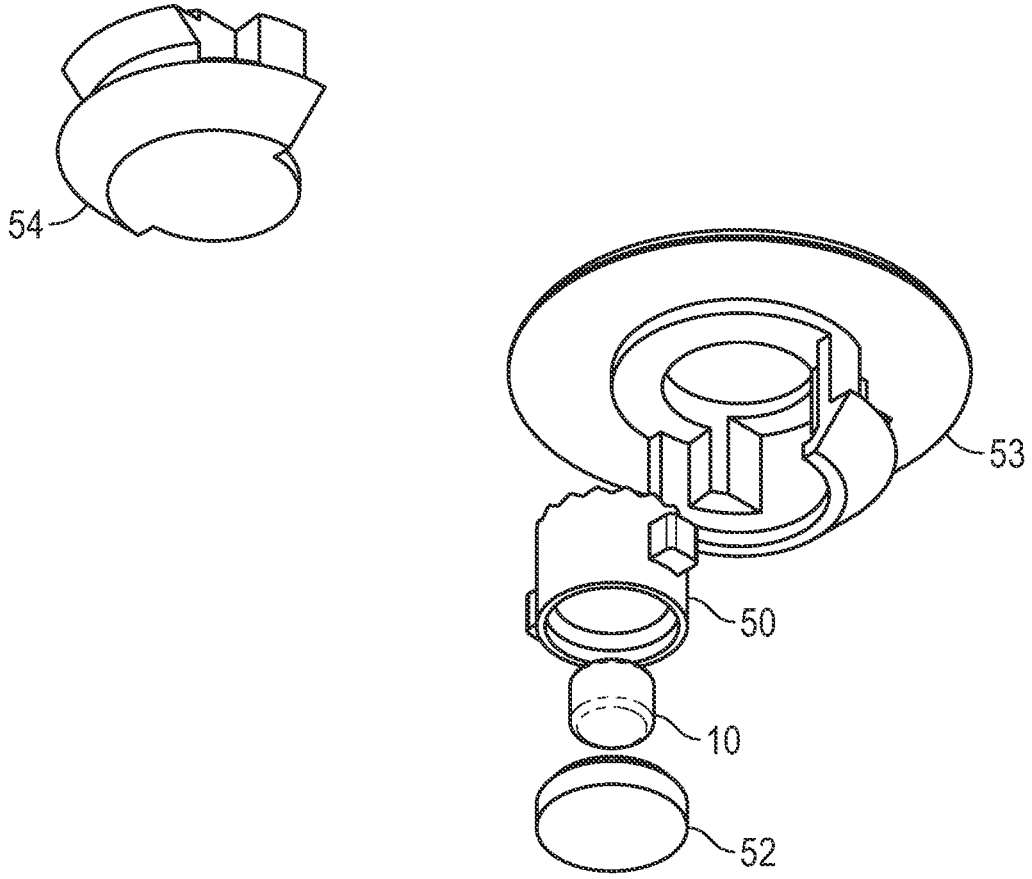

FIG. 99 is an exploded top isometric view of an exemplary magnetic housing assembly, that may include a ratcheting post, magnet, lower cap 52, main exterior housing 53 and side retention housing 54; and FIG. 100 is an exploded bottom isometric view of the magnetic housing that may include a ratcheting post, magnet, lower cap 52, main exterior housing 53 and side retention housing 54.

In this embodiment, the water tight chamber or hermetically sealed chamber which contains the magnet 10 may be defined by a hollow, generally cylindrical ratcheting post 50 which has the ratcheting face 5 on an upper surface, and is sealed at the bottom with a lower cap 52, possibly with ultrasonic welding. The ratcheting post may have one or more protruding posts or points of contact that extend outward from the curved exterior surface of the generally cylindrical body.

In this embodiment, the exterior housing 51 may be a bisected structure, with the ratcheting post 50/lower cap 52 assembly contained therein, between the two bisected halves. The bisected halves may be symmetrical.

The exterior housing captures the welded magnet 10 assembly within cavities formed when the main exterior housing 53 and side retention housing 54 may be ultrasonically welded together. The exterior housing may be defined by a bisected structure comprised of the main exterior housing 53 and side retention housing 54. The main exterior housing may have the larger upper diameter circle, and half of a generally cylindrical body, and the side retention housing 54 may have the other half of the generally cylindrical body. This assembly may also make for a second level of water resistance to liquids. Exterior small extrusion barbs with upward angular faces may help to facilitate an easy insertion into the mating foam body and a resistance to movement in the opposite direction upon insertion.

This embodiment may include a combination of parts to produce an assembly that allows exterior faces of connecting blocks to align in a planar manner (e.g. along the ratcheting faces 5). The contacting surfaces use a ratcheting interface to create a loud or audible clicking sound. This face may float for a few degrees radially to allow exterior faces of the blocks to align. The faces may also float axially so that the ratcheting teeth may pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Alternate forms of this embodiment may also eliminate the exterior barbs and instead include smooth glue-in method, cutting threads, a snap-in feature or other mechanical means of attachment.

The magnetic housing assembly 245 may be inserted into a hole-cut, or machined or injection-molded into, foam, wood, plastic, or other material. An inner assembly containing a hermetically-sealed or watertight enclosed magnet 10 is located within a plastic (or other material) housing that is inserted into the anchor body 21. The magnet 10 may be formed as a cube, sphere, cylinder, or other shaped component. The outer housing is fastened to the mating block through chemical bonding or mechanical interface methodology, which may include threads, barbs, expanding areas or mating snap-fit inner features.

This design may allow for the magnet 10 to flip within the housing, thereby allowing it to orient into the correct polarity orientation to pair with another magnetic block assembly.

Figure 101:
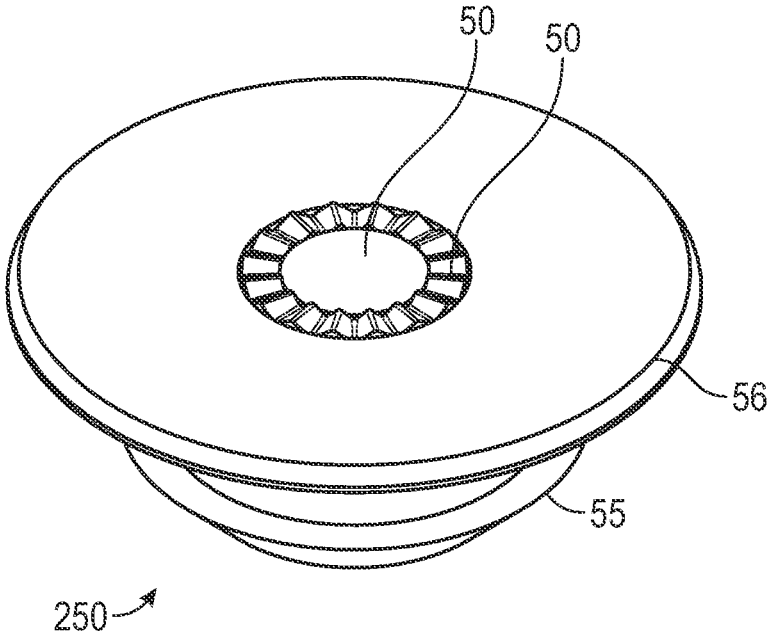
FIGS. 101-110 show various perspective views, a top view, a side view, cross-sectional views, and exploded views of an exemplary embodiment of a magnetic housing assembly which utilizes a ratcheting post.
Figure 102:
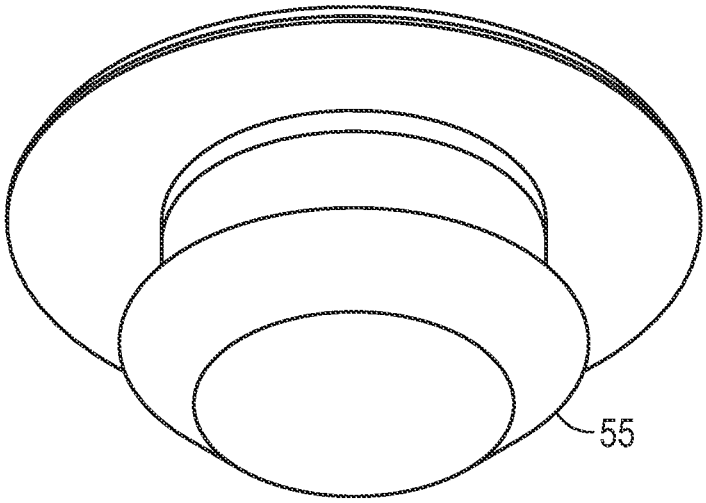
Figure 103:
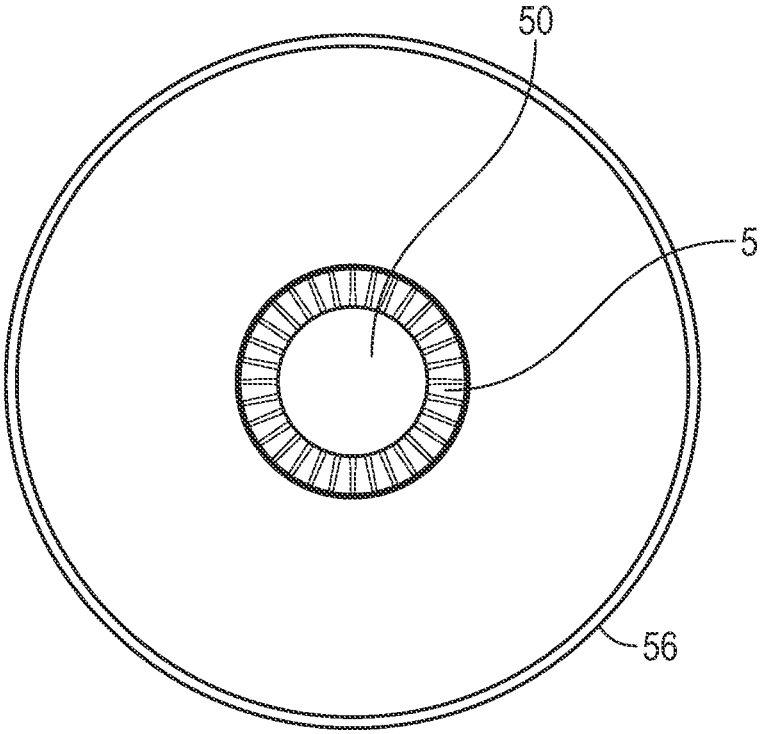
Figure 104:
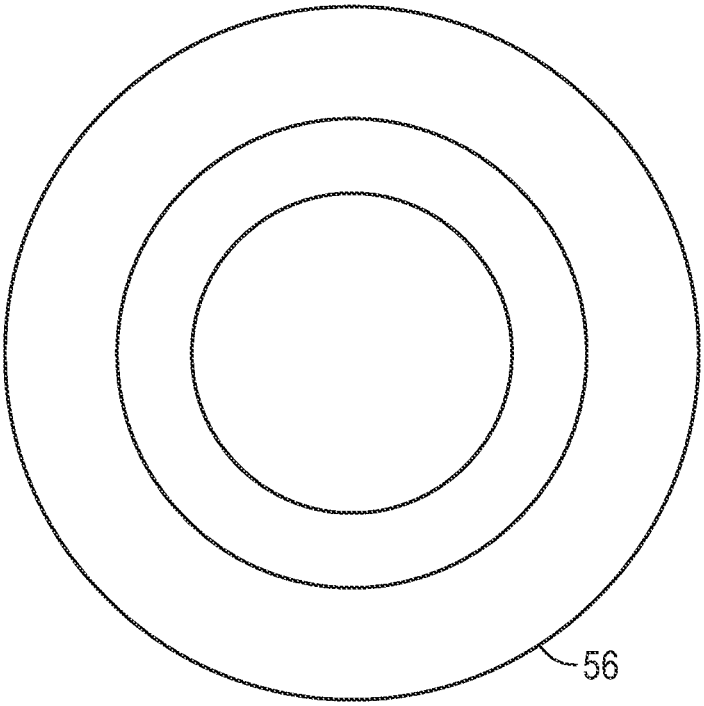
Figure 105:
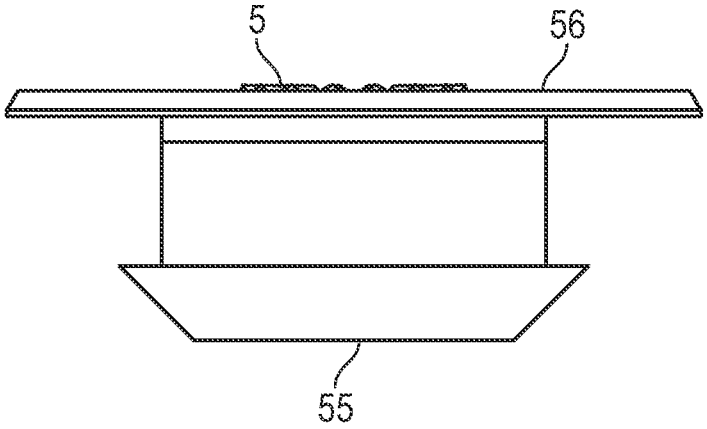
Figure 106:
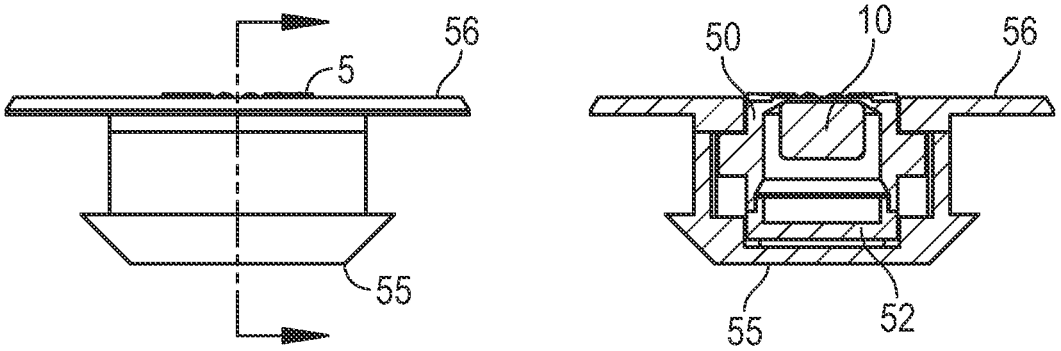
Figure 107:
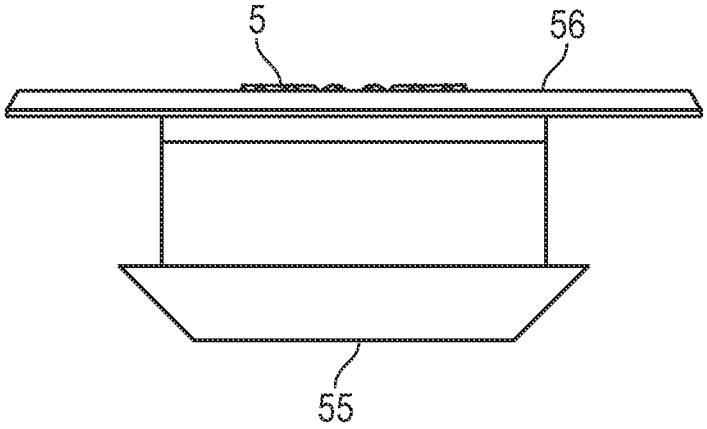
Figure 108:
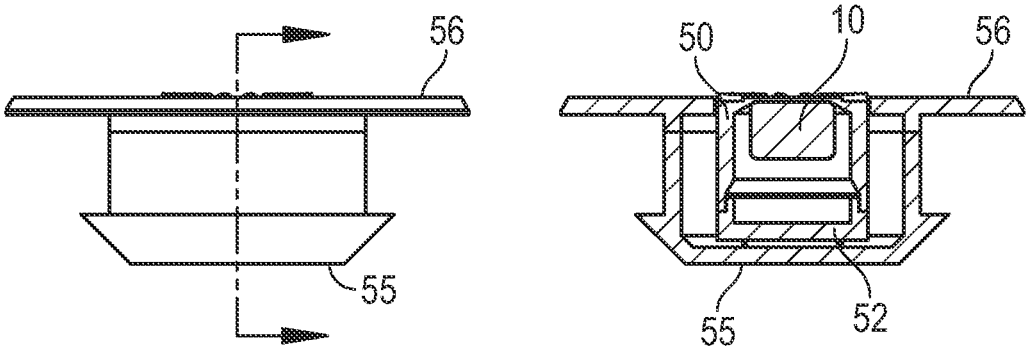
Figure 109:
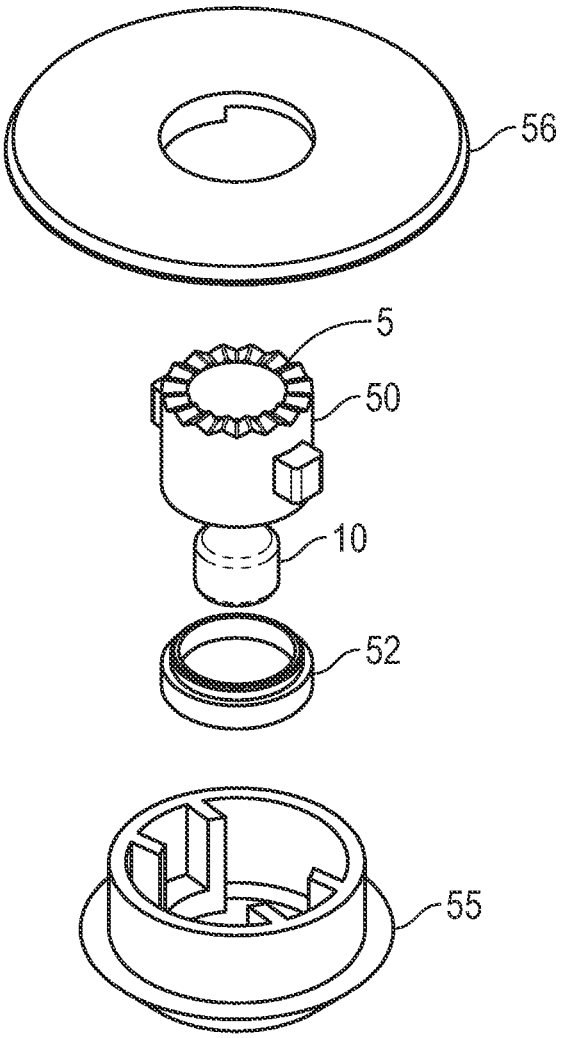
Figure 110:
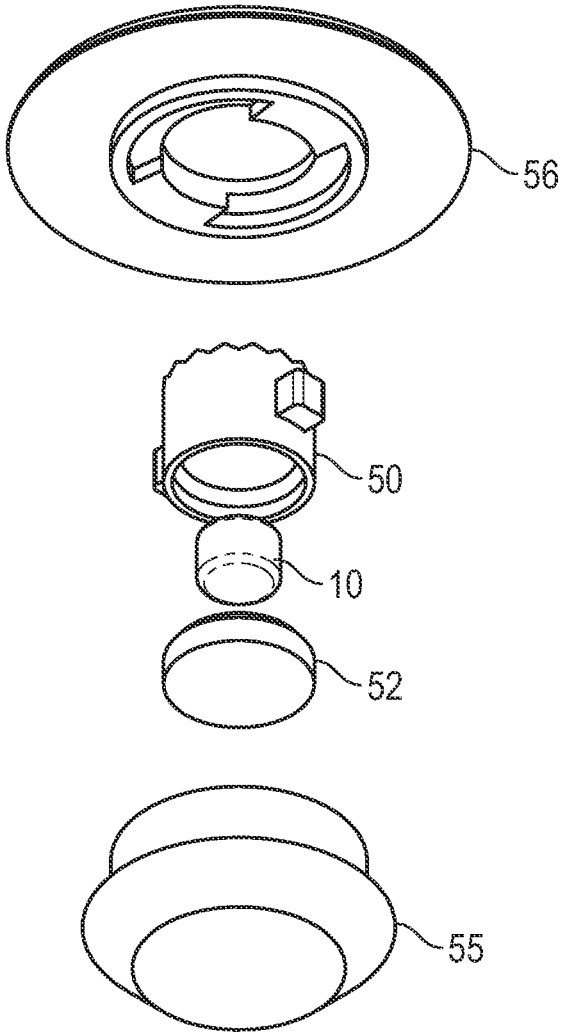

FIGS. 101-110 illustrate an embodiment of the magnetic housing assembly that uses an ultrasonically, or chemically-welded hermetically-sealed or watertight enclosure to protect the magnet 10 from exposure to wet and corrosive environments. This seal is created by capturing a magnet 10 between a ratcheting post 50 and a lower cap 52. In FIGS. 101-110:

FIG. 101 is an isometric top view of an assembly with all parts combined;

FIG. 102 is an isometric bottom view of the assembly with the parts combined;

FIG. 103 is a top view of the assembly with the parts combined;

FIG. 104 is a bottom view of an assembly with the parts combined;

FIG. 105 is a front view of an assembly with the parts combined;

FIG. 106 is a front cross-sectional view of an assembly with the parts combined;

FIG. 107 is a side view of an assembly with the parts combined;

FIG. 108 is a side cross-sectional view of the assembly with the parts combined;

FIG. 109 is an exploded top isometric view of an exemplary magnetic housing assembly, that may include a top cap 56, ratcheting post, magnet, lower cap 52 and lower housing 55; and FIG. 110 is an exploded bottom isometric view of the magnetic housing assembly that may include a top cap 56, ratcheting post, magnet, lower cap 52 and lower housing 55.

In this embodiment, the lower housing 55 may be generally cylindrical, and capped with a top cap 56 to form a top like shape. The ratcheting post 50 have a structure similar to that described above, and may define the water tight chamber or hermetically sealed chamber when ultrasonically welded to the lower cap 52. The ratcheting post 50/lower cap 52 assembly may then be captured between the lower housing 55 and the top cap 56 to form the magnetic housing assembly 250.

The exterior housing captures the welded magnet assembly within cavities formed when the top cap 56 and main lower housing 55 may be ultrasonically welded together. This assembly also enables a second level of water resistance to liquids. Exterior small extrusion barbs with upward angular faces help to facilitate an easy insertion into the mating foam body and a resistance to movement in the opposite direction upon insertion.

This design may include a combination of parts to produce an assembly that allows exterior faces of connecting blocks to align in a planar manner. The contacting surfaces include a ratcheting interface to create a loud or audible clicking sound. The face may float for a few degrees radially to allow exterior faces of the blocks to align. The faces may also float axially so that the ratcheting teeth may pass one another while allowing the remaining mating surfaces of the block to stay in contact as the blocks may be twisted in opposing directions. Blocks may be centered in line with each other through magnetism and the ratcheting teeth geometry which both interlocks and nests within the geometry of the mated block preventing misalignment through sheer force.

Alternate forms of this embodiment may also eliminate the exterior barbs and instead include smooth glue-in method, cutting threads, a snap-in feature or other mechanical means of attachment.

The magnetic housing assembly is inserted into an aperture configured to receive the body, or is machined or injection-molded into foam, wood, plastic, or other material. The inner assembly may contain a hermetically-sealed or watertight enclosed magnet, wherein the shape of the magnet may be a cube, sphere, cylinder, or other shaped component, within a plastic (or other material) housing that is inserted into the anchor body 21. The outer housing may be fastened to the mating block through chemical bonding or mechanical interface methodology, such as threads, barbs, expanding areas or mating snap-fit inner features.

This embodiment may allow the magnet 10 to flip within the housing, thereby allowing the magnet 10 to orient itself into the correct polarity to pair with another magnetic block assembly.

FIGS. 111-120 illustrate an assembled embodiment of a block containing magnetic housings according to any of the embodiments described herein. The exemplary blocks may be made of foam, wood, plastic or other suitable material, and may be formed in the shape of a sphere, truncated sphere, polyhedron, wedge, pyramid, disk, cylinder, cube, rectangle, polygon, or other rounded or multi-sided design.

Figure 111:
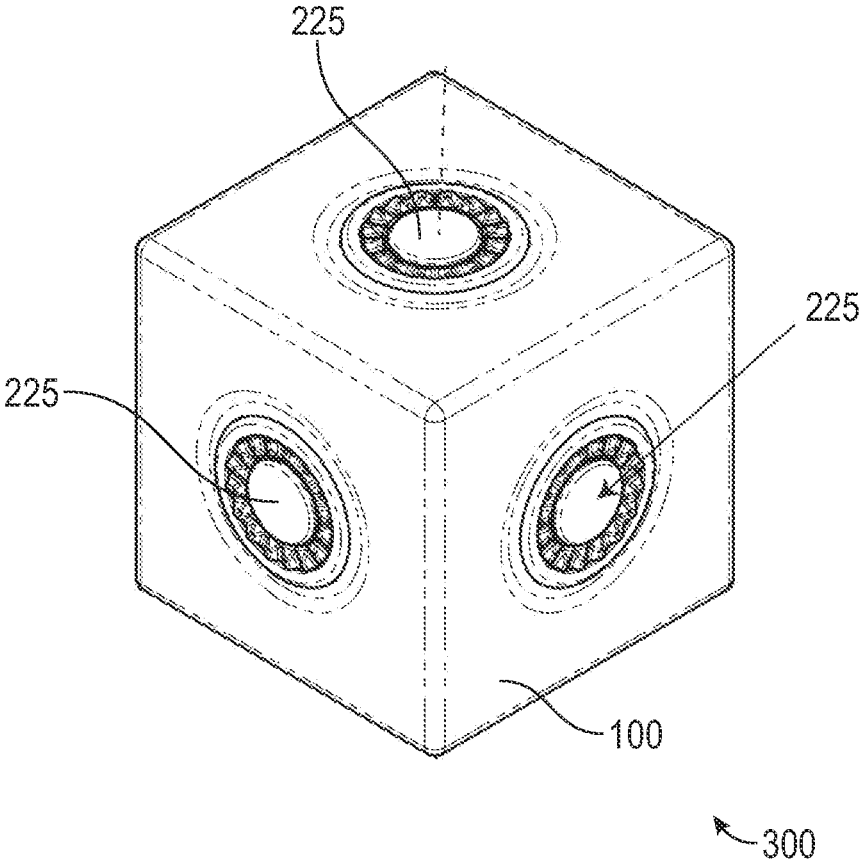
FIGS. 111-115 various perspective views, a cross sectional view, and exploded views of an exemplary embodiment of a magnetic attachment member assembly with all parts combined.
Figure 112:
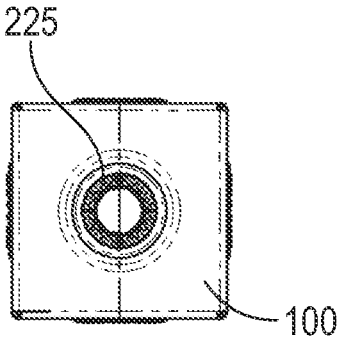
Figure 113:
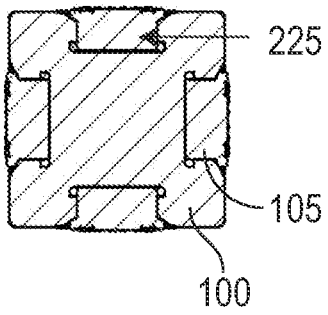
Figure 114:
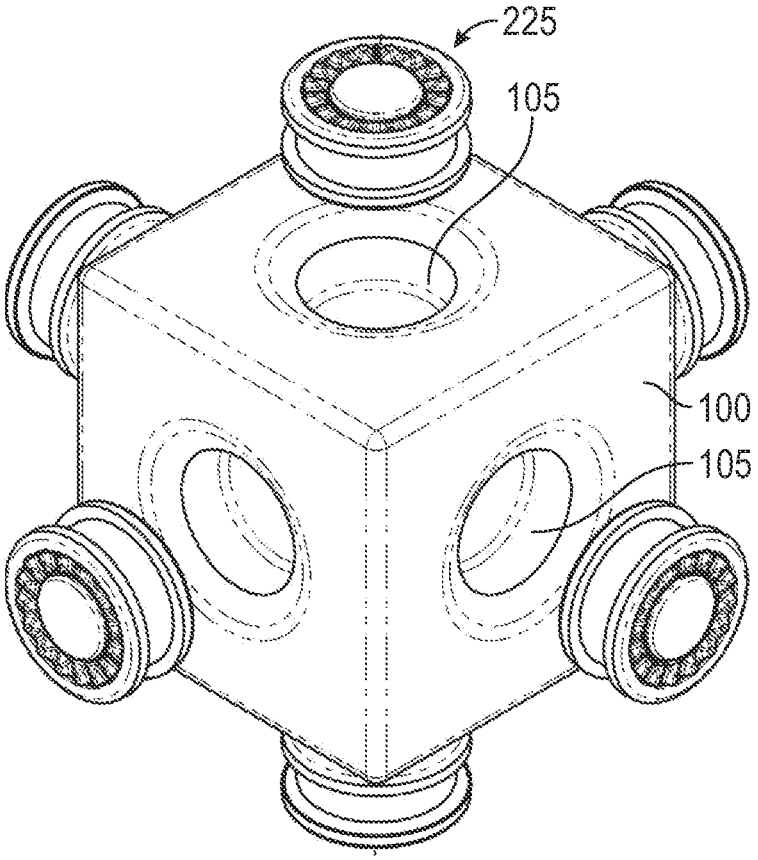
Figure 115:
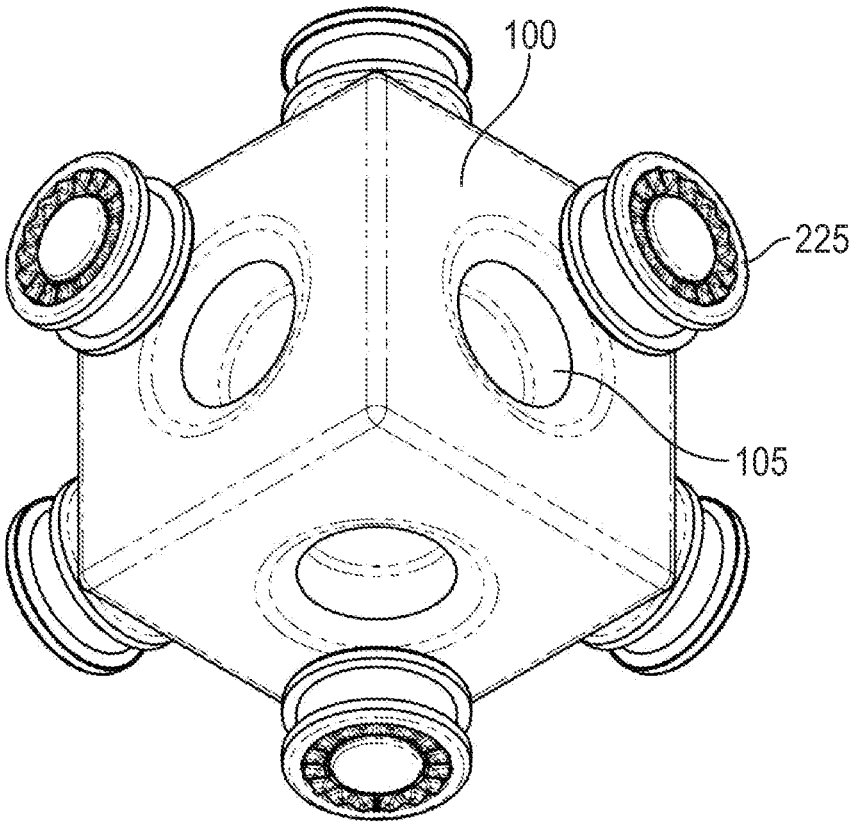

The exemplary embodiment is further described with reference to FIGS. 111-120, in which:

FIG. 111 is a representative view of a square shaped block assembly with all parts combined;

FIG. 112 is a side view of an assembly formed of combined parts;

FIG. 113 is a front cross-sectional view of an assembly with the parts combined;

FIG. 114 is an exploded top isometric view of the block and magnetic insert assembly; and FIG. 115 is an exploded bottom isometric view of the block and magnetic insert assembly.

Figure 116:
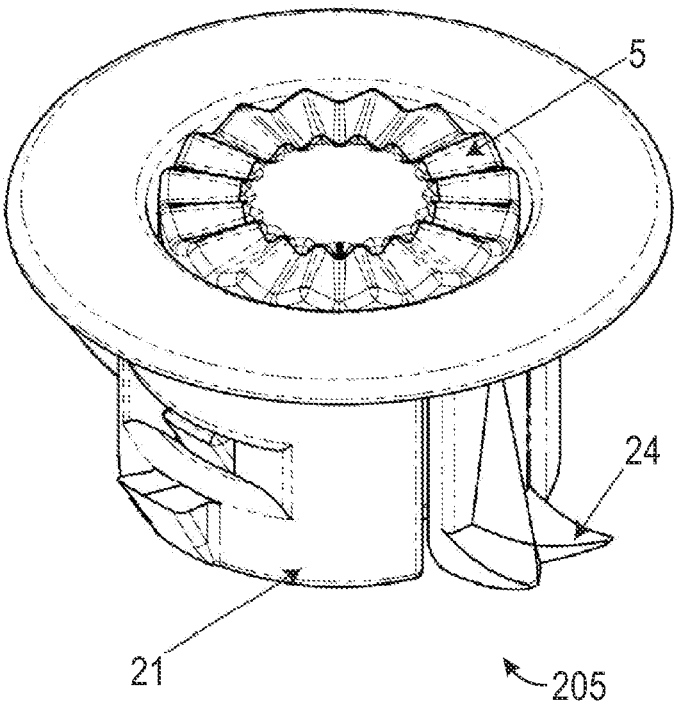
Figure 117:
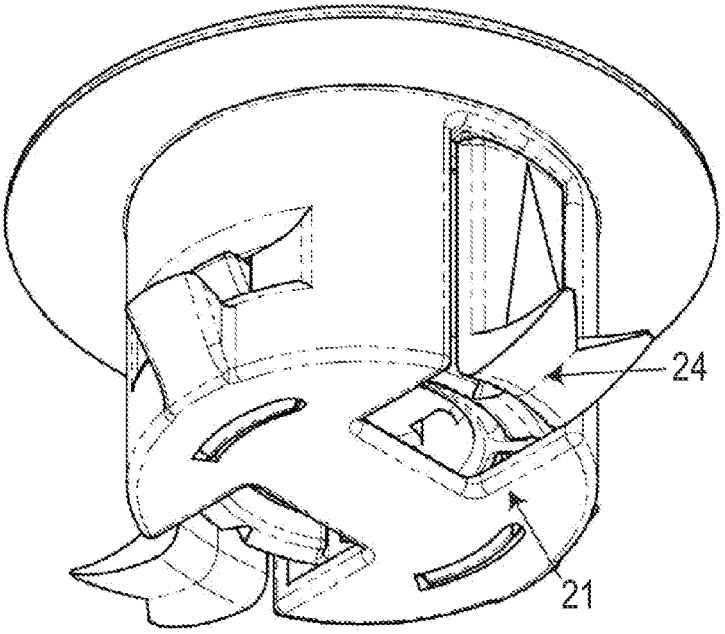
Figure 118:
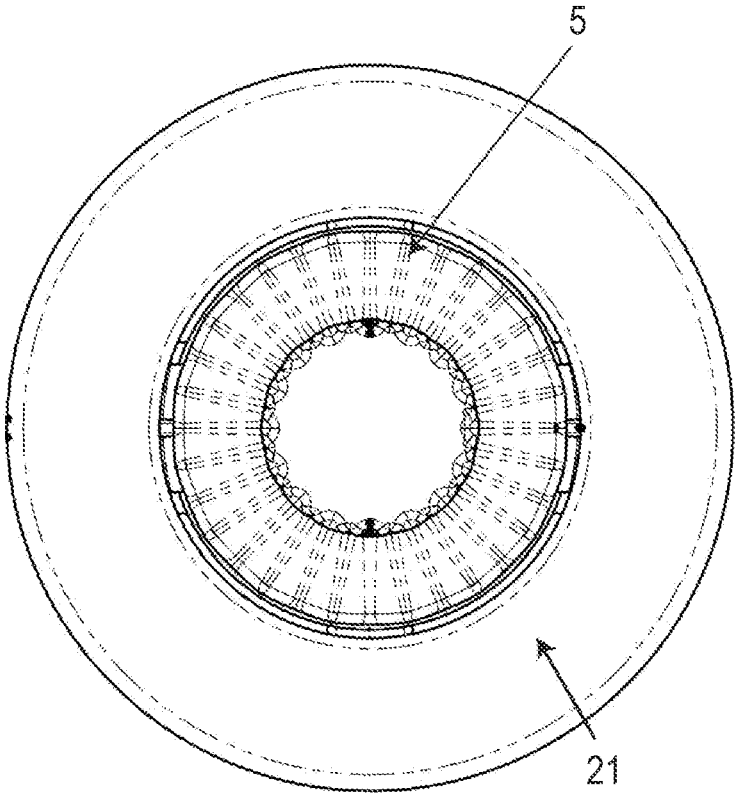
Figure 119:
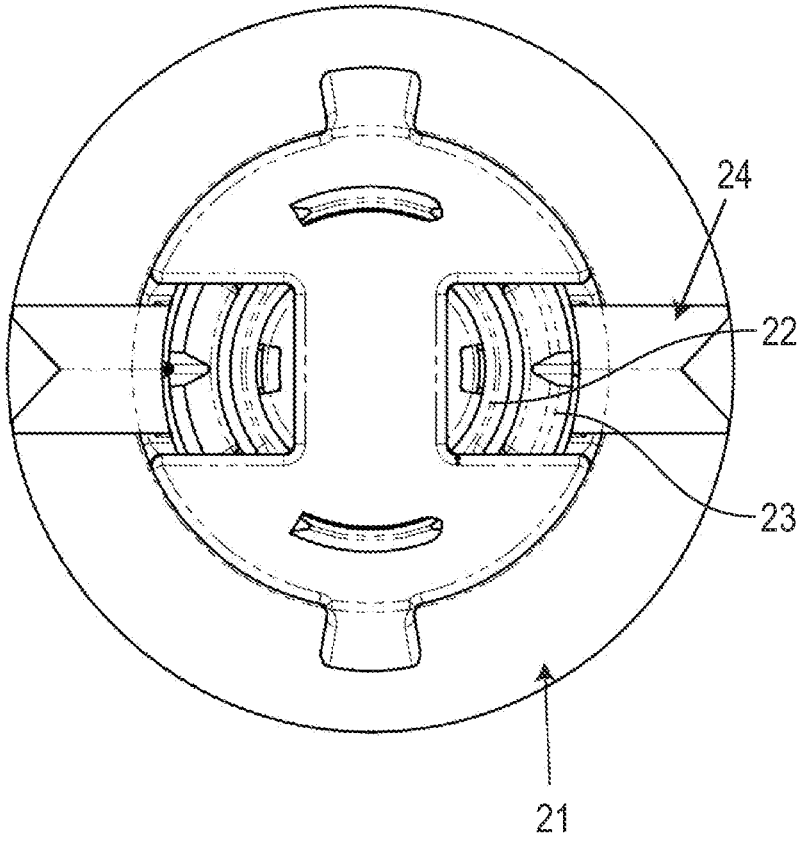
Figure 120:
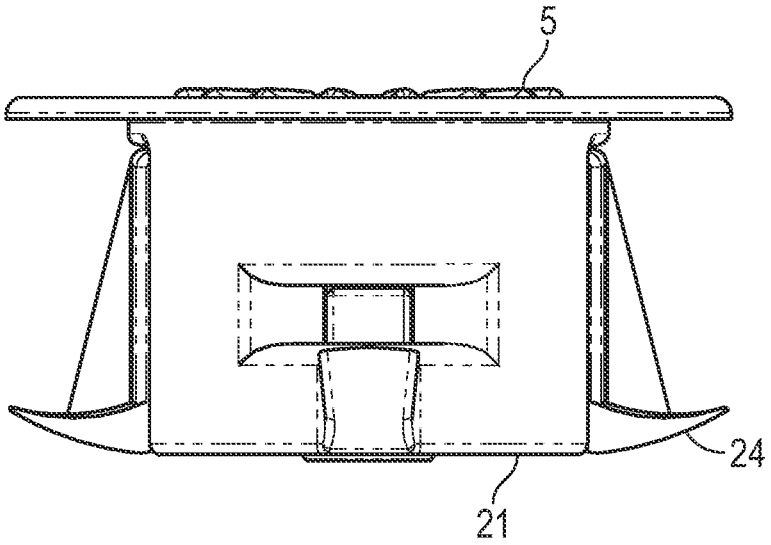
Figure 121:
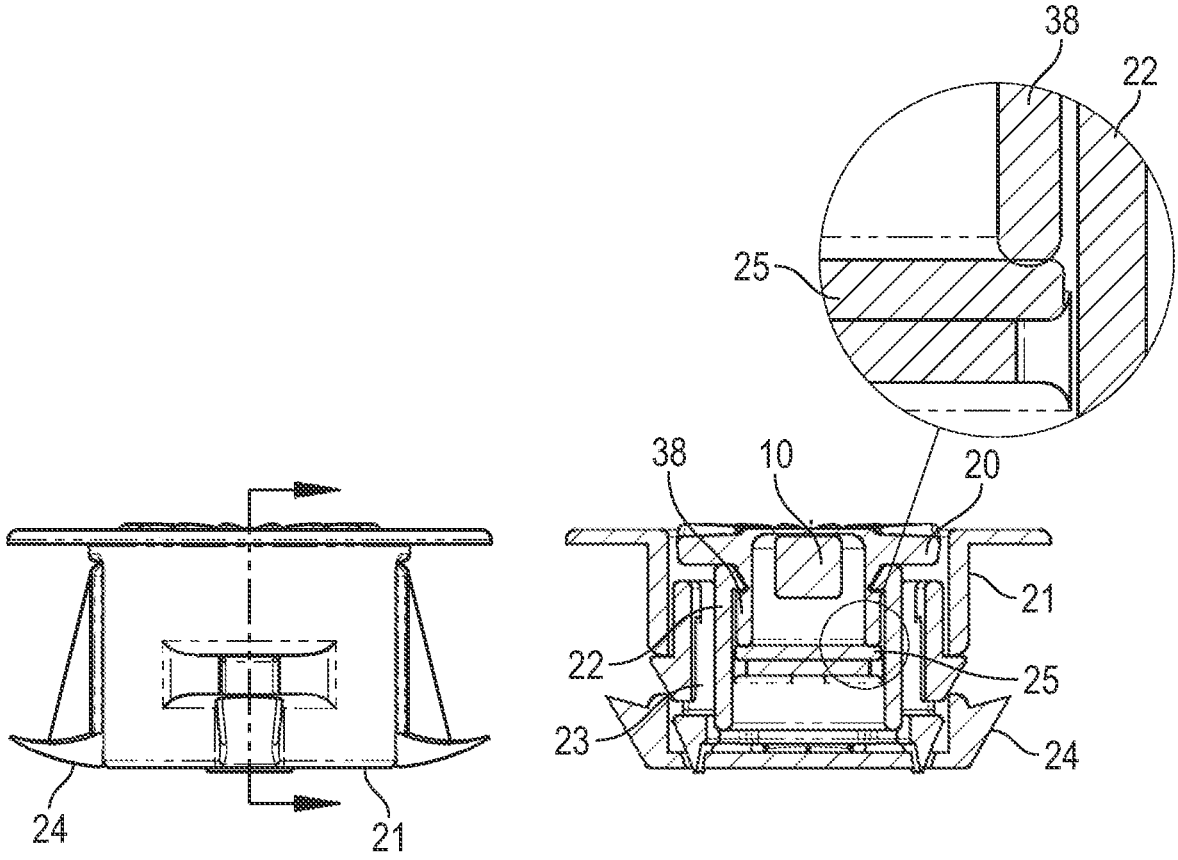
Figure 122:
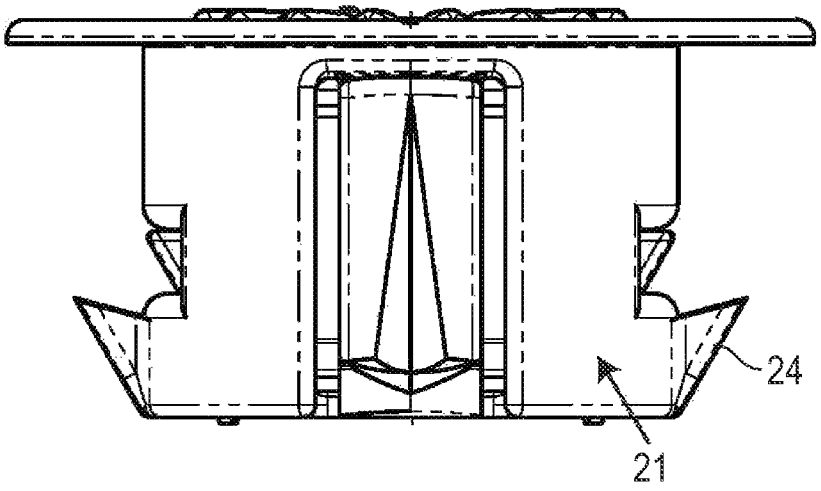
Figure 123:
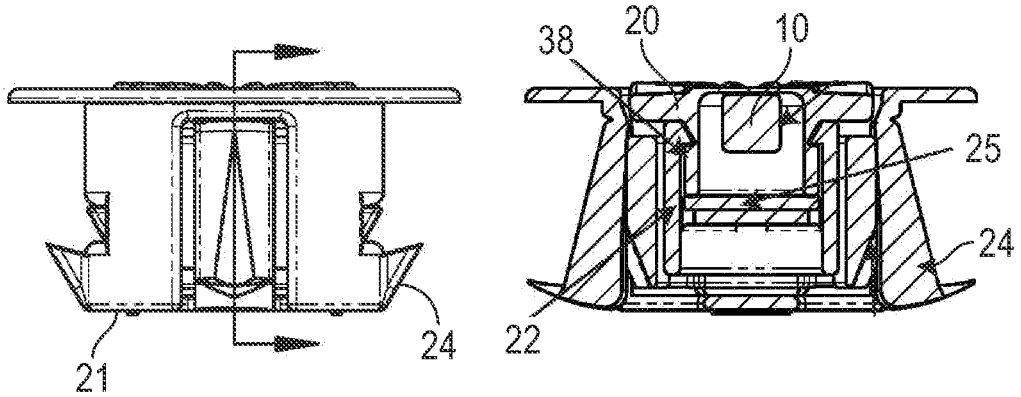
Figure 124:
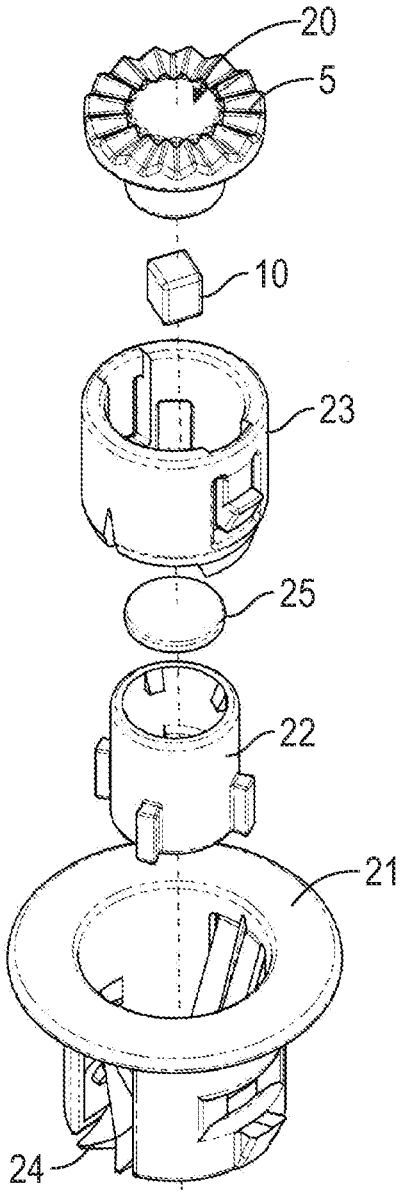
Figure 125:
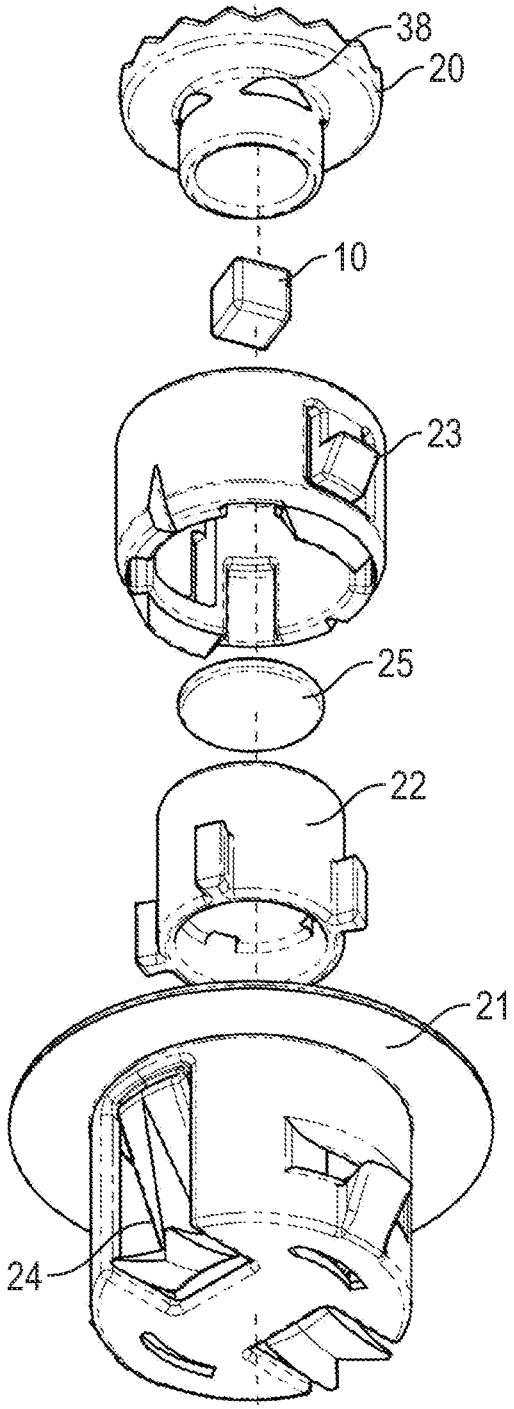
Figure 126:
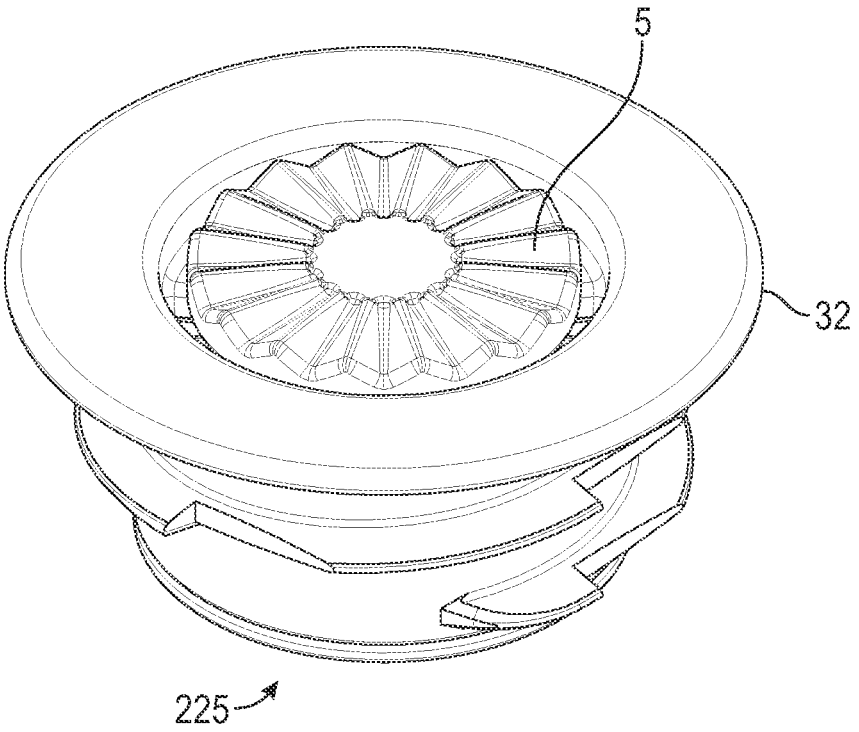
FIGS. 126-135 show various perspective views, a top view, a side view, cross-sectional views, and exploded views of an exemplary embodiment of a magnetic housing assembly which utilizes a ratcheting cap.
Figure 127:
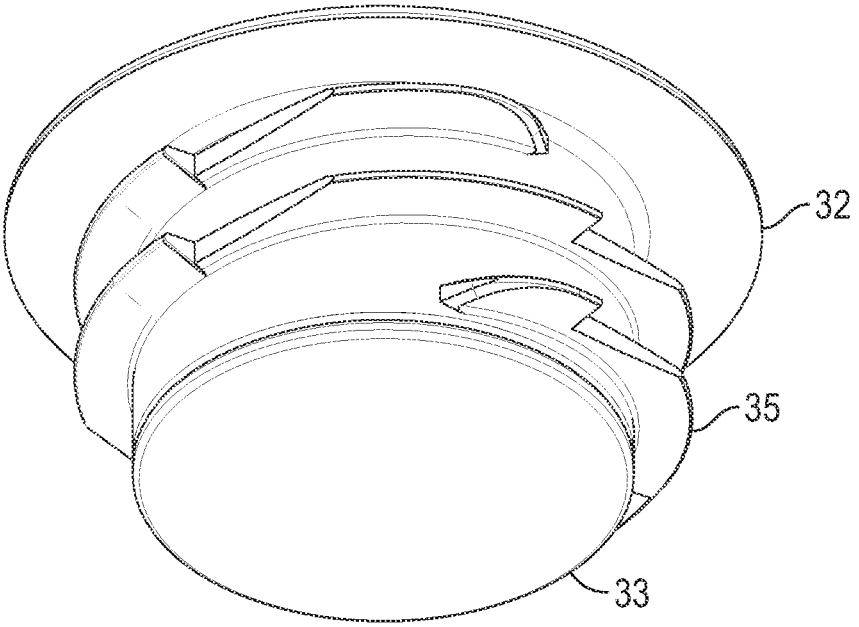
Figure 128:
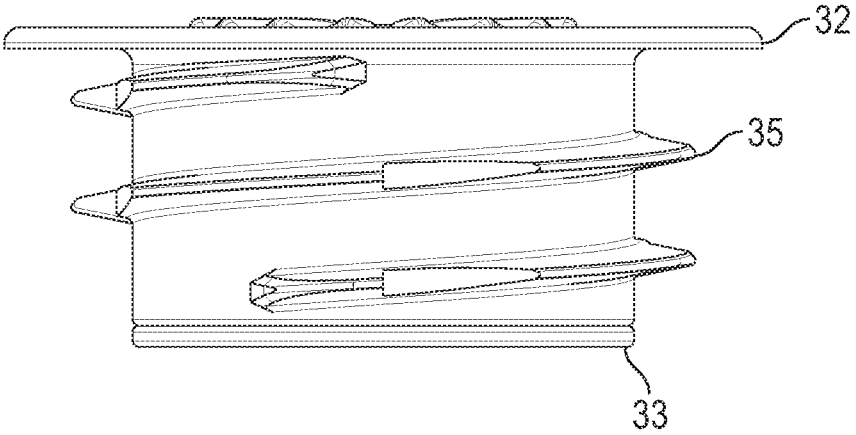
Figure 129:
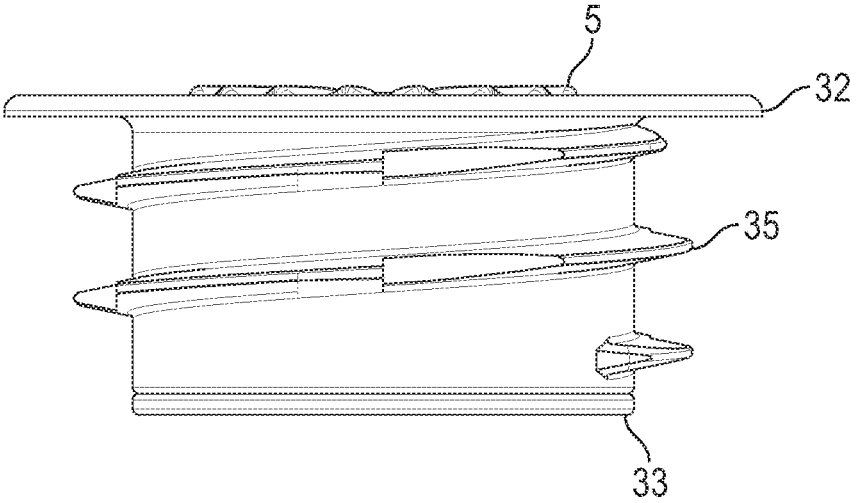
Figure 130:
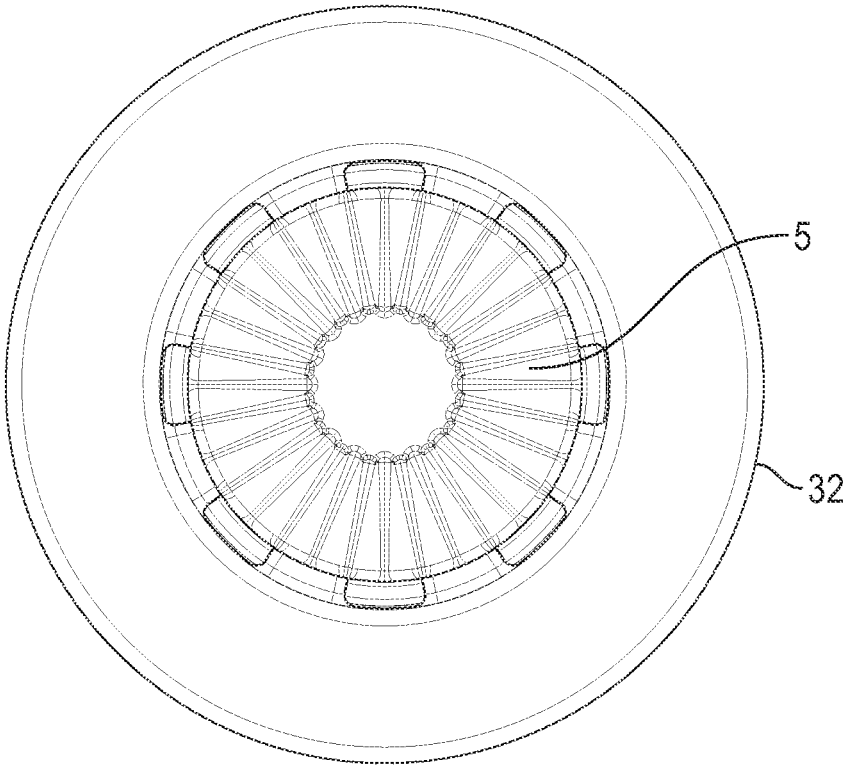
Figure 131:
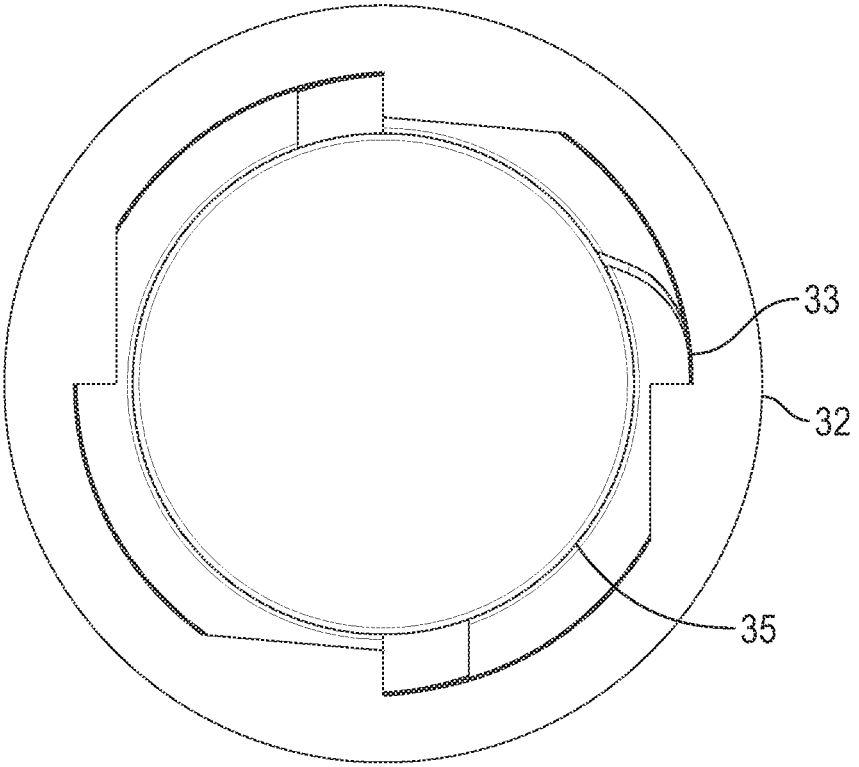
Figure 132:
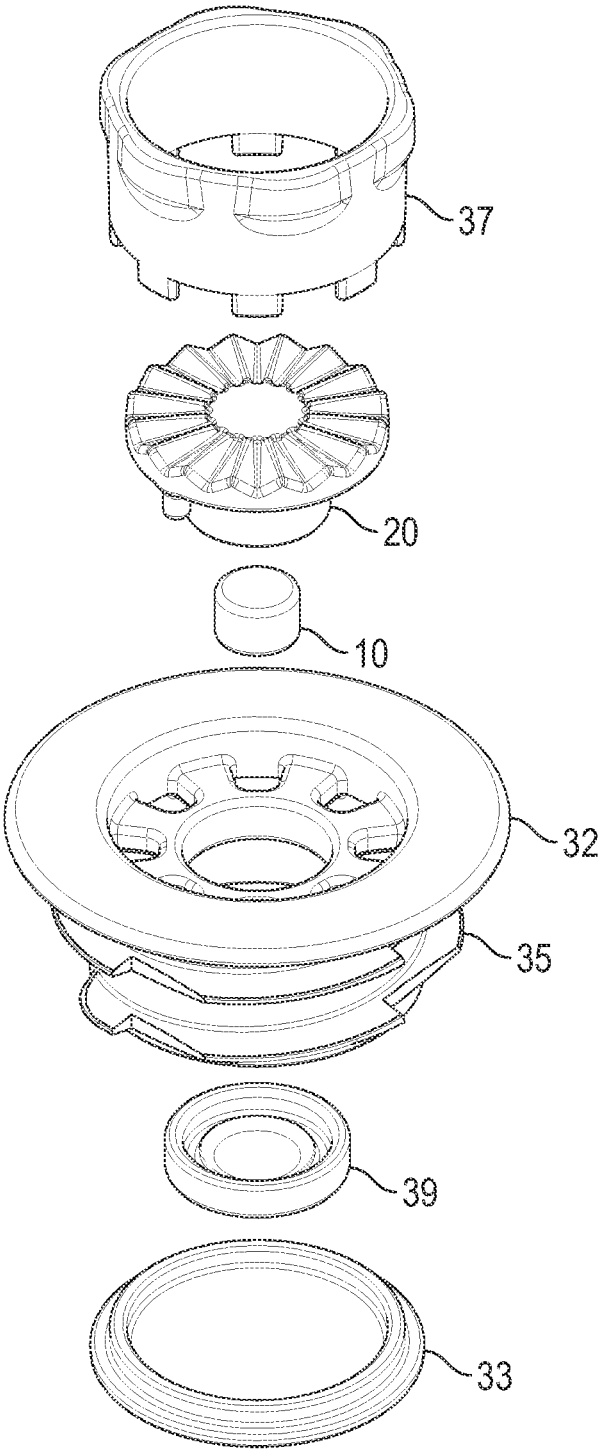
Figure 133:
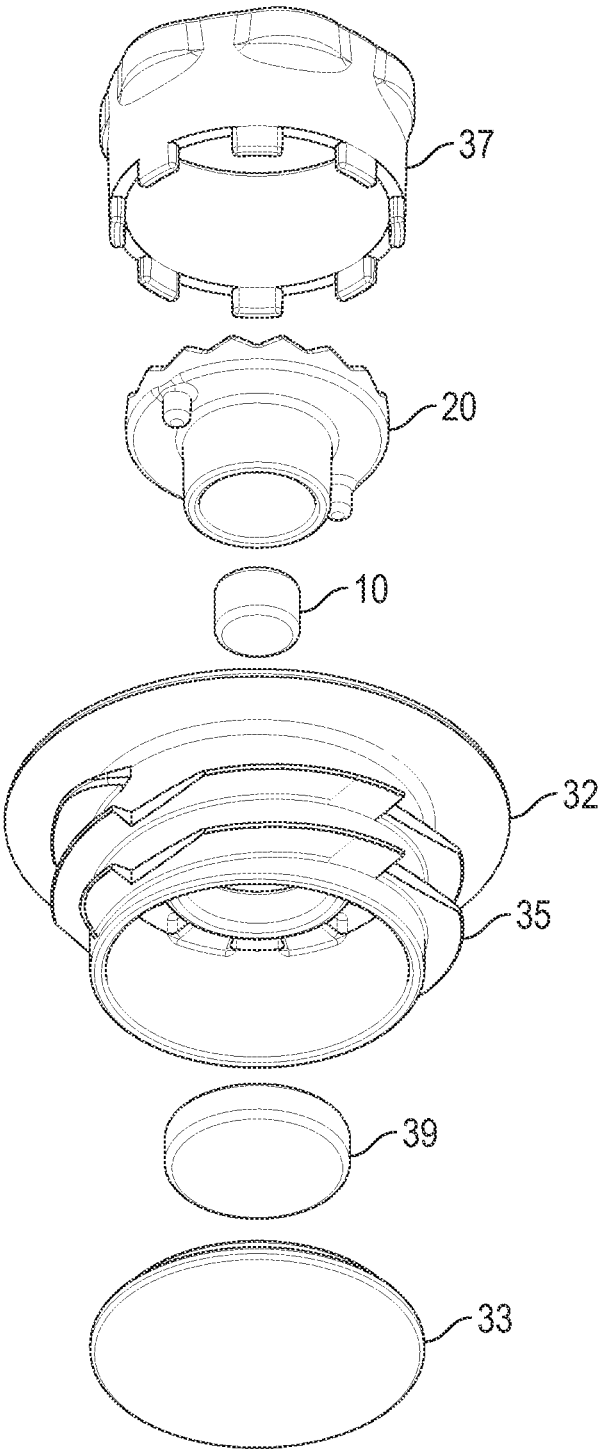
Figure 134:
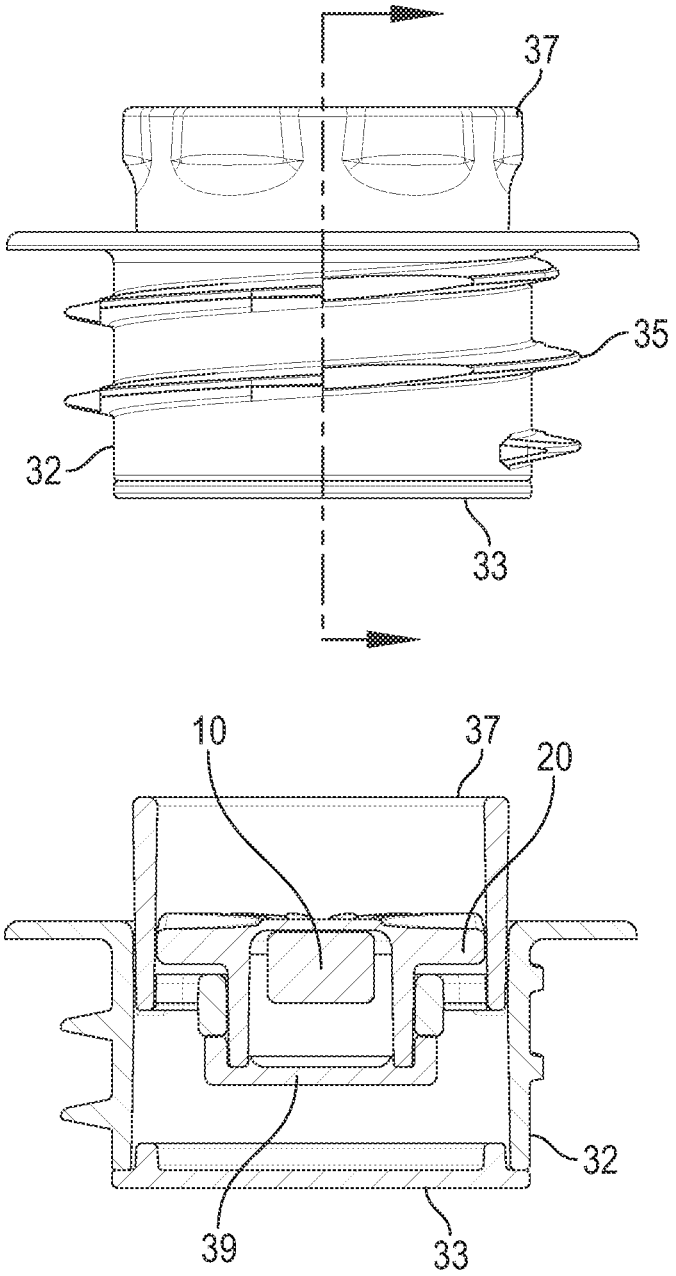
Figure 135:
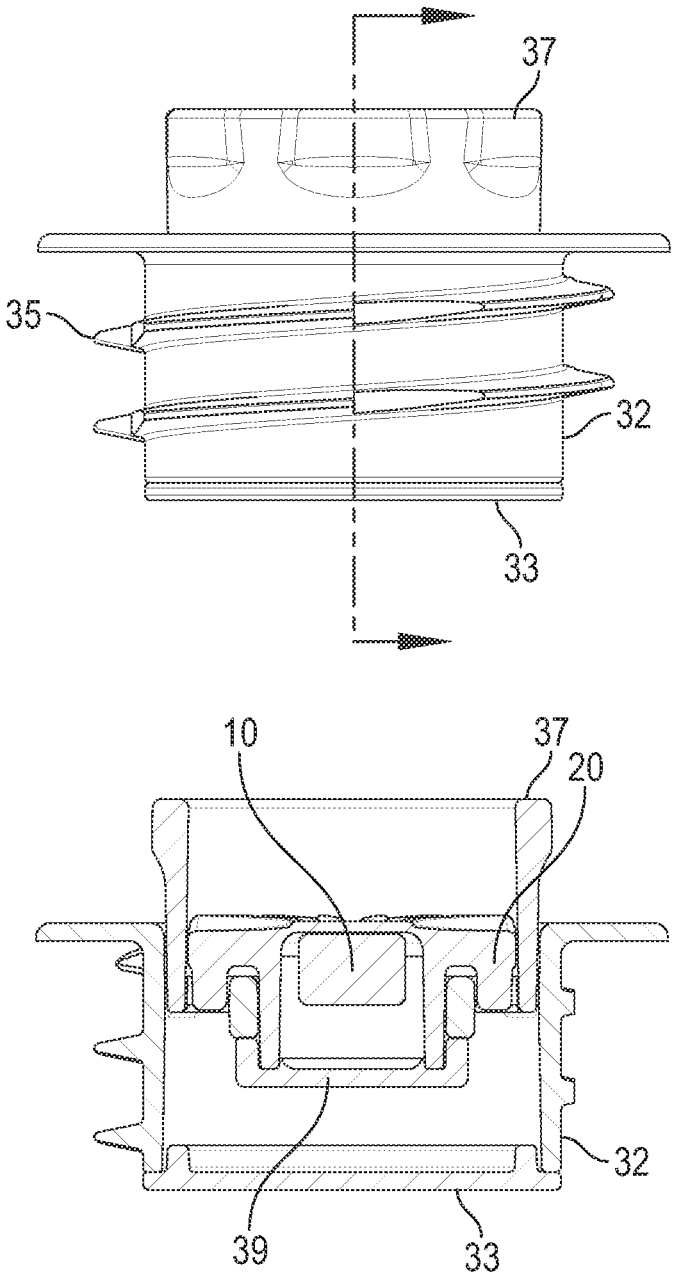

FIGS. 116-125 illustrate another exemplary embodiment in which a magnetic housing may include a snap fit hermetically-sealed or watertight enclosure having a rubber-like gasket 25 to protect the magnet 10 from exposure to wet and corrosive environments. In FIGS. 116-125:

FIG. 116 is an isometric top view of an assembly with all parts combined and the expanding features deployed;

FIG. 117 is an isometric bottom view of an assembly with the parts combined and the expanding features deployed;

FIG. 118 is a top view of the assembly with the parts combined and the expanding features deployed;

FIG. 119 is a bottom view of an assembly with the parts combined and the expanding features deployed;

FIG. 120 is a front view of an assembly with the parts combined and the expanding features deployed;

FIG. 121 is a front cross-sectional view of an assembly with the parts combined and the expanding features deployed;

FIG. 122 is a side view of an assembly with the parts combined and the expanding features deployed;

FIG. 123 is a side cross-sectional view of the assembly with the parts combined and the expanding features deployed;

FIG. 124 is an exploded top isometric view of an exemplary magnetic housing assembly, that may include a ratcheting face 5, magnet, containment housing 23, gasket 25, rotational limiting housing 22 and anchoring body 21; and FIG. 125 is an exploded bottom isometric view of the magnetic housing assembly that may include a ratcheting face 5, magnet, containment housing 23, gasket 25, rotational limiting housing 22 and anchoring body 21.

In this embodiment, the ratcheting cap 20 may be inserted into the rotational limiting housing 22 to define the hermetically sealed chamber, with a gasket 25 and magnet 10 within the chamber. The ratcheting cap 20/rotational limiting housing 22 assembly cay then be inserted into the containment housing 23, which may have one or more snap fittings along an exterior surface to insert into the outer housing anchor body 21, to complete the magnetic housing assembly 205. The anchor body 21 may have one or more anchoring body tabs 24, and a structure which is generally similar to the anchor body described above. The ratcheting cap 20 may further comprise one or more snap fittings 38 which allow it to attach to the rotational limiting housing 22.

Expanding features, such as when the inner housing assembly is inserted into the outer housing anchor body 21, anchoring body tabs 24 may be pushed outward and into the main body substrate, for example, foam, to permanently secure the assembly into the mating substrate, may be implemented to embed the plastic (or other material) housing into the foam (or other material) without the need for additional adhesives. This may overcome the challenges of permanently affixing two materials with low-surface energies. This may also reduce the time required to assemble the parts and may simplify the quality control process and secondary tests to ensure proper adhesion between the assemblies.

This embodiment may include a combination of parts to produce an assembly that allows exterior faces of connecting blocks to align in a planar manner. The contacting surfaces include a ratcheting interface to create a loud or audible clicking sound. The face preferably may float for a few degrees radially to allow exterior faces of the blocks to align. The faces may also float axially so that the ratcheting teeth may pass one another while allowing the remaining mating surfaces of the block to stay in contact as the blocks may be twisted in opposing directions.

In this embodiment, the magnetic housing assembly 205 may be inserted into a hole-cut, or may be machined, or injection-molded into, foam, wood, plastic, or other material. The inner assembly containing a hermetically-sealed or watertight enclosed magnet 10 within a plastic (or other material) housing that may be inserted into the anchor body 21. The magnet 10 may take the form of a cube, sphere, cylinder, or other shape. The interference between the anchor body tabs 24 and the plastic (or other material) housing preferably biases the anchor tabs outward into the foam (or other material) block tightly or permanently connecting the anchor body 21 and the foam (or other material). The connection between the anchor body 21 and the plastic (or other material) assembly may be made through a snap-fit tab locking the two parts together tightly or permanently.

This embodiment preferably may allow for the magnet 10 to flip within the housing, thereby allowing the magnet 10 to orient itself into the correct polarity to pair with another magnetic block assembly.

One of ordinary skill in the art will recognize the inventive principles disclosed are not limited to the embodiments disclosed herein, and that various aspects of the disclosed embodiments can be combined to achieve additional embodiments. The applications of the present invention have been described largely by reference to specific examples and in terms of particular allocations of functionality to certain components. However, those of skill in the art will recognize that the invention can also be produced by components that distribute the functions of embodiments of this invention differently than herein described. Such variations and implementations are understood to be captured according to this disclosure, the following claims and their equivalents.

In the figures, dimensions of the various elements, layers, etc. may be exaggerated for clarity of illustration. The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively. As used herein, the terms "substantially," "about," and similar terms are used as terms of approximation and not as terms of degree, and are intended to account for the inherent variations in measured or calculated values that would be recognized by those of ordinary skill in the art.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

What is claimed is:

1. A magnetic housing assembly comprising:
- a housing body;
- a first capping structure;
- a second capping structure;
- a water-tight chamber defined by the first capping structure and the second capping structure;
- a ratcheting face;
- a magnet enclosed within the water-tight chamber;
- at least one ridge on a perimeter of the housing body,
- wherein the magnet can flip to reverse polarity within the water-tight chamber,
- wherein the ratcheting face is configured to connect with another like ratcheting face, and
- wherein the ratcheting face is configured to allow adjustment of the magnetic housing assembly in a tangential direction when connected with another like ratcheting face.

2. The magnetic housing assembly of claim 1 wherein the housing body further comprises an exterior ring along a perimeter of the housing body that increases a diameter of the housing body, and wherein the magnetic housing assembly is configured to prevent choking by children by being too large to swallow.

3. The magnetic housing assembly of claim 1 further comprising a third capping structure attached to a bottom of the housing body.

4. The magnetic housing assembly of claim 1 wherein the ratcheting face is defined by a plurality of ridges, wherein the ridges are defined by a first upwardly slanting surface, and a second downwardly slanting surface, wherein the first upwardly slanting surface is connected to the second downwardly slanting surface.

5. The magnetic housing assembly of claim 4 wherein the plurality of ridges are arranged in a repeating pattern along a tangential direction.

6. The magnetic housing assembly of claim 5 wherein the plurality of ridges arranged in a repeating pattern along a tangential direction allows for rotational adjustment of the magnetic housing assembly along the ratcheting face when connected to another like ratcheting face according to a formula:

$$\theta \geq \frac{360^\circ}{2T}$$

wherein θ is a degree of rotational movement along a tangential direction, and T is a number of ridges in the ratcheting face.

7. The magnetic housing assembly of claim 5 wherein the plurality of ridges arranged in a repeating pattern along a tangential direction are spaced apart from one another as to allow tangential movement of the magnetic housing assembly in approximately 22.5-degree increments when connected to another like structure also having a plurality of ridges arranged in a same configuration, and allows for approximately 11.25-degrees of rotation in either a clockwise or counterclockwise direction from a neutral position between ridges before interlocking with a subsequent ridge.

8. The magnetic housing assembly of claim 5 wherein the plurality of ridges allow for 360-degree adjustment about an axis of the magnetic housing assembly when connected to another like structure also having a plurality of ridges arranged in a same configuration.

9. The magnetic housing assembly of claim 1 further comprising a plurality of slots in the housing body which allow for fluids to pass in and out of an interior of the housing body.

10. The magnetic housing assembly of claim 9 wherein the plurality of slots in the housing body are positioned on an interior surface of the housing body.

11. The magnetic housing assembly of claim 9 wherein the plurality of slots are configured to rotate the magnetic housing assembly when connected with a tool that has a plurality of teeth which inserts into the plurality of slots.

12. The magnetic housing assembly of claim 1 wherein the housing body and magnetic housing assembly are cylindrical in shape.

13. The magnetic housing assembly of claim 12 wherein the magnetic housing assembly with a cylindrical housing body further comprises a circular base with a larger radius than the cylindrical housing body at the top of the cylindrical housing body.

14. The magnetic housing assembly of claim 1 wherein the water-tight chamber is hermetically sealed by ultrasonically welding the first capping structure to the second capping structure.

15. The magnetic housing assembly of claim 1 wherein a ratcheting face is on the first capping structure.

16. The magnetic housing assembly of claim 1 wherein the at least one ridge on a perimeter of the housing body spirals around the housing body and varies in height along a length of the ridge.

17. A system comprising:

a plurality of magnetic housing assemblies, each magnetic housing assembly comprising:

a housing body;

a first capping structure;

a second capping structure;

a water-tight chamber defined by the first capping structure and the second capping structure;

a ratcheting face;

a magnet enclosed within the water-tight chamber;

at least one ridge on a perimeter of the housing body, wherein the magnet can flip to reverse polarity within the water-tight chamber, wherein the ratcheting face is configured to connect with another like ratcheting face, and wherein the ratcheting face is configured to allow adjustment of the magnetic housing assembly in a tangential direction when connected with another like ratcheting face; and a structure configured to house the plurality of magnetic housing assemblies while exposing the ratcheting face of each magnetic housing assembly housed in the structure.

18. The system of claim 17 further comprising a plurality of structures each configured to house a plurality of the magnetic housing assemblies.

19. The system of claim 18 wherein the plurality of structures are made from foam.

20. The system of claim 19 wherein the plurality of structures made from foam are block shaped, and a house a magnetic housing assembly within each face of the block.

* * * * *